US008897455B2

(12) United States Patent
Visser et al.

(10) Patent No.: US 8,897,455 B2
(45) **Date of Patent: *Nov. 25, 2014**

(54) MICROPHONE ARRAY SUBSET SELECTION FOR ROBUST NOISE REDUCTION

(75) Inventors: Erik Visser, San Diego, CA (US); Ernan Liu, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 711 days.

This patent is subject to a terminal disclaimer.

(21) Appl. No.: 13/029,582

(22) Filed: Feb. 17, 2011

(65) Prior Publication Data

US 2012/0051548 A1 Mar. 1, 2012

Related U.S. Application Data

(60) Provisional application No. 61/305,763, filed on Feb. 18, 2010.

(51) Int. Cl.

| | |
|---|---|
| ***H04R 29/00*** | (2006.01) |
| ***H04R 3/00*** | (2006.01) |
| ***G10L 21/0208*** | (2013.01) |
| *G10L 21/0216* | (2013.01) |

(52) U.S. Cl.

CPC ..... *H04R 3/005* (2013.01); *G10L 21/0208* (2013.01); *G10L 2021/02166* (2013.01)

USPC ..... 381/56; 381/26; 381/61; 381/313; 381/316; 381/92; 455/60; 455/139; 455/276.1; 702/190

(58) Field of Classification Search

CPC ..... H04R 3/005; H04R 25/40; H04R 25/402; H04R 25/405; H04R 25/407; H04R 25/43; H04R 25/48; H04R 2410/01; H04R 2430/20; H04R 2430/21; H04R 2430/23; H04R 2430/25; H04R 5/04; H04R 25/70; H04R 2499/13; G10L 19/008; G10L 25/06

USPC ..... 381/1, 17, 18, 19, 20, 23, 26, 56, 57, 381/61, 66, 312, 313, 23.1, 314, 316, 317, 381/318, 320, 321, 71.1, 71.14, 73.1, 77, 381/80, 81, 83, 86, 91, 92, 93, 94.1, 94.2, 381/94.3, 94.5, 94.7, 94.9, 95, 97, 98, 100, 381/101, 102, 103, 119, 120, 121, 122, 381/123; 455/60, 67.16, 139, 276.1, 277.2, 455/137, 138, 304; 700/94; 702/190, 191, 702/193, 194, 195, 196, 198, 199

See application file for complete search history.

(56) References Cited

U.S. PATENT DOCUMENTS 4,485,484 A * 11/1984 Flanagan ..... 381/92
4,653,102 A * 3/1987 Hansen ..... 381/92

(Continued)

FOREIGN PATENT DOCUMENTS

CN 1837846 A 9/2006
JP 2006197552 A 7/2006

(Continued)

OTHER PUBLICATIONS

International Search Report and Written Opinion—PCT/US2011/025512—ISA/EPO—Jun. 20, 2011.

(Continued)

*Primary Examiner* — Leshui Zhang

(74) *Attorney, Agent, or Firm* — Anthony Mauro; Espartaco Diaz Hidalgo

(57) ABSTRACT

A disclosed method selects a plurality of fewer than all of the channels of a multichannel signal, based on information relating to the direction of arrival of at least one frequency component of the multichannel signal.

40 Claims, 43 Drawing Sheets

(56) References Cited

U.S. PATENT DOCUMENTS

| | | | | |
|---|---|---|---|---|
| 5,524,059 | A * | 6/1996 | Zurcher | 381/92 |
| 6,069,961 | A | 5/2000 | Nakazawa | |
| 2003/0147538 | A1* | 8/2003 | Elko | 381/92 |
| 2006/0058983 | A1* | 3/2006 | Araki et al. | 702/190 |
| 2006/0215854 | A1 | 9/2006 | Suzuki et al. | |
| 2006/0233389 | A1 | 10/2006 | Mao et al. | |
| 2007/0160230 | A1* | 7/2007 | Nakagomi | 381/97 |
| 2008/0260175 | A1* | 10/2008 | Elko | 381/73.1 |
| 2008/0273476 | A1 | 11/2008 | Cohen | |
| 2009/0180633 | A1 | 7/2009 | Ishibashi | |
| 2009/0226005 | A1 | 9/2009 | Acero | |
| 2009/0238377 | A1 | 9/2009 | Ramakrishnan | |
| 2010/0296668 | A1 | 11/2010 | Lee | |
| 2011/0058683 | A1* | 3/2011 | Kosteva et al. | 381/92 |

FOREIGN PATENT DOCUMENTS

| | | | |
|---|---|---|---|
| JP | 2006211708 | A | 8/2006 |
| JP | 2007150743 | A | 6/2007 |
| WO | 2010048620 | A1 | 4/2010 |

OTHER PUBLICATIONS

Togami, M. et al. Stepwise phase difference restoration method for sound source localization using multiple microphone pairs. Proc. ICASSP 2007, IEEE, Apr. 15-20, 2007, pp. I-117-I-120.

* cited by examiner

MICROPHONE ARRAY SUBSET SELECTION FOR ROBUST NOISE REDUCTION

CLAIM OF PRIORITY UNDER 35 U.S.C. §119

The present application for patent claims priority to Provisional Application No. 61/305,763, entitled "MICROPHONE ARRAY SUBSET SELECTION FOR ROBUST NOISE REDUCTION," filed Feb. 18, 2010, and assigned to the assignee hereof and hereby expressly incorporated by reference herein.

BACKGROUND

1. Field

This disclosure relates to signal processing.

2. Background

Many activities that were previously performed in quiet office or home environments are being performed today in acoustically variable situations like a car, a street, or a café. For example, a person may desire to communicate with another person using a voice communication channel. The channel may be provided, for example, by a mobile wireless handset or headset, a walkie-talkie, a two-way radio, a car-kit, or another communications device. Consequently, a substantial amount of voice communication is taking place using mobile devices (e.g., smartphones, handsets, and/or headsets) in environments where users are surrounded by other people, with the kind of noise content that is typically encountered where people tend to gather. Such noise tends to distract or annoy a user at the far end of a telephone conversation. Moreover, many standard automated business transactions (e.g., account balance or stock quote checks) employ voice recognition based data inquiry, and the accuracy of these systems may be significantly impeded by interfering noise.

For applications in which communication occurs in noisy environments, it may be desirable to separate a desired speech signal from background noise. Noise may be defined as the combination of all signals interfering with or otherwise degrading the desired signal. Background noise may include numerous noise signals generated within the acoustic environment, such as background conversations of other people, as well as reflections and reverberation generated from the desired signal and/or any of the other signals. Unless the desired speech signal is separated from the background noise, it may be difficult to make reliable and efficient use of it. In one particular example, a speech signal is generated in a noisy environment, and speech processing methods are used to separate the speech signal from the environmental noise.

Noise encountered in a mobile environment may include a variety of different components, such as competing talkers, music, babble, street noise, and/or airport noise. As the signature of such noise is typically nonstationary and close to the user's own frequency signature, the noise may be hard to model using traditional single-microphone or fixed beamforming type methods. Single-microphone noise-reduction techniques typically require significant parameter tuning to achieve optimal performance. For example, a suitable noise reference may not be directly available in such cases, and it may be necessary to derive a noise reference indirectly. Therefore multiple-microphone-based advanced signal processing may be desirable to support the use of mobile devices for voice communications in noisy environments.

SUMMARY

A method of processing a multichannel signal according to a general configuration includes calculating, for each of a plurality of different frequency components of the multichannel signal, a difference between a phase of the frequency component at a first time in each of a first pair of channels of the multichannel signal, to obtain a first plurality of phase differences; and calculating, based on information from the first plurality of calculated phase differences, a value of a first coherency measure that indicates a degree to which the directions of arrival of at least the plurality of different frequency components of the first pair at the first time are coherent in a first spatial sector. This method also includes calculating, for each of the plurality of different frequency components of the multichannel signal, a difference between a phase of the frequency component at a second time in each of a second pair of channels of the multichannel signal (the second pair being different than the first pair), to obtain a second plurality of phase differences; and calculating, based on information from the second plurality of calculated phase differences, a value of a second coherency measure that indicates a degree to which the directions of arrival of at least the plurality of different frequency components of the second pair at the second time are coherent in a second spatial sector. This method also includes calculating a contrast of the first coherency measure by evaluating a relation between the calculated value of the first coherency measure and an average value of the first coherency measure over time; and calculating a contrast of the second coherency measure by evaluating a relation between the calculated value of the second coherency measure and an average value of the second coherency measure over time. This method also includes selecting one among the first and second pairs of channels based on which among the first and second coherency measures has the greatest contrast. The disclosed configurations also include a computer-readable storage medium having tangible features that cause a machine reading the features to perform such a method.

An apparatus for processing a multichannel signal according to a general configuration includes means for calculating, for each of a plurality of different frequency components of the multichannel signal, a difference between a phase of the frequency component at a first time in each of a first pair of channels of the multichannel signal, to obtain a first plurality of phase differences; and means for calculating a value of a first coherency measure, based on information from the first plurality of calculated phase differences, that indicates a degree to which the directions of arrival of at least the plurality of different frequency components of the first pair at the first time are coherent in a first spatial sector. This apparatus also includes means for calculating, for each of the plurality of different frequency components of the multichannel signal, a difference between a phase of the frequency component at a second time in each of a second pair of channels of the multichannel signal (the second pair being different than the first pair), to obtain a second plurality of phase differences; and means for calculating a value of a second coherency measure, based on information from the second plurality of calculated phase differences, that indicates a degree to which the directions of arrival of at least the plurality of different frequency components of the second pair at the second time are coherent in a second spatial sector. This apparatus also includes means for calculating a contrast of the first coherency measure by evaluating a relation between the calculated value of the first coherency measure and an average value of the first coherency measure over time; and means for calculating a contrast of the second coherency measure by evaluating a relation between the calculated value of the second coherency measure and an average value of the second coherency measure over time. This apparatus also includes means for selecting one among the first and second pairs of channels, based on which among the first and second coherency measures has the greatest contrast.

An apparatus for processing a multichannel signal according to another general configuration includes a first calculator configured to calculate, for each of a plurality of different frequency components of the multichannel signal, a difference between a phase of the frequency component at a first time in each of a first pair of channels of the multichannel signal, to obtain a first plurality of phase differences; and a second calculator configured to calculate a value of a first coherency measure, based on information from the first plurality of calculated phase differences, that indicates a degree to which the directions of arrival of at least the plurality of different frequency components of the first pair at the first time are coherent in a first spatial sector. This apparatus also includes a third calculator configured to calculate, for each of the plurality of different frequency components of the multichannel signal, a difference between a phase of the frequency component at a second time in each of a second pair of channels of the multichannel signal (the second pair being different than the first pair), to obtain a second plurality of phase differences; and a fourth calculator configured to calculate a value of a second coherency measure, based on information from the second plurality of calculated phase differences, that indicates a degree to which the directions of arrival of at least the plurality of different frequency components of the second pair at the second time are coherent in a second spatial sector. This apparatus also includes a fifth calculator configured to calculate a contrast of the first coherency measure by evaluating a relation between the calculated value of the first coherency measure and an average value of the first coherency measure over time; and a sixth calculator configured to calculate a contrast of the second coherency measure by evaluating a relation between the calculated value of the second coherency measure and an average value of the second coherency measure over time. This apparatus also includes a selector configured to select one among the first and second pairs of channels, based on which among the first and second coherency measures has the greatest contrast.

DETAILED DESCRIPTION

Figure 1:
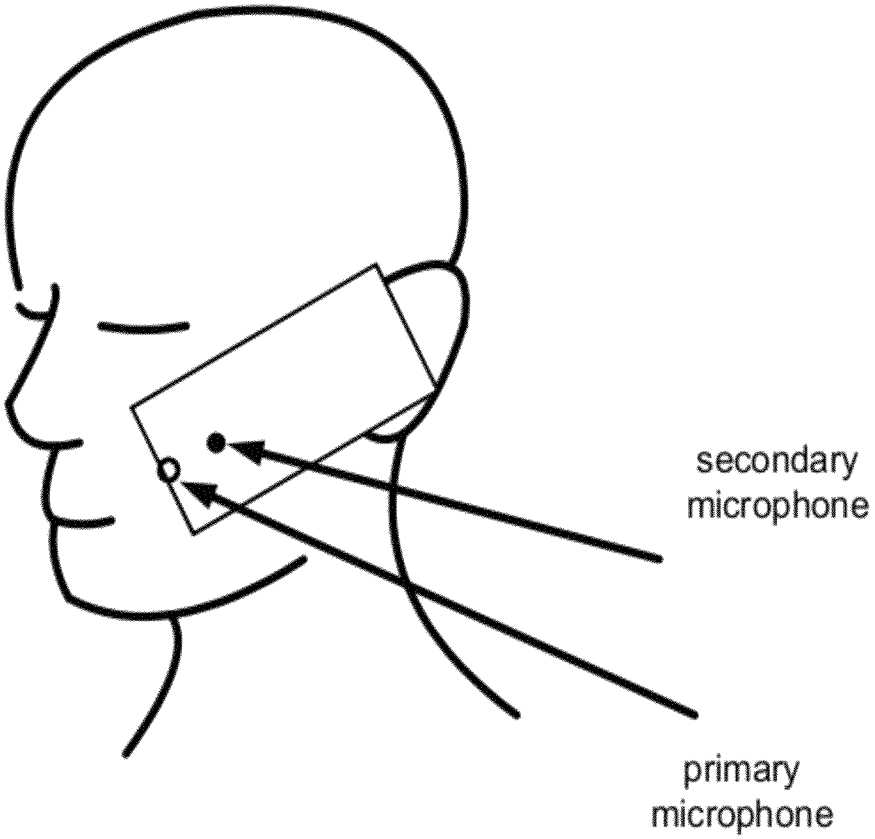
FIG. 1 shows an example of a handset being used in a nominal handset-mode holding position.

This description includes disclosure of systems, methods, and apparatus that apply information regarding the inter-microphone distance and a correlation between frequency and inter-microphone phase difference to determine whether a certain frequency component of a sensed multichannel signal originated from within a range of allowable inter-microphone angles or from outside it. Such a determination may be used to discriminate between signals arriving from different directions (e.g., such that sound originating from within that range is preserved and sound originating outside that range is suppressed) and/or to discriminate between near-field and far-field signals.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The near-field may be defined as that region of space which is less than one wavelength away from a sound receiver (e.g., a microphone array). Under this definition, the distance to the boundary of the region varies inversely with frequency. At frequencies of two hundred, seven hundred, and two thousand hertz, for example, the distance to a one-wavelength boundary is about 170, forty-nine, and seventeen centimeters, respectively. It may be useful instead to consider the near-field/far-field boundary to be at a particular distance from the microphone array (e.g., fifty centimeters from a microphone of the array or from the centroid of the array, or one meter or 1.5 meters from a microphone of the array or from the centroid of the array).

FIG. 1 shows an example of a handset having a two-microphone array (including a primary microphone and a secondary microphone) being used in a nominal handset-mode holding position. In this example, the primary microphone of the array is at the front side of the handset (i.e., toward the user) and the secondary microphone is at the back side of the handset (i.e., away from the user), although the array may also be configured with the microphones on the same side of the handset.

With the handset in this holding position, the signals from the microphone array may be used to support dual-microphone noise reduction. For example, the handset may be configured to perform a spatially selective processing (SSP) operation on a stereo signal received via the microphone array (i.e., a stereo signal in which each channel is based on the signal produced by a corresponding one of the two microphones). Examples of SSP operations include operations that indicate directions of arrival (DOAs) of one or more frequency components of the received multichannel signal, based on differences in phase and/or level (e.g., amplitude, gain, energy) between the channels. An SSP operation may be configured to distinguish signal components due to sounds that arrive at the array from a forward endfire direction (e.g., desired voice signals arriving from the direction of the user's mouth) from signal components due to sounds that arrive at the array from a broadside direction (e.g., noise from the surrounding environment).

A dual-microphone arrangement may be sensitive to directional noise. For example, a dual-microphone arrangement may admit sounds arriving from sources located within a large spatial area, such that it may be difficult to discriminate between near-field and far-field sources based on tight thresholds for phase-based directional coherence and gain differences.

Figure 2:
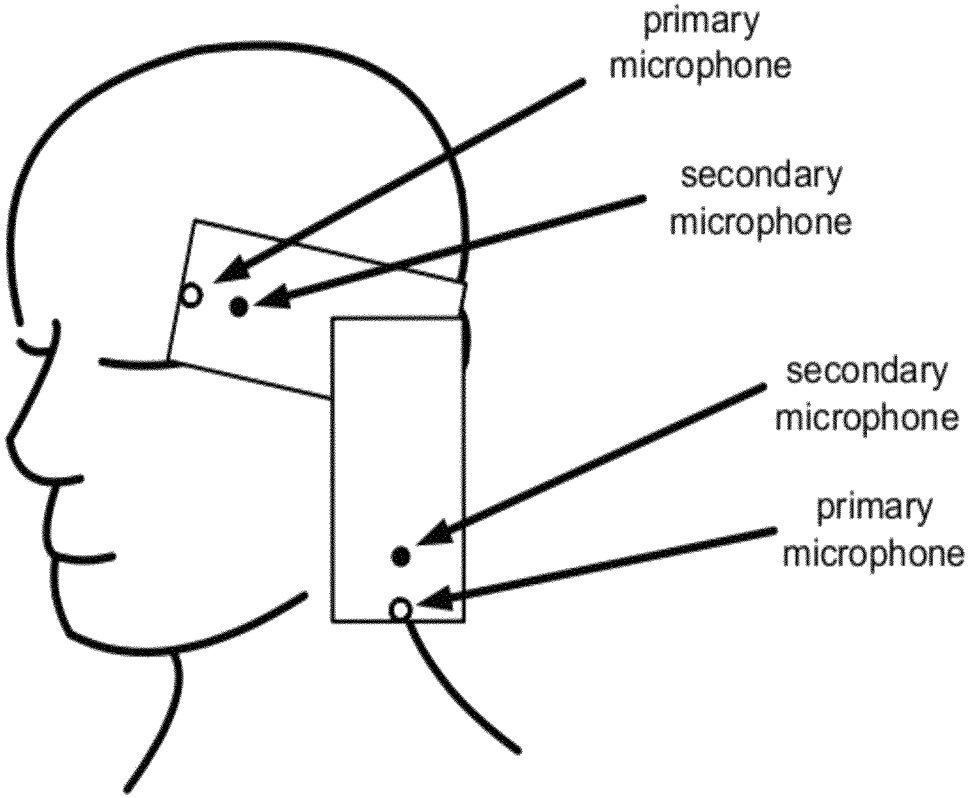
FIG. 2 shows examples of a handset in two different holding positions.

Dual-microphone noise-reduction techniques are typically less effective when the desired sound signal arrives from a direction that is far from an axis of the microphone array. When the handset is held away from the mouth (e.g., in either of the angular holding positions shown in FIG. 2), the axis of the microphone array is broadside to the mouth, and effective dual-microphone noise reduction may not be possible. Use of dual-microphone noise reduction during time intervals in which the handset is held in such a position may result in attenuation of the desired voice signal. For handset mode, a dual-microphone-based scheme typically cannot offer consistent noise reduction across a wide range of phone holding positions without attenuating desired speech level in at least some of those positions.

For holding positions in which the endfire direction of the array is pointed away from the user's mouth, it may be desirable to switch to a single-microphone noise reduction scheme to avoid speech attenuation. Such operations may reduce stationary noise (e.g., by subtracting a time-averaged noise signal from the channel in the frequency domain) and/or preserve the speech during these broadside time intervals. However, single-microphone noise reduction schemes typically provide no reduction of nonstationary noise (e.g., impulses and other sudden and/or transitory noise events).

It may be concluded that for the wide range of angular holding positions that may be encountered in handset mode, a dual-microphone approach typically will not provide both consistent noise reduction and desired speech level preservation at the same time.

The proposed solution uses a set of three or more microphones together with a switching strategy that selects an array from among the set (e.g., a selected pair of microphones). In other words, the switching strategy selects an array of fewer than all of the microphones of the set. This selection is based on information relating to the direction of arrival of at least one frequency component of a multichannel signal produced by the set of microphones.

In an endfire arrangement, the microphone array is oriented relative to the signal source (e.g., a user's mouth) such that the axis of the array is directed at the source. Such an arrangement provides two maximally differentiated mixtures of desired speech-noise signals. In a broadside arrangement, the microphone array is oriented relative to the signal source (e.g., a user's mouth) such that the direction from the center of the array to the source is roughly orthogonal to the axis of the array. Such an arrangement produces two mixtures of desired speech-noise signals that are basically very similar. Consequently, an endfire arrangement is typically preferred for a case in which a small-size microphone array (e.g., on a portable device) is being used to support a noise reduction operation.

Figure 3:
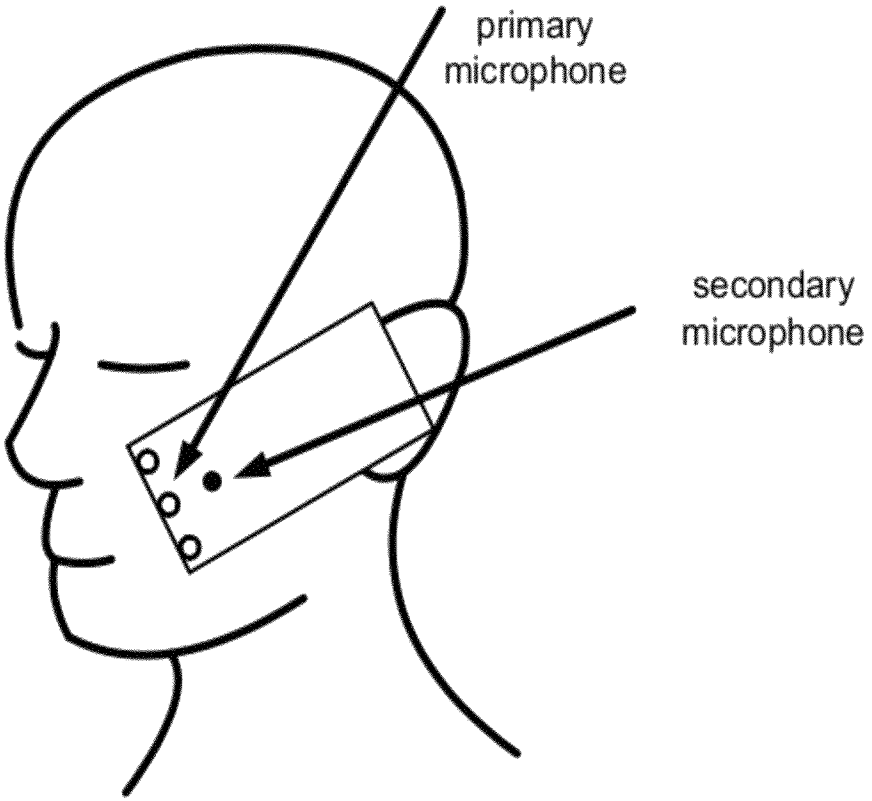
FIGS. 3, 4, and 5 show examples of different holding positions for a handset that has a row of three microphones at its front face and another microphone at its back face.
Figure 4:
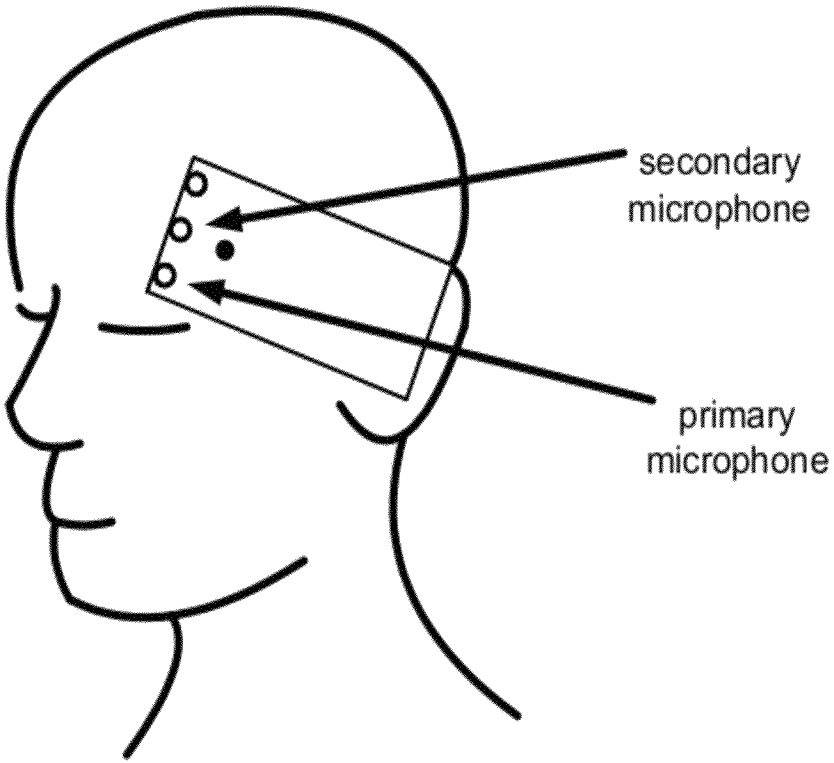
Figure 5:
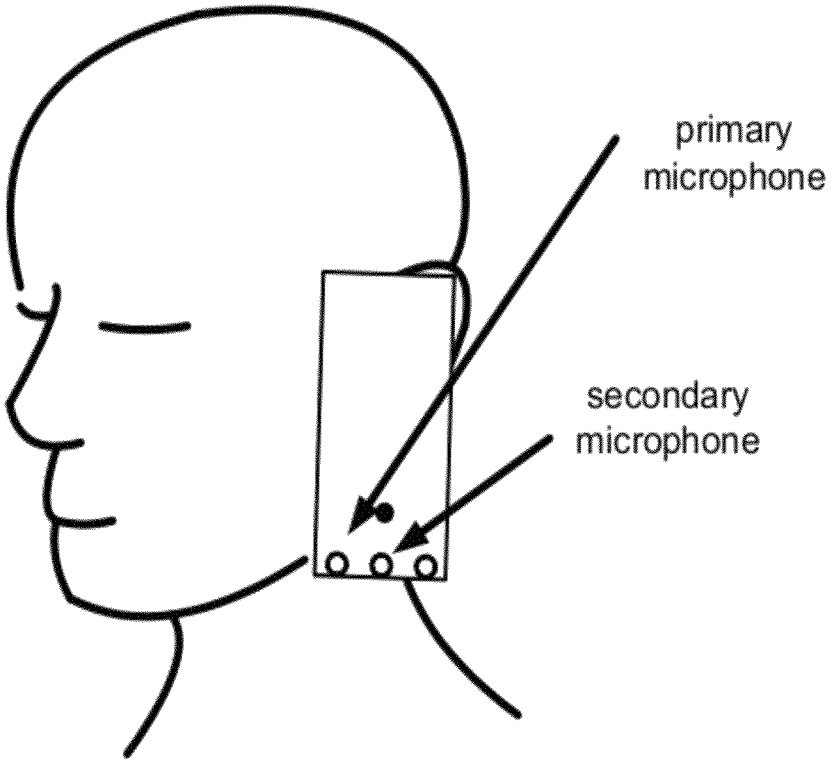

FIGS. 3, 4, and 5 show examples of different use cases (here, different holding positions) for a handset that has a row of three microphones at its front face and another microphone at its back face. In FIG. 3, the handset is held in a nominal holding position, such that the user's mouth is at the endfire direction of an array of the center front microphone (as primary) and the back microphone (secondary), and the switching strategy selects this pair. In FIG. 4, the handset is held such that the user's mouth is at the endfire direction of an array of the left front microphone (as primary) and the center front microphone (secondary), and the switching strategy selects this pair. In FIG. 5, the handset is held such that the user's mouth is at the endfire direction of an array of the right front microphone (as primary) and the center front microphone (secondary), and the switching strategy selects this pair.

Figure 6:
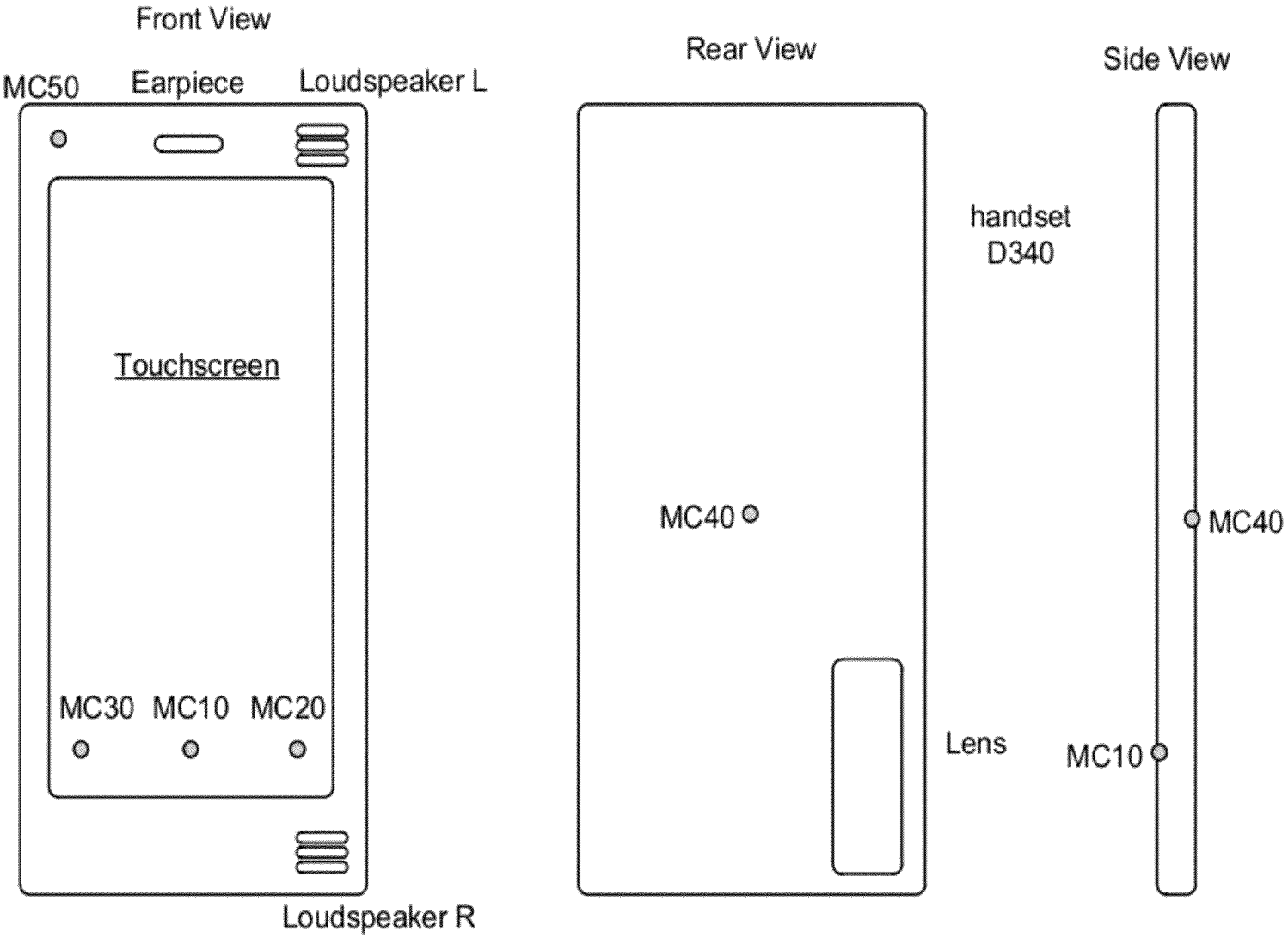
FIG. 6 shows front, rear, and side views of a handset D340.
Figure 7:
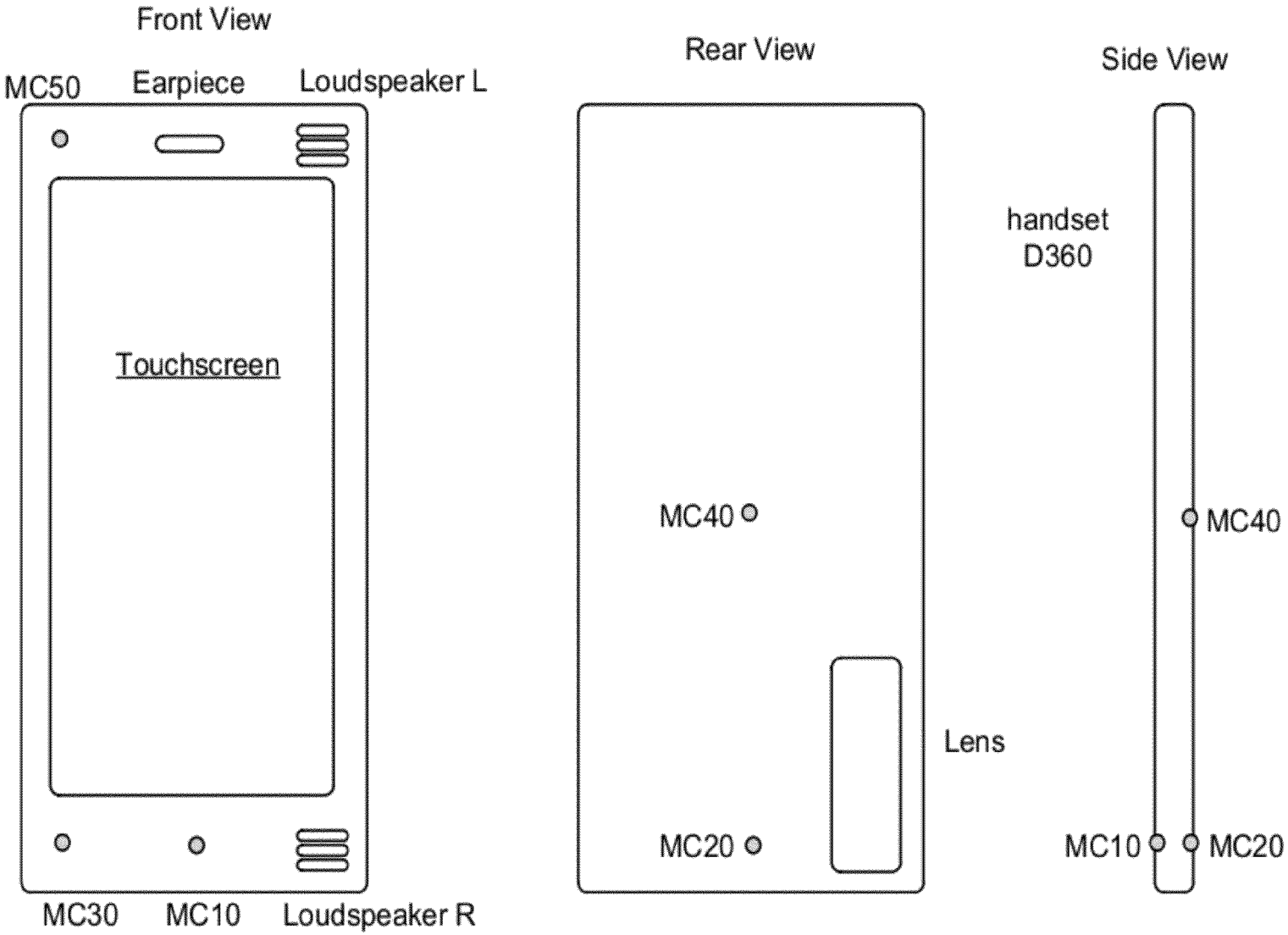
FIG. 7 shows front, rear, and side views of a handset D360.

Such a technique may be based on an array of three, four, or more microphones for handset mode. FIG. 6 shows front, rear, and side views of a handset D340 having a set of five microphones that may be configured to perform such a strategy. In this example, three of the microphones are located in a linear array on the front face, another microphone is located in a top corner of the front face, and another microphone is located on the back face. FIG. 7 shows front, rear, and side views of a handset D360 having a different arrangement of five microphones that may be configured to perform such a strategy. In this example, three of the microphones are located on the front face, and two of the microphones are located on the back face. A maximum distance between the microphones of such handsets is typically about ten or twelve centimeters. Other examples of handsets having two or more microphones that may also be configured to perform such a strategy are described herein.

In designing a set of microphones for use with such a switching strategy, it may be desirable to orient the axes of individual microphone pairs so that for all expected source-device orientations, there is likely to be at least one substantially endfire oriented microphone pair. The resulting arrangement may vary according to the particular intended use case.

In general, the switching strategy described herein (e.g., as in the various implementations of method M100 set forth below) may be implemented using one or more portable audio sensing devices that each has an array R100 of two or more microphones configured to receive acoustic signals. Examples of a portable audio sensing device that may be constructed to include such an array and to be used with this switching strategy for audio recording and/or voice communications applications include a telephone handset (e.g., a cellular telephone handset); a wired or wireless headset (e.g., a Bluetooth headset); a handheld audio and/or video recorder; a personal media player configured to record audio and/or video content; a personal digital assistant (PDA) or other handheld computing device; and a notebook computer, laptop computer, netbook computer, tablet computer, or other portable computing device. Other examples of audio sensing devices that may be constructed to include instances of array R100 and to be used with this switching strategy include set-top boxes and audio- and/or video-conferencing devices.

Each microphone of array R100 may have a response that is omnidirectional, bidirectional, or unidirectional (e.g., cardioid). The various types of microphones that may be used in array R100 include (without limitation) piezoelectric microphones, dynamic microphones, and electret microphones. In a device for portable voice communications, such as a handset or headset, the center-to-center spacing between adjacent microphones of array R100 is typically in the range of from about 1.5 cm to about 4.5 cm, although a larger spacing (e.g., up to 10 or 15 cm) is also possible in a device such as a handset or smartphone, and even larger spacings (e.g., up to 20, 25 or 30 cm or more) are possible in a device such as a tablet computer. In a hearing aid, the center-to-center spacing between adjacent microphones of array R100 may be as little as about 4 or 5 mm. The microphones of array R100 may be arranged along a line or, alternatively, such that their centers lie at the vertices of a two-dimensional (e.g., triangular) or three-dimensional shape. In general, however, the microphones of array R100 may be disposed in any configuration deemed suitable for the particular application. FIGS. 6 and 7, for example, each show an example of a five-microphone implementation of array R100 that does not conform to a regular polygon.

During the operation of a multi-microphone audio sensing device as described herein, array R100 produces a multichannel signal in which each channel is based on the response of a corresponding one of the microphones to the acoustic environment. One microphone may receive a particular sound more directly than another microphone, such that the corresponding channels differ from one another to provide collectively a more complete representation of the acoustic environment than can be captured using a single microphone.

Figure 8A:
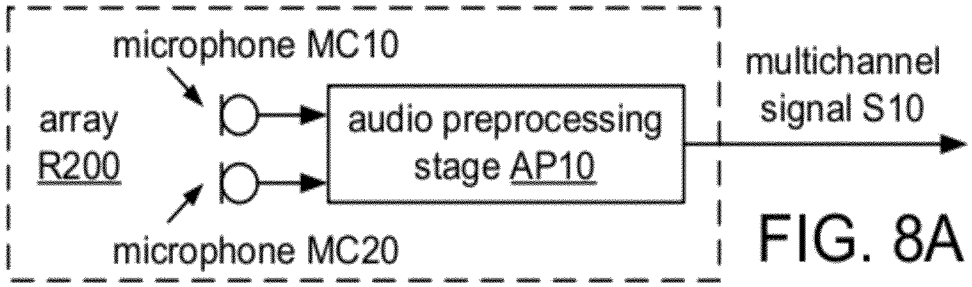
FIG. 8A shows a block diagram of an implementation R200 of array R100.

It may be desirable for array R100 to perform one or more processing operations on the signals produced by the microphones to produce multichannel signal S10. FIG. 8A shows a block diagram of an implementation R200 of array R100 that includes an audio preprocessing stage AP10 configured to perform one or more such operations, which may include (without limitation) impedance matching, analog-to-digital conversion, gain control, and/or filtering in the analog and/or digital domains.

Figure 8B:
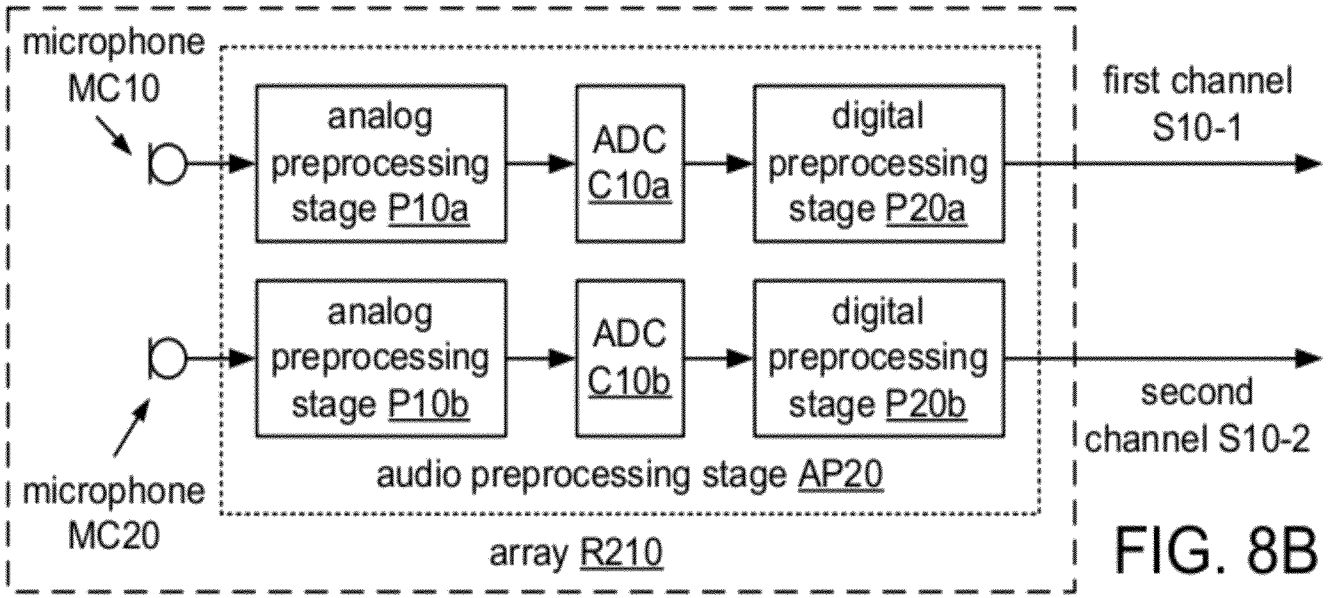
FIG. 8B shows a block diagram of an implementation R210 of array R200.

FIG. 8B shows a block diagram of an implementation R210 of array R200. Array R210 includes an implementation AP20 of audio preprocessing stage AP10 that includes analog preprocessing stages P10*a* and P10*b*. In one example, stages P10*a* and P10*b* are each configured to perform a highpass filtering operation (e.g., with a cutoff frequency of 50, 100, or 200 Hz) on the corresponding microphone signal.

It may be desirable for array R100 to produce the multichannel signal as a digital signal, that is to say, as a sequence of samples. Array R210, for example, includes analog-to-digital converters (ADCs) C10*a* and C10*b* that are each arranged to sample the corresponding analog channel. Typical sampling rates for acoustic applications include 8 kHz, 12 kHz, 16 kHz, and other frequencies in the range of from about 8 to about 16 kHz, although sampling rates as high as about 44 kHz may also be used. In this particular example, array R210 also includes digital preprocessing stages P20*a* and P20*b* that are each configured to perform one or more preprocessing operations (e.g., echo cancellation, noise reduction, and/or spectral shaping) on the corresponding digitized channel.

It is expressly noted that the microphones of array R100 may be implemented more generally as transducers sensitive to radiations or emissions other than sound. In one such example, the microphones of array R100 are implemented as ultrasonic transducers (e.g., transducers sensitive to acoustic frequencies greater than fifteen, twenty, twenty-five, thirty, forty, or fifty kilohertz or more).

Figure 9A:
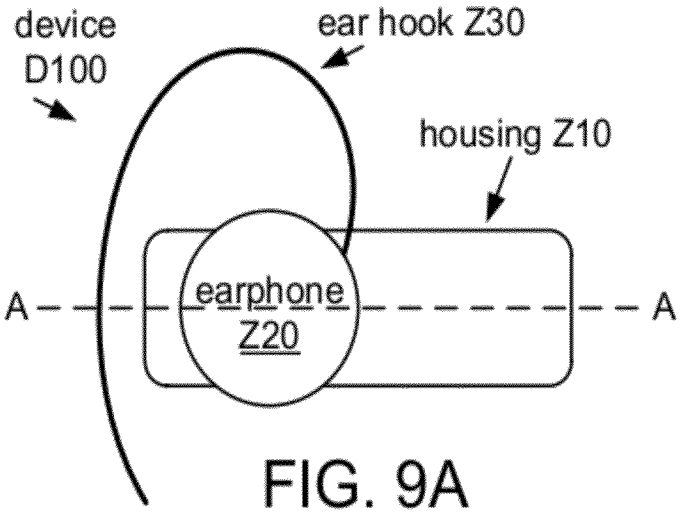
FIGS. 9A to 9D show various views of a multi-microphone wireless headset D100.
Figure 9B:
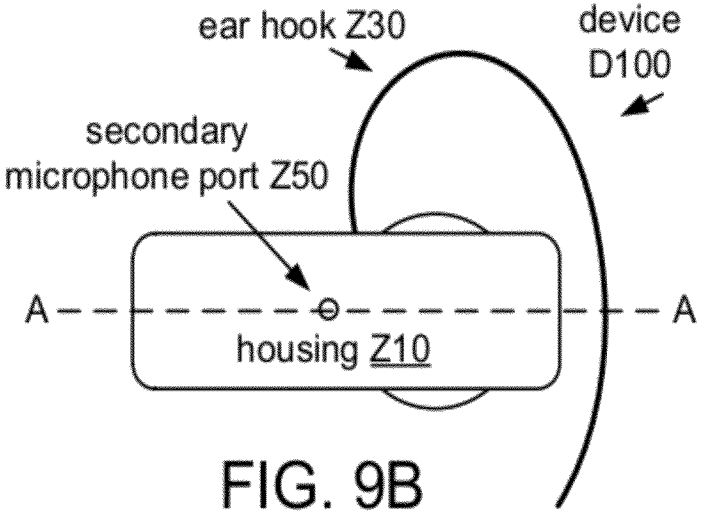
Figure 9C:
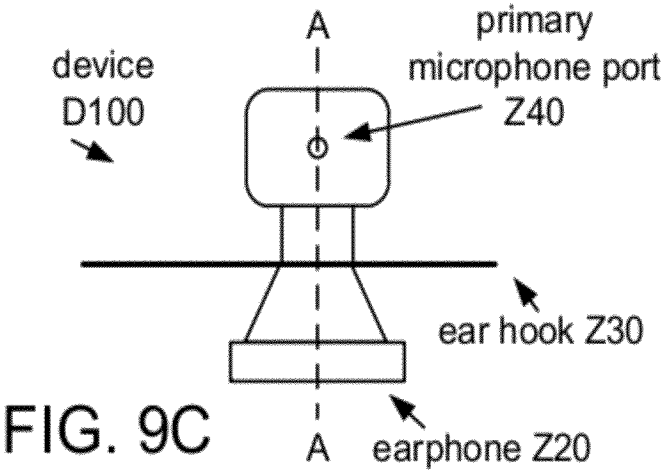
Figure 9D:
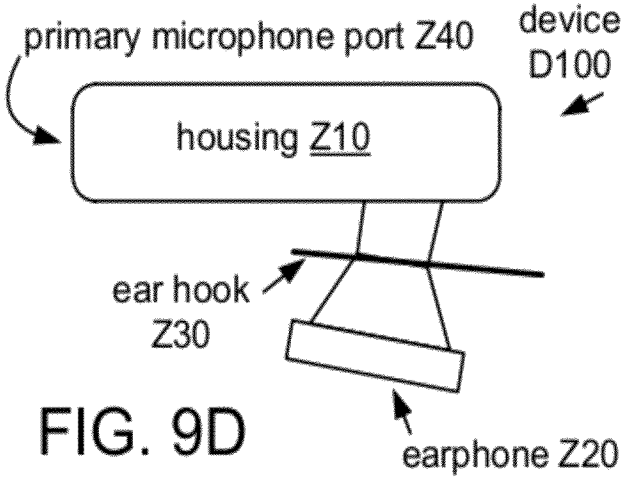
Figure 10A:
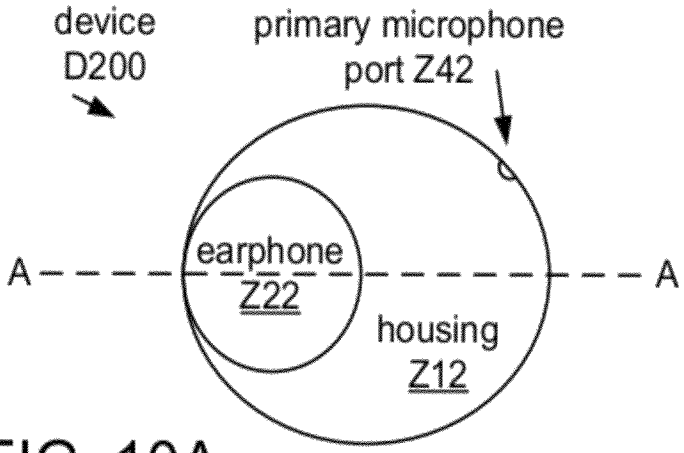
FIGS. 10A to 10D show various views of a multi-microphone wireless headset D200.
Figure 10B:
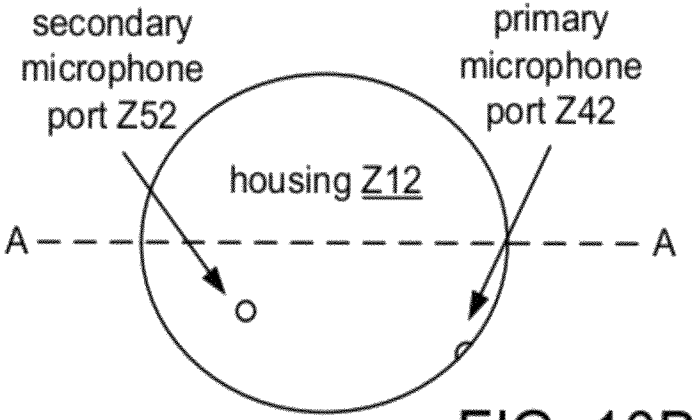
Figure 10C:
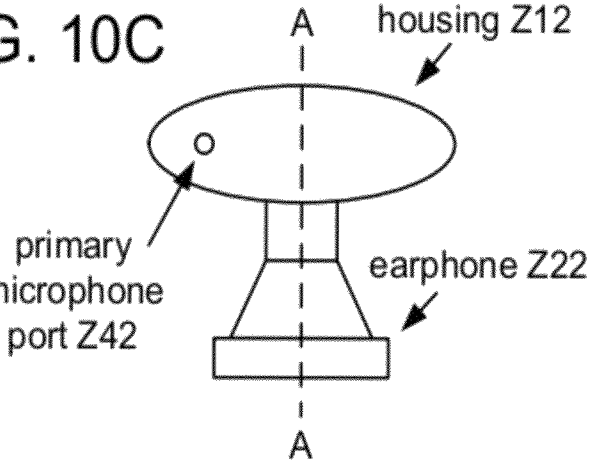
Figure 10D:
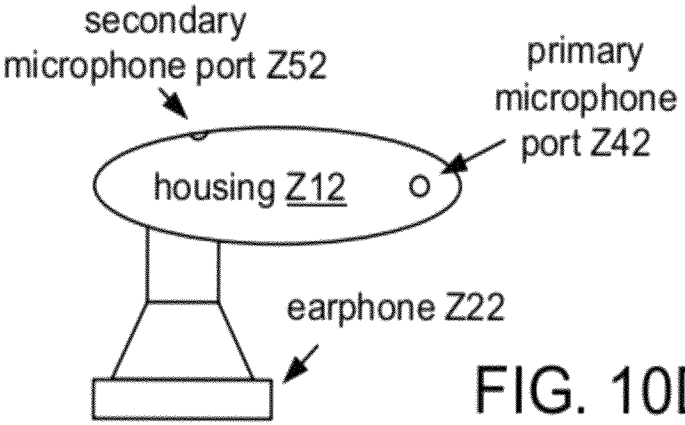

FIGS. 9A to 9D show various views of a multi-microphone portable audio sensing device D100. Device D100 is a wireless headset that includes a housing Z10 which carries a two-microphone implementation of array R100 and an earphone Z20 that extends from the housing. Such a device may be configured to support half- or full-duplex telephony via communication with a telephone device such as a cellular telephone handset (e.g., using a version of the Bluetooth™ protocol as promulgated by the Bluetooth Special Interest Group, Inc., Bellevue, Wash.). In general, the housing of a headset may be rectangular or otherwise elongated as shown in FIGS. 9A, 9B, and 9D (e.g., shaped like a miniboom) or may be more rounded or even circular. The housing may also enclose a battery and a processor and/or other processing circuitry (e.g., a printed circuit board and components mounted thereon) and may include an electrical port (e.g., a mini-Universal Serial Bus (USB) or other port for battery charging) and user interface features such as one or more button switches and/or LEDs. Typically the length of the housing along its major axis is in the range of from one to three inches.

Typically each microphone of array R100 is mounted within the device behind one or more small holes in the housing that serve as an acoustic port. FIGS. 9B to 9D show the locations of the acoustic port Z40 for the primary microphone of the array of device D100 and the acoustic port Z50 for the secondary microphone of the array of device D100.

A headset may also include a securing device, such as ear hook Z30, which is typically detachable from the headset. An external ear hook may be reversible, for example, to allow the user to configure the headset for use on either ear. Alternatively, the earphone of a headset may be designed as an internal securing device (e.g., an earplug) which may include a removable earpiece to allow different users to use an earpiece of different size (e.g., diameter) for better fit to the outer portion of the particular user's ear canal.

FIGS. 10A to 10D show various views of a multi-microphone portable audio sensing device D200 that is another example of a wireless headset. Device D200 includes a rounded, elliptical housing Z12 and an earphone Z22 that may be configured as an earplug. FIGS. 10A to 10D also show the locations of the acoustic port Z42 for the primary microphone and the acoustic port Z52 for the secondary microphone of the array of device D200. It is possible that secondary microphone port Z52 may be at least partially occluded (e.g., by a user interface button).

Figure 11A:
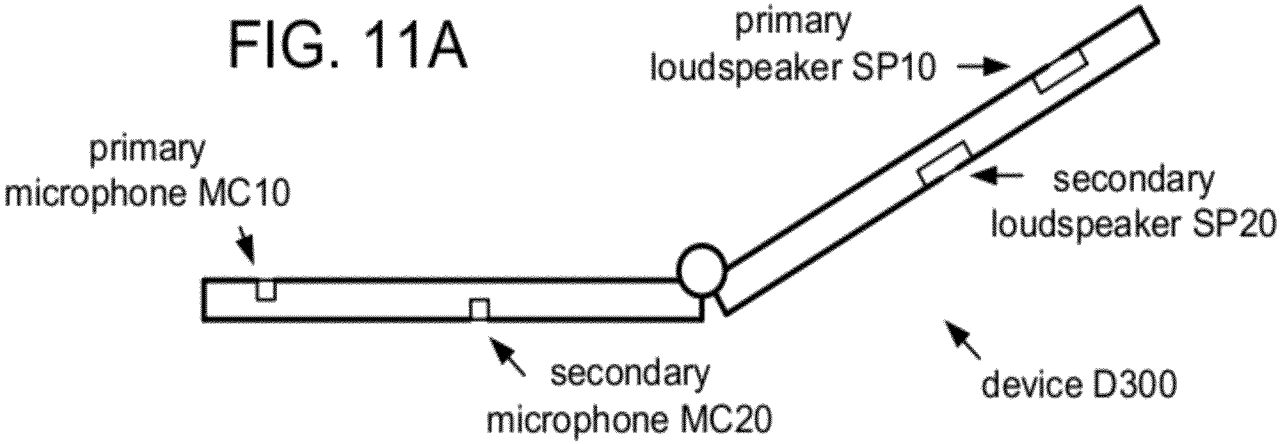
FIG. 11A shows a cross-sectional view (along a central axis) of a multi-microphone communications handset D300.
Figure 11B:
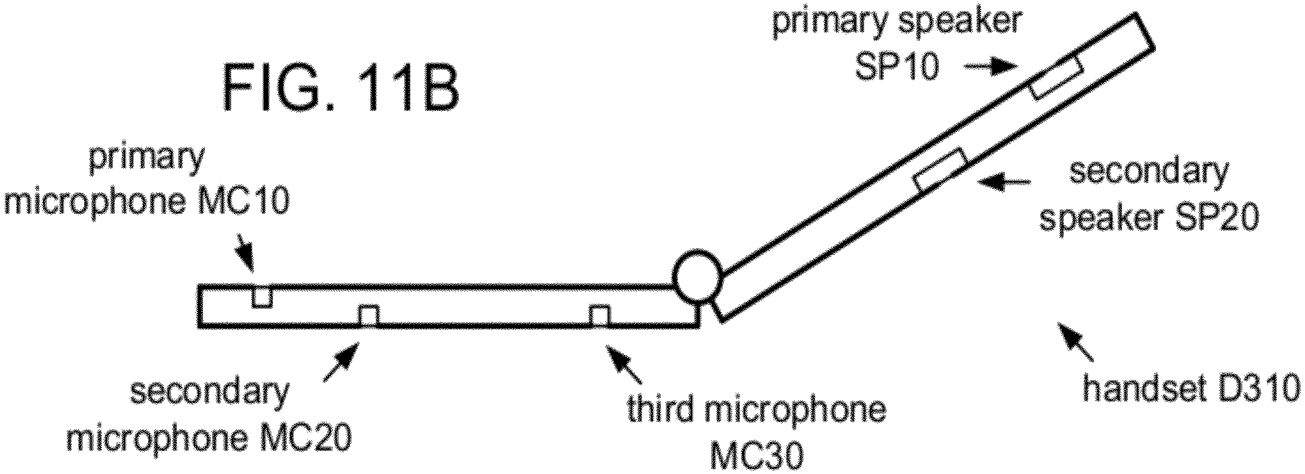
FIG. 11B shows a cross-sectional view of an implementation D310 of device D300.

FIG. 11A shows a cross-sectional view (along a central axis) of a multi-microphone portable audio sensing device D300 that is a communications handset. Device D300 includes an implementation of array R100 having a primary microphone MC10 and a secondary microphone MC20. In this example, device D300 also includes a primary loudspeaker SP10 and a secondary loudspeaker SP20. Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004). In the example of FIG. 3A, handset D300 is a clamshell-type cellular telephone handset (also called a "flip" handset). Other configurations of such a multi-microphone communications handset include bar-type and slider-type telephone handsets. FIG. 11B shows a cross-sectional view of an implementation D310 of device D300 that includes a three-microphone implementation of array R100 that includes a third microphone MC30.

Figure 12C:
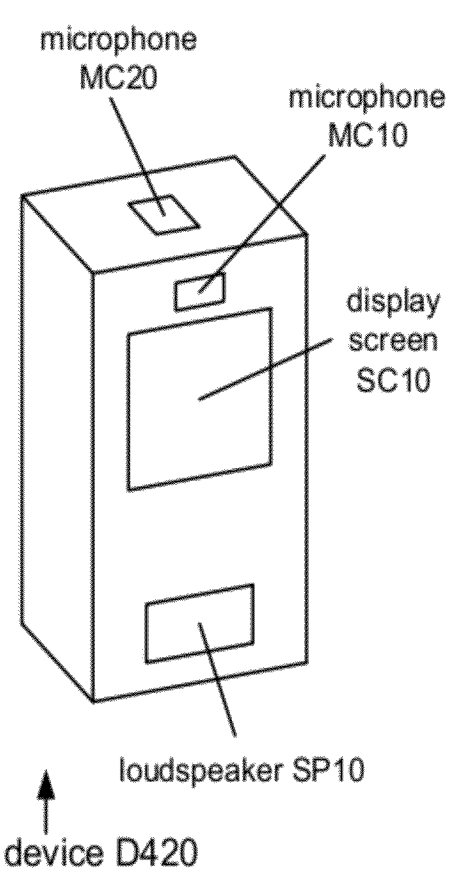
FIG. 12C shows a diagram of an implementation D420 of multi-microphone portable media player D400.
Figure 12B:
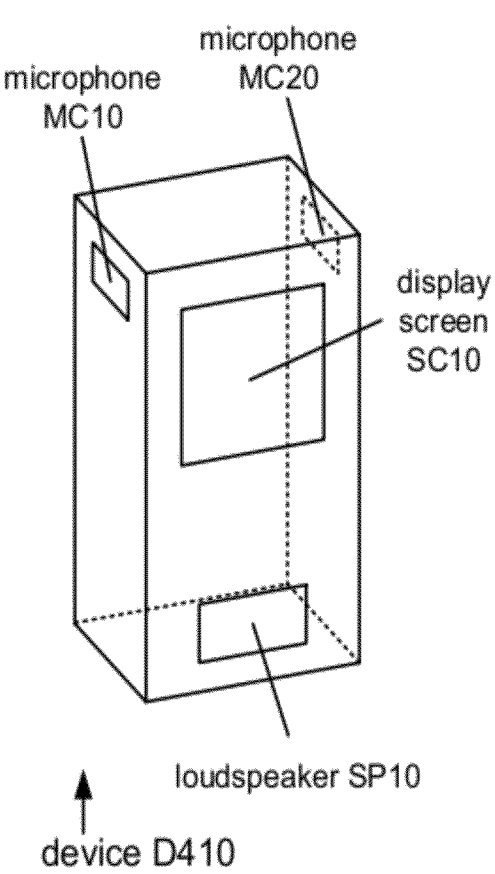
FIG. 12B shows a diagram of an implementation D410 of multi-microphone portable media player D400.
Figure 12A:
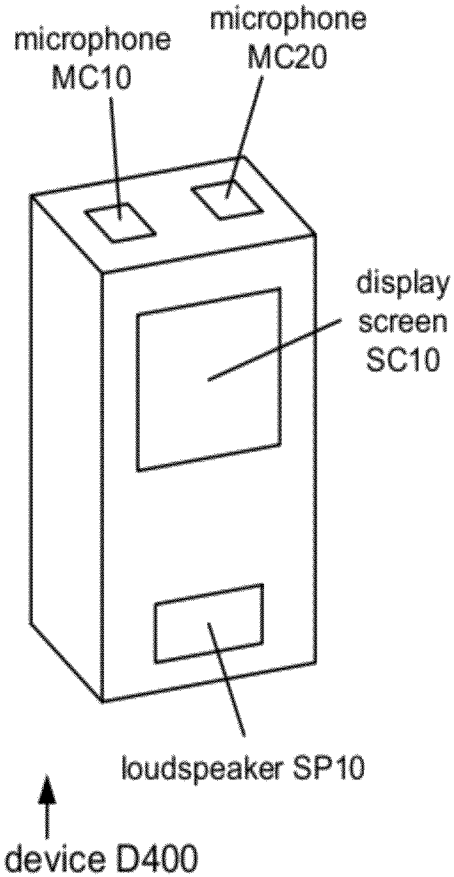
FIG. 12A shows a diagram of a multi-microphone portable media player D400.

FIG. 12A shows a diagram of a multi-microphone portable audio sensing device D400 that is a media player. Such a device may be configured for playback of compressed audio or audiovisual information, such as a file or stream encoded according to a standard compression format (e.g., Moving Pictures Experts Group (MPEG)-1 Audio Layer 3 (MP3), MPEG-4 Part 14 (MP4), a version of Windows Media Audio/Video (WMA/WMV) (Microsoft Corp., Redmond, Wash.), Advanced Audio Coding (AAC), International Telecommunication Union (ITU)-T H.264, or the like). Device D400 includes a display screen SC10 and a loudspeaker SP10 disposed at the front face of the device, and microphones MC10 and MC20 of array R100 are disposed at the same face of the device (e.g., on opposite sides of the top face as in this example, or on opposite sides of the front face). FIG. 12B shows another implementation D410 of device D400 in which microphones MC10 and MC20 are disposed at opposite faces of the device, and FIG. 12C shows a further implementation D420 of device D400 in which microphones MC10 and MC20 are disposed at adjacent faces of the device. A media player may also be designed such that the longer axis is horizontal during an intended use.

Figure 13A:
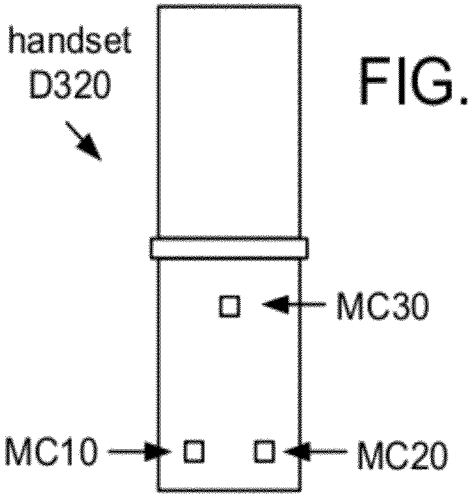
FIG. 13A shows a front view of a handset D320.
Figure 13B:
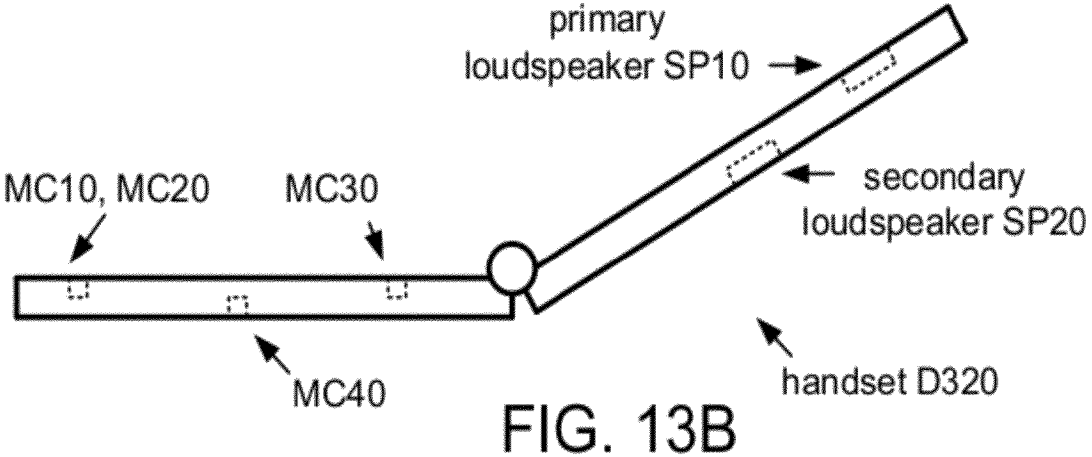
FIG. 13B shows a side view of handset D320.

In an example of a four-microphone instance of array R100, the microphones are arranged in a roughly tetrahedral configuration such that one microphone is positioned behind (e.g., about one centimeter behind) a triangle whose vertices are defined by the positions of the other three microphones, which are spaced about three centimeters apart. Potential applications for such an array include a handset operating in a speakerphone mode, for which the expected distance between the speaker's mouth and the array is about twenty to thirty centimeters. FIG. 13A shows a front view of a handset D320 that includes such an implementation of array R100 in which four microphones MC10, MC20, MC30, MC40 are arranged in a roughly tetrahedral configuration. FIG. 13B shows a side view of handset D320 that shows the positions of microphones MC10, MC20, MC30, and MC40 within the handset.

Figure 13C:
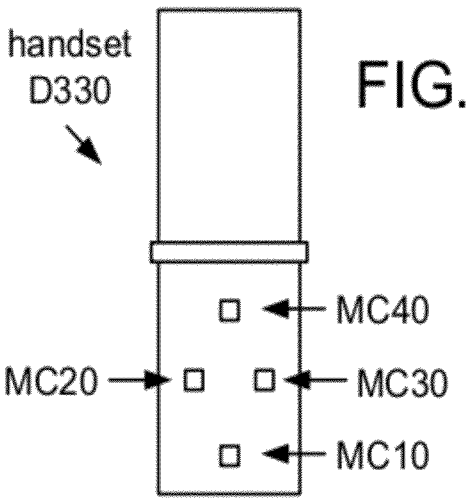
FIG. 13C shows a front view of a handset D330.
Figure 13D:
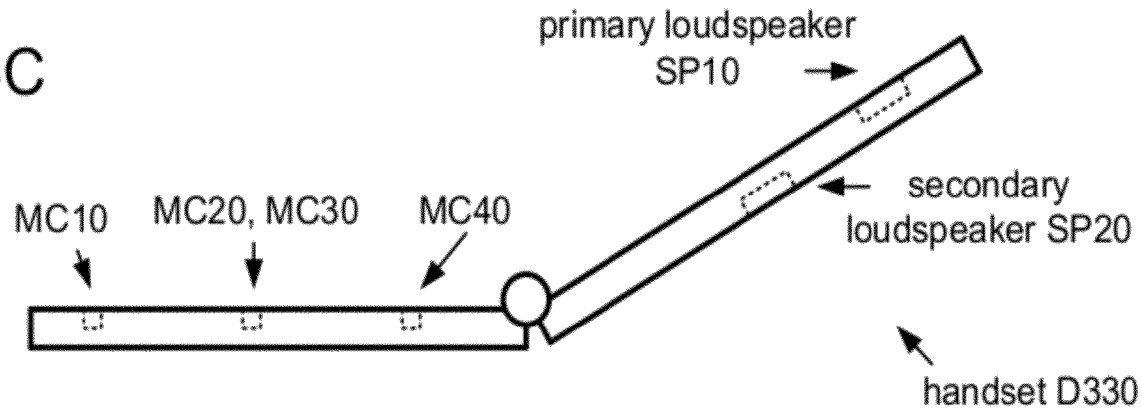
FIG. 13D shows a side view of handset D330.

Another example of a four-microphone instance of array R100 for a handset application includes three microphones at the front face of the handset (e.g., near the 1, 7, and 9 positions of the keypad) and one microphone at the back face (e.g., behind the 7 or 9 position of the keypad). FIG. 13C shows a front view of a handset D330 that includes such an implementation of array R100 in which four microphones MC10, MC20, MC30, MC40 are arranged in a "star" configuration. FIG. 13D shows a side view of handset D330 that shows the positions of microphones MC10, MC20, MC30, and MC40 within the handset. Other examples of portable audio sensing devices that may be used to perform a switching strategy as described herein include touchscreen implementations of handset D320 and D330 (e.g., as flat, non-folding slabs, such as the iPhone (Apple Inc., Cupertino, Calif.), HD2 (HTC, Taiwan, ROC) or CLIQ (Motorola, Inc., Schaumberg, Ill.)) in which the microphones are arranged in similar fashion at the periphery of the touchscreen.

Figure 14:
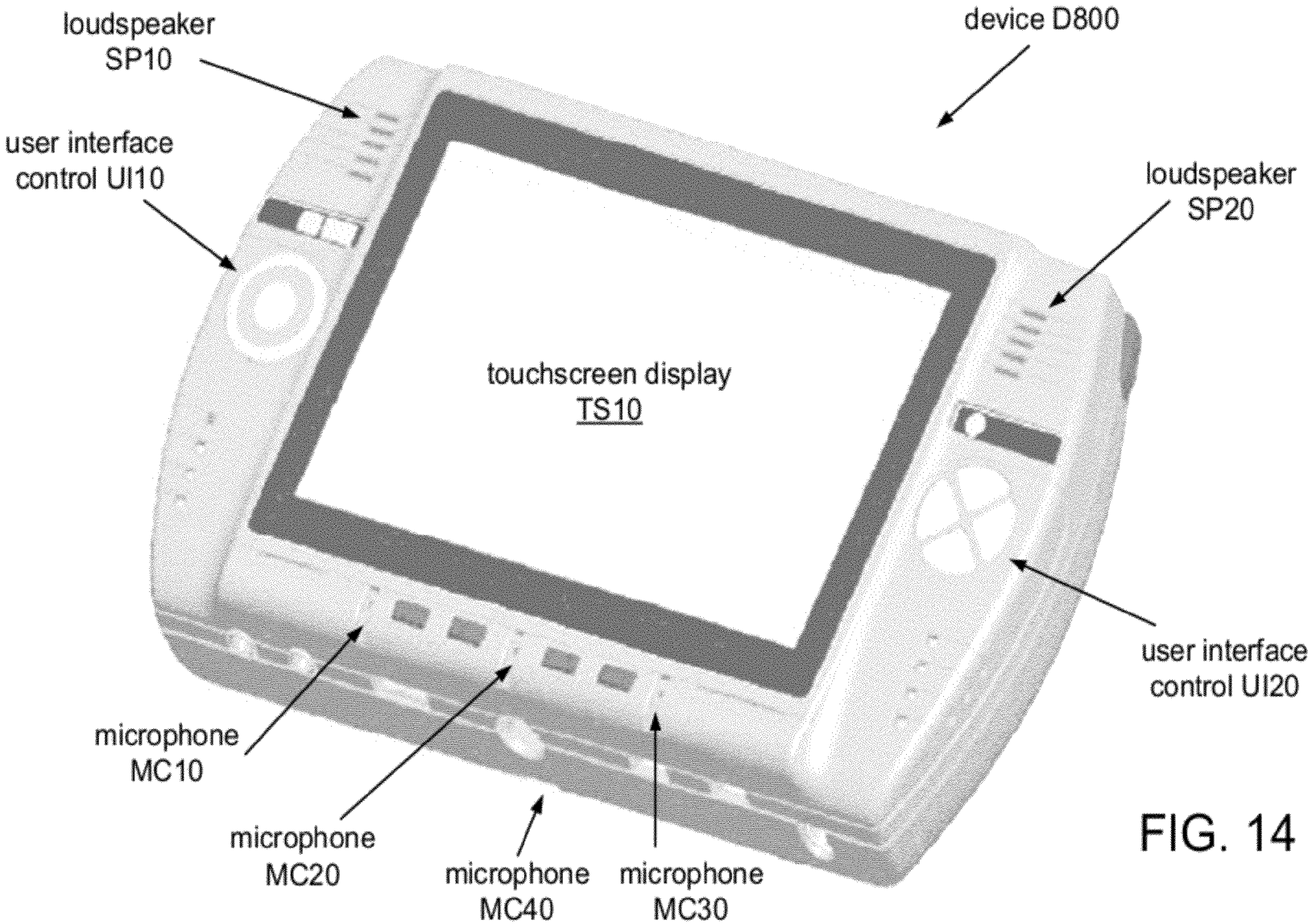
FIG. 14 shows a diagram of a portable multimicrophone audio sensing device D800 for handheld applications.

FIG. 14 shows a diagram of a portable multimicrophone audio sensing device D800 for handheld applications. Device D800 includes a touchscreen display TS10, a user interface selection control UI10 (left side), a user interface navigation control UI20 (right side), two loudspeakers SP10 and SP20, and an implementation of array R100 that includes three front microphones MC10, MC20, MC30 and a back microphone MC40. Each of the user interface controls may be implemented using one or more of pushbuttons, trackballs, clickwheels, touchpads, joysticks and/or other pointing devices, etc. A typical size of device D800, which may be used in a browse-talk mode or a game-play mode, is about fifteen centimeters by twenty centimeters. A portable multimicrophone audio sensing device may be similarly implemented as a tablet computer that includes a touchscreen display on a top surface (e.g., a "slate," such as the iPad (Apple, Inc.), Slate (Hewlett-Packard Co., Palo Alto, Calif.) or Streak (Dell Inc., Round Rock, Tex.)), with microphones of array R100 being disposed within the margin of the top surface and/or at one or more side surfaces of the tablet computer.

Figure 15B:
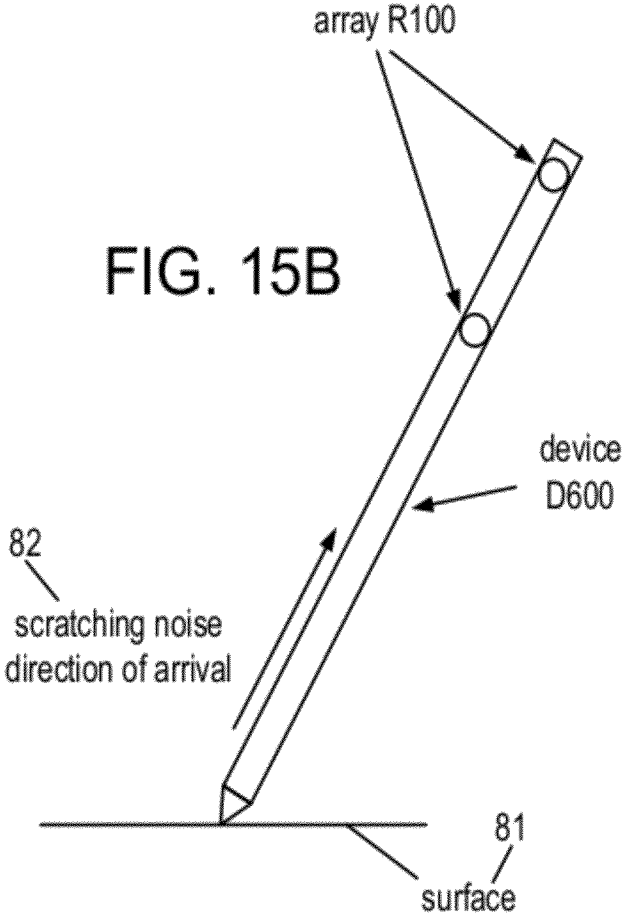
FIG. 15B shows a diagram of a multi-microphone writing device D600.
Figure 15A:
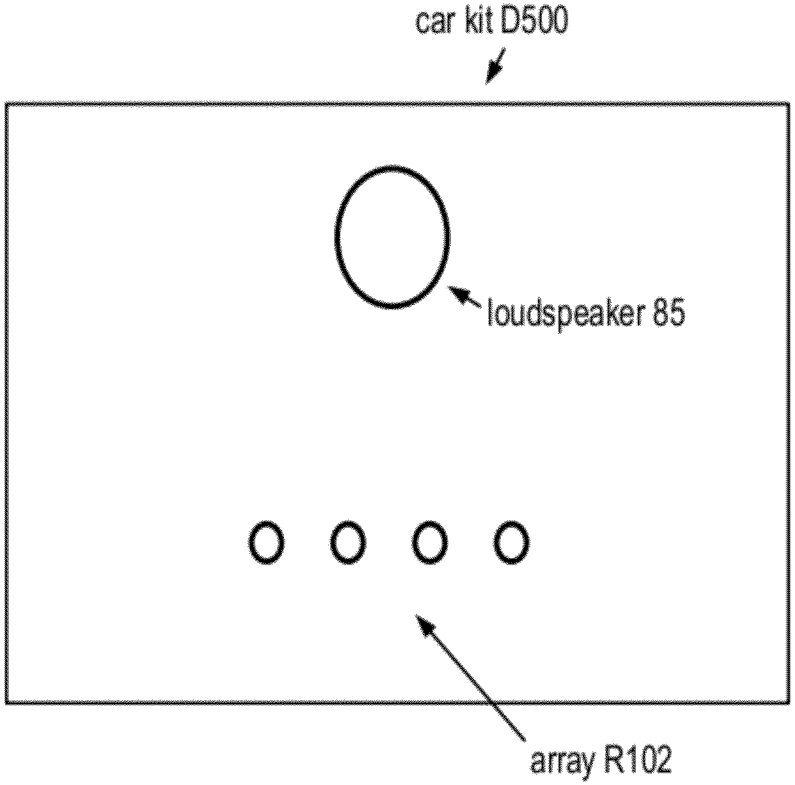
FIG. 15A shows a diagram of a multi-microphone hands-free car kit D500.

FIG. 15A shows a diagram of a multi-microphone portable audio sensing device D500 that is a hands-free car kit. Such a device may be configured to be installed in or on or removably fixed to the dashboard, the windshield, the rear-view mirror, a visor, or another interior surface of a vehicle. Device D500 includes a loudspeaker 85 and an implementation of array R100. In this particular example, device D500 includes an implementation R102 of array R100 as four microphones arranged in a linear array. Such a device may be configured to transmit and receive voice communications data wirelessly via one or more codecs, such as the examples listed above. Alternatively or additionally, such a device may be configured to support half- or full-duplex telephony via communication with a telephone device such as a cellular telephone handset (e.g., using a version of the Bluetooth™ protocol as described above).

FIG. 15B shows a diagram of a multi-microphone portable audio sensing device D600 that is a writing device (e.g., a pen or pencil). Device D600 includes an implementation of array R100. Such a device may be configured to transmit and receive voice communications data wirelessly via one or more codecs, such as the examples listed above. Alternatively or additionally, such a device may be configured to support half- or full-duplex telephony via communication with a device such as a cellular telephone handset and/or a wireless headset (e.g., using a version of the Bluetooth™ protocol as described above). Device D600 may include one or more processors configured to perform a spatially selective processing operation to reduce the level of a scratching noise 82, which may result from a movement of the tip of device D600 across a drawing surface 81 (e.g., a sheet of paper), in a signal produced by array R100.

The class of portable computing devices currently includes devices having names such as laptop computers, notebook computers, netbook computers, ultra-portable computers, tablet computers, mobile Internet devices, smartbooks, or smartphones. One type of such device has a slate or slab configuration as described above and may also include a slide-out keyboard. FIGS. 16A-D show another type of such device that has a top panel which includes a display screen and a bottom panel that may include a keyboard, wherein the two panels may be connected in a clamshell or other hinged relationship.

Figure 16A:
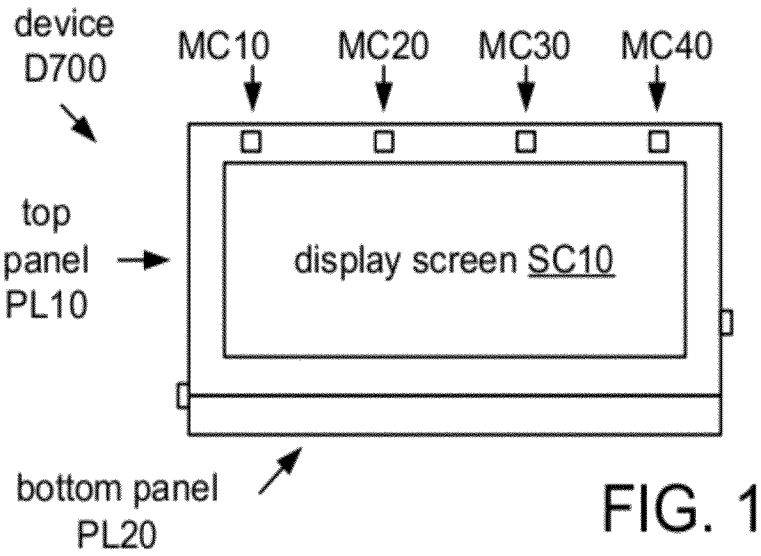
FIGS. 16A and 16B show two views of a portable computing device D700.
Figure 16B:
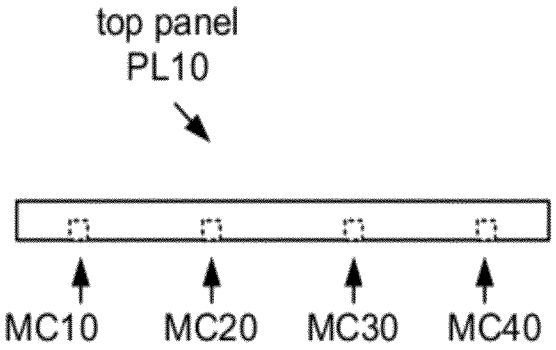
Figure 16C:
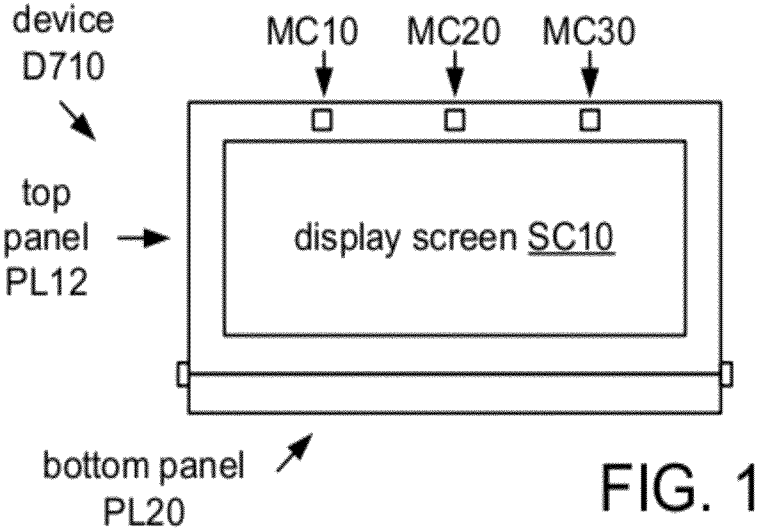
FIGS. 16C and 16D show two views of a portable computing device D710.
Figure 16D:
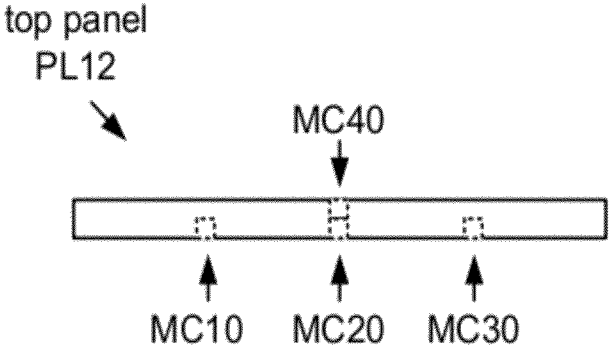

FIG. 16A shows a front view of an example of such a device D700 that includes four microphones MC10, MC20, MC30, MC40 arranged in a linear array on top panel PL10 above display screen SC10. FIG. 16B shows a top view of top panel PL10 that shows the positions of the four microphones in another dimension. FIG. 16C shows a front view of another example of such a portable computing device D710 that includes four microphones MC10, MC20, MC30, MC40 arranged in a nonlinear array on top panel PL12 above display screen SC10. FIG. 16D shows a top view of top panel PL12 that shows the positions of the four microphones in another dimension, with microphones MC10, MC20, and MC30 disposed at the front face of the panel and microphone MC40 disposed at the back face of the panel.

Figure 17B:
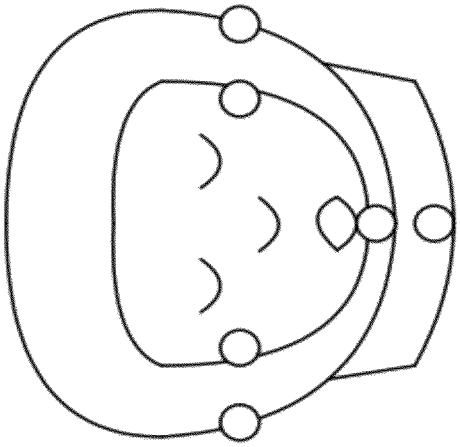
FIGS. 17A-C show additional examples of portable audio sensing devices.
Figure 17C:
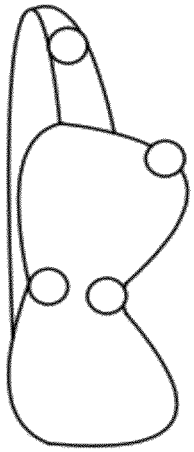
Figure 17A:
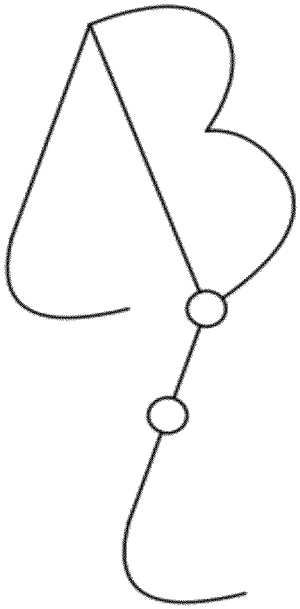

FIGS. 17A-C show additional examples of portable audio sensing devices that may be implemented to include an instance of array R100 and used with a switching strategy as disclosed herein. In each of these examples, the microphones of array R100 are indicated by open circles. FIG. 17A shows eyeglasses (e.g., prescription glasses, sunglasses, or safety glasses) having at least one front-oriented microphone pair, with one microphone of the pair on a temple and the other on the temple or the corresponding end piece. FIG. 17B shows a helmet in which array R100 includes one or more microphone pairs (in this example, a pair at the mouth and a pair at each side of the user's head). FIG. 17C shows goggles (e.g., ski goggles) including at least one microphone pair (in this example, front and side pairs).

Additional placement examples for a portable audio sensing device having one or more microphones to be used with a switching strategy as disclosed herein include but are not limited to the following: visor or brim of a cap or hat; lapel, breast pocket, shoulder, upper arm (i.e., between shoulder and elbow), lower arm (i.e., between elbow and wrist), wristband or wristwatch. One or more microphones used in the strategy may reside on a handheld device such as a camera or camcorder.

Figure 18:
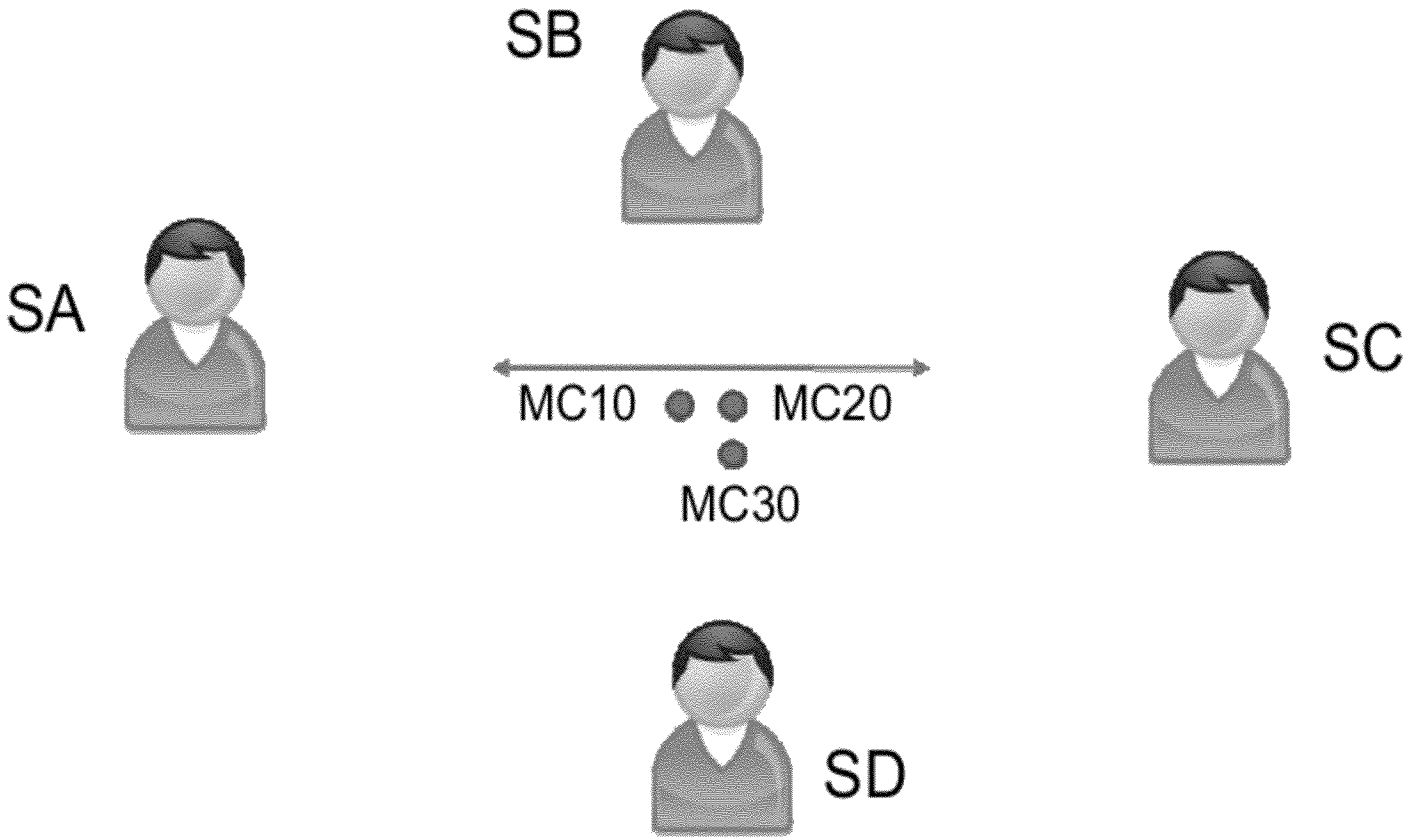
FIG. 18 shows an example of a three-microphone implementation of array R100 in a multi-source environment.

Applications of a switching strategy as disclosed herein are not limited to portable audio sensing devices. FIG. 18 shows an example of a three-microphone implementation of array R100 in a multi-source environment (e.g., an audio- or videoconferencing application). In this example, the microphone pair MC10-MC20 is in an endfire arrangement with respect to speakers SA and SC, and the microphone pair MC20-MC30 is in an endfire arrangement with respect to speakers SB and SD. Consequently, when speaker SA or SC is active, it may be desirable to perform noise reduction using signals captured by microphone pair MC10-MC20, and when speaker SB or SD is active, it may be desirable to perform noise reduction using signals captured by microphone pair MC20-MC30. It is noted for a different speaker placement, it may be desirable to perform noise reduction using signals captured by microphone pair MC10-MC30.

Figure 19:
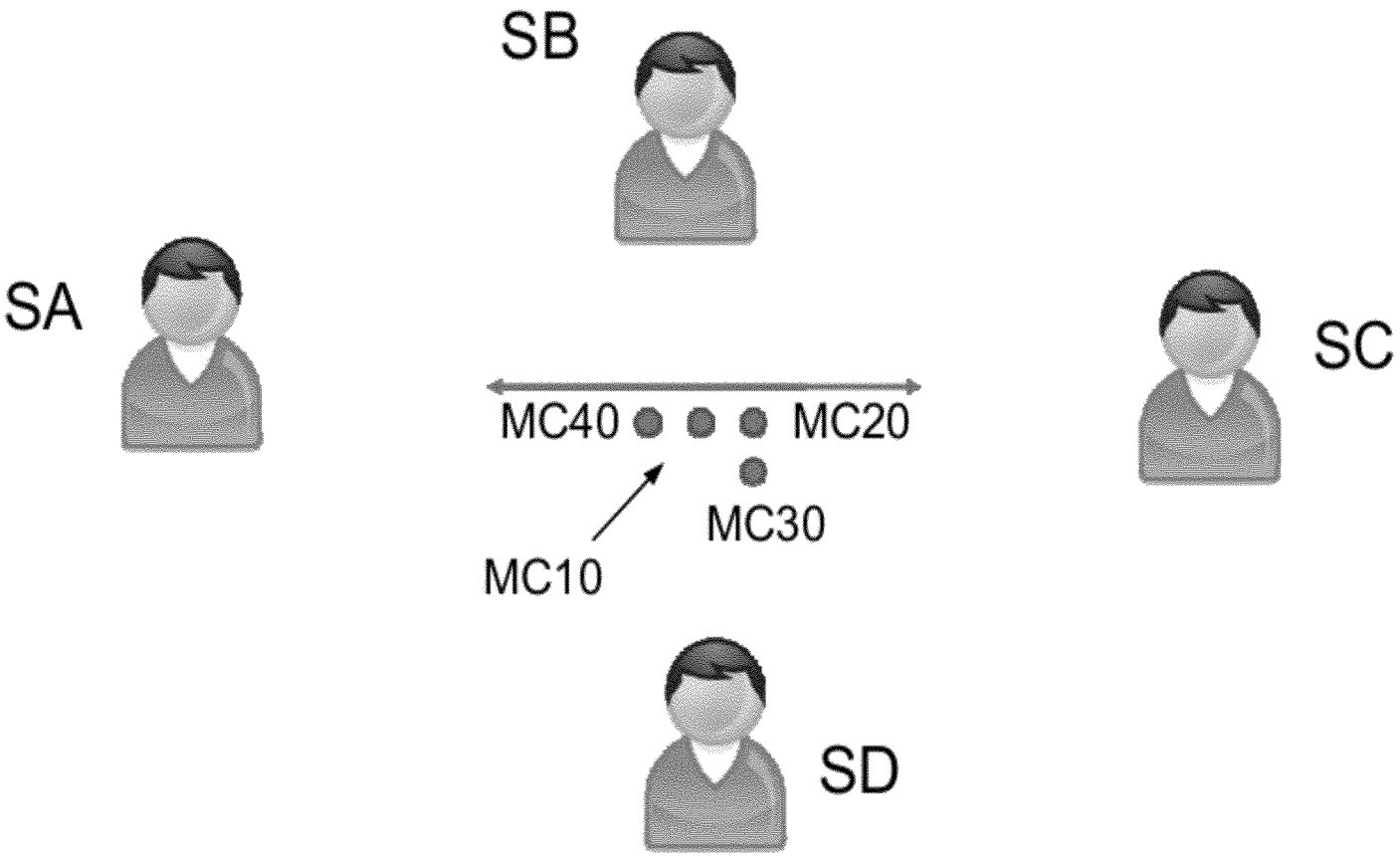
FIGS. 19 and 20 show related examples.
Figure 20:
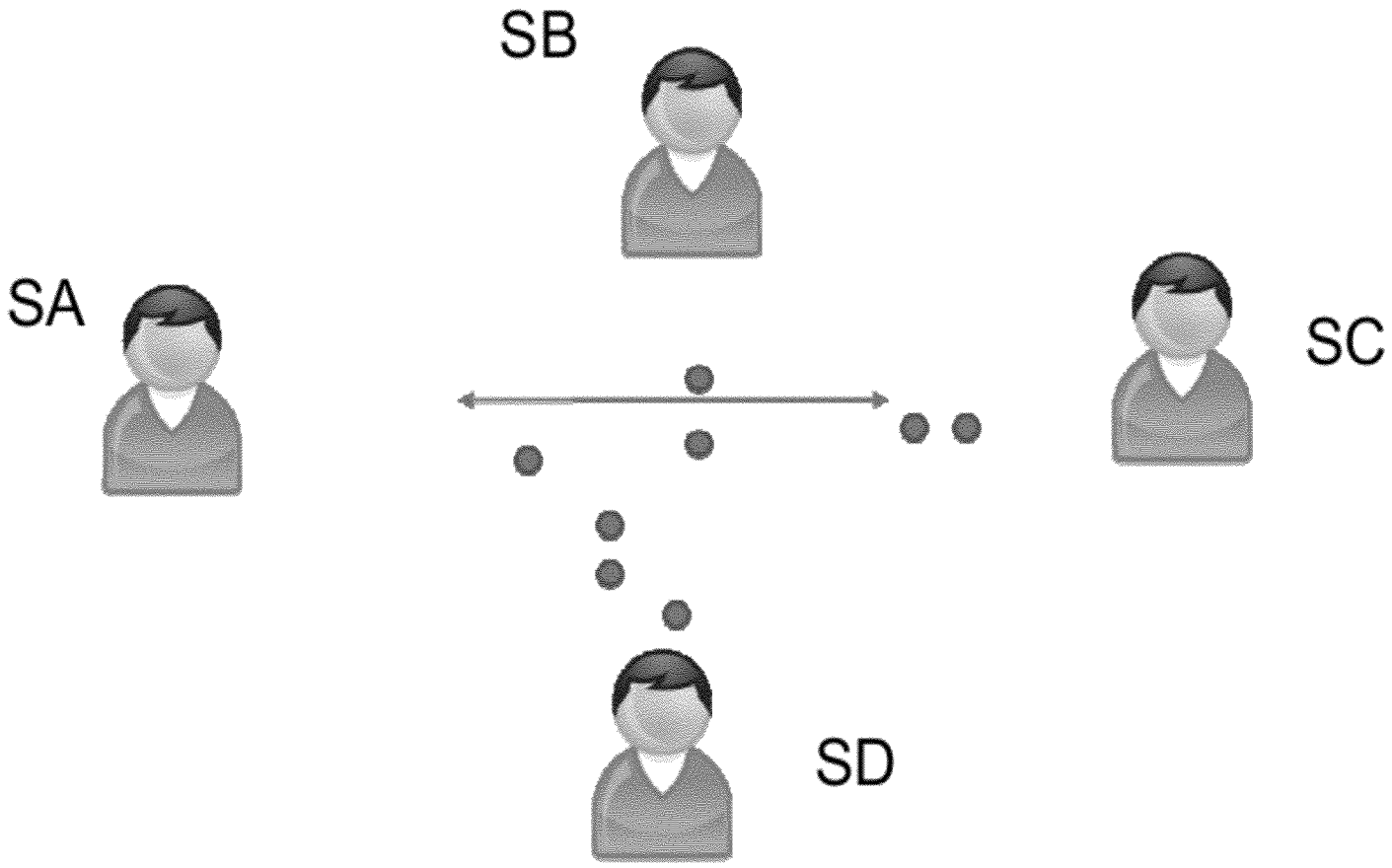
Figure 21B:
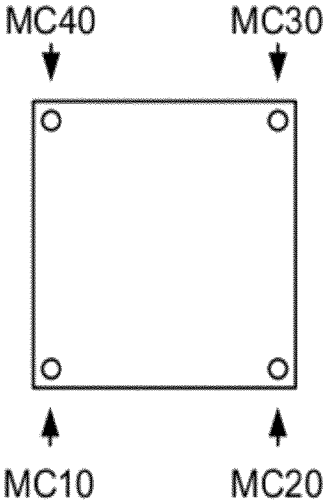
FIGS. 21A-D show top views of several examples of a conferencing device.
Figure 21D:
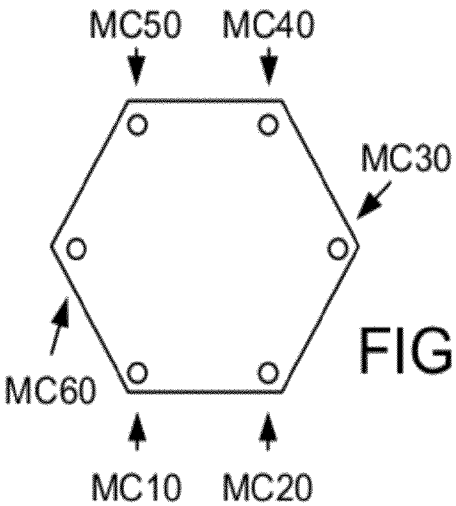
Figure 21A:
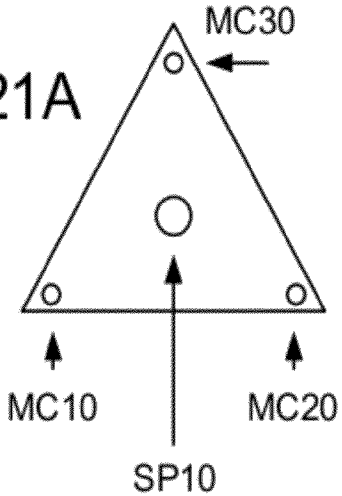
Figure 21C:
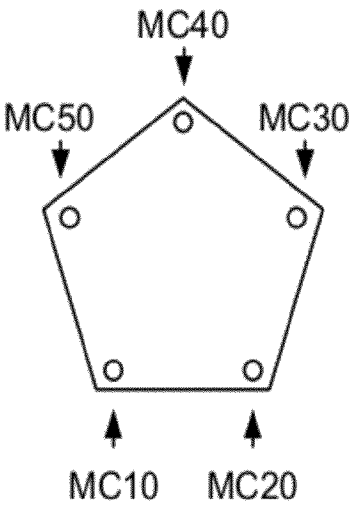

FIG. 19 shows a related example in which array R100 includes an additional microphone MC40. FIG. 20 shows how the switching strategy may select different microphone pairs of the array for different relative active speaker locations.

FIGS. 21A-D show top views of several examples of a conferencing device. FIG. 20A includes a three-microphone implementation of array R100 (microphones MC 10, MC20, and MC30). FIG. 20B includes a four-microphone implementation of array R100 (microphones MC10, MC20, MC30, and MC40). FIG. 20C includes a five-microphone implementation of array R100 (microphones MC10, MC20, MC30, MC40, and MC50). FIG. 20D includes a six-microphone implementation of array R100 (microphones MC10, MC20, MC30, MC40, MC50, and MC60). It may be desirable to position each of the microphones of array R100 at a corresponding vertex of a regular polygon. A loudspeaker SP10 for reproduction of the far-end audio signal may be included within the device (e.g., as shown in FIG. 20A), and/or such a loudspeaker may be located separately from the device (e.g., to reduce acoustic feedback). Additional far-field use case examples include a TV set-top box (e.g., to support Voice over IP (VoIP) applications) and a game console (e.g., Microsoft Xbox, Sony Playstation, Nintendo Wii).

It is expressly disclosed that applicability of systems, methods, and apparatus disclosed herein includes and is not limited to the particular examples shown in FIGS. 6 to 21D. The microphone pairs used in an implementation of the switching strategy may even be located on different devices (i.e., a distributed set) such that the pairs may be movable relative to one another over time. For example, the microphones used in such an implementation may be located on both of a portable media player (e.g., Apple iPod) and a phone, a headset and a phone, a lapel mount and a phone, a portable computing device (e.g., a tablet) and a phone or headset, two different devices that are each worn on the user's body, a device worn on the user's body and a device held in the user's hand, a device worn or held by the user and a device that is not worn or held by the user, etc. Channels from different microphone pairs may have different frequency ranges and/or different sampling rates.

The switching strategy may be configured to choose the best end-fire microphone pair for a given source-device orientation (e.g., a given phone holding position). For every holding position, for example, the switching strategy may be configured to identify, from a selection of multiple microphones (for example, four microphones), the microphone pair which is oriented more or less in an endfire direction toward the user's mouth. This identification may be based on near-field DOA estimation, which may be based on phase and/or gain differences between microphone signals. The signals from the identified microphone pair may be used to support one or more multichannel spatially selective processing operations, such as dual-microphone noise reduction, which may also be based on phase and/or gain differences between the microphone signals.

Figure 22C:
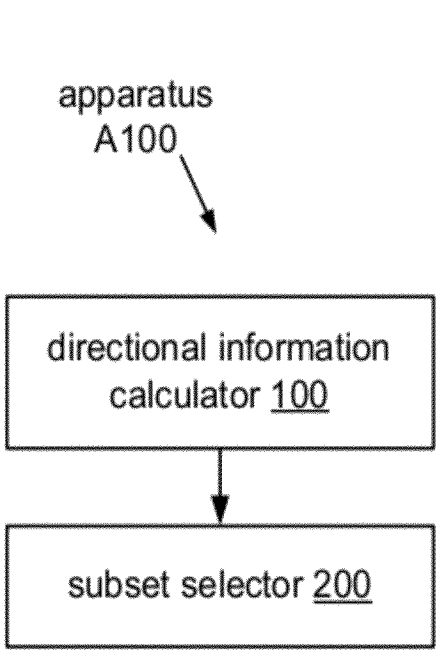
FIG. 22C shows a block diagram of an apparatus A100 according to a general configuration.
Figure 22B:
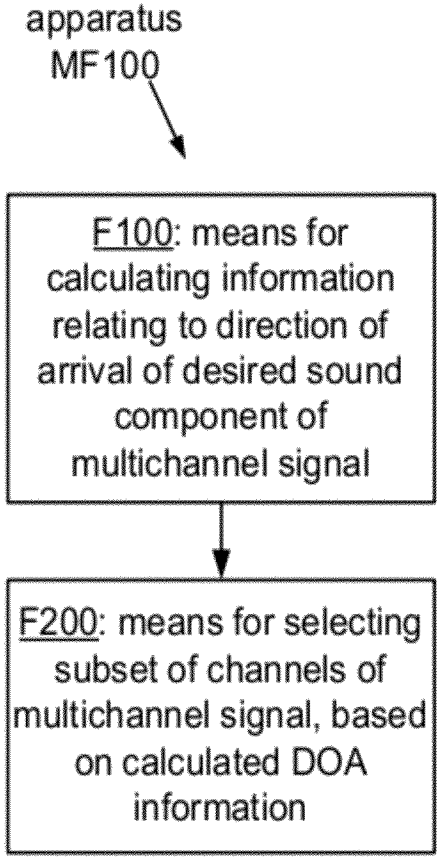
FIG. 22B shows a block diagram of an apparatus MF100 according to a general configuration.
Figure 22A:
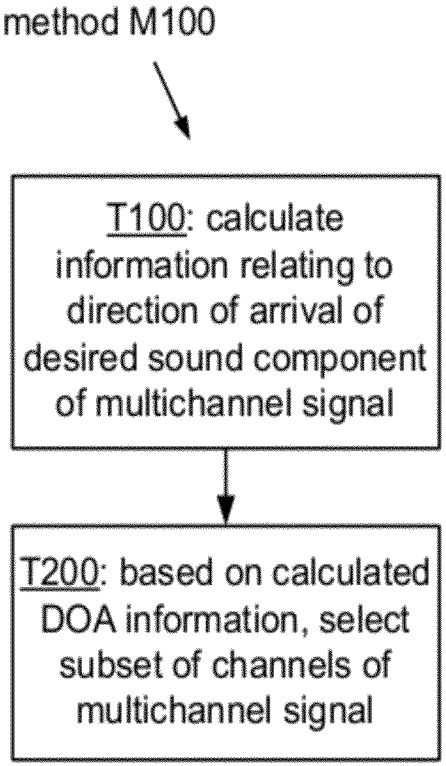
FIG. 22A shows a flowchart of a method M100 according to a general configuration.

FIG. 22A shows a flowchart for a method M100 (e.g., a switching strategy) according to a general configuration. Method M100 may be implemented, for example, as a decision mechanism for switching between different pairs of microphones of a set of three or more microphones, where each microphone of the set produces a corresponding channel of a multichannel signal. Method M100 includes a task T100 that calculates information relating to the direction of arrival (DOA) of a desired sound component (e.g., the sound of the user's voice) of a multichannel signal. Method M100 also includes a task T200 that selects a proper subset (i.e., fewer than all) of the channels of the multichannel signal, based on the calculated DOA information. For example, task T200 may be configured to select the channels of a microphone pair whose endfire direction corresponds to a DOA indicated by task T100. It is expressly noted that task T200 may also be implemented to select more than one subset at a time (for a multi-source application, for example, such as an audio- and/or video-conferencing application).

FIG. 22B shows a block diagram of an apparatus MF100 according to a general configuration. Apparatus MF100 includes means F100 for calculating information relating to the direction of arrival (DOA) of a desired sound component of the multichannel signal (e.g., by performing an implementation of task T100 as described herein), and means F200 for selecting a proper subset of the channels of the multichannel signal, based on the calculated DOA information (e.g., by performing an implementation of task T200 as described herein).

FIG. 22C shows a block diagram of an apparatus A100 according to a general configuration. Apparatus A100 includes a directional information calculator 100 that is configured to calculate information relating to the direction of arrival (DOA) of a desired sound component of the multichannel signal (e.g., by performing an implementation of task T100 as described herein), and a subset selector 200 that is configured to select a proper subset of the channels of the multichannel signal, based on the calculated DOA information (e.g., by performing an implementation of task T200 as described herein).

Task T100 may be configured to calculate a direction of arrival with respect to a microphone pair for each time-frequency point of a corresponding channel pair. A directional masking function may be applied to these results to distinguish points having directions of arrival within a desired range (e.g., an endfire sector) from points having other directions of arrival. Results from the masking operation may also be used to remove signals from undesired directions by discarding or attenuating time-frequency points having directions of arrival outside the mask.

Task T100 may be configured to process the multichannel signal as a series of segments. Typical segment lengths range from about five or ten milliseconds to about forty or fifty milliseconds, and the segments may be overlapping (e.g., with adjacent segments overlapping by 25% or 50%) or nonoverlapping. In one particular example, the multichannel signal is divided into a series of nonoverlapping segments or "frames", each having a length of ten milliseconds. A segment as processed by task T100 may also be a segment (i.e., a "subframe") of a larger segment as processed by a different operation, or vice versa.

Task T100 may be configured to indicate the DOA of a near-field source based on directional coherence in certain spatial sectors using multichannel recordings from an array of microphones (e.g., a microphone pair). FIG. 23A shows a flowchart of such an implementation T102 of task T100 that includes subtasks T110 and T120. Based on a plurality of phase differences calculated by task T110, task T120 evaluates a degree of directional coherence of the multichannel signal in each of one or more of a plurality of spatial sectors.

Task T110 may include calculating a frequency transform of each channel, such as a fast Fourier transform (FFT) or discrete cosine transform (DCT). Task T110 is typically configured to calculate the frequency transform of the channel for each segment. It may be desirable to configure task T110 to perform a 128-point or 256-point FFT of each segment, for example. An alternate implementation of task T110 is configured to separate the various frequency components of the channel using a bank of subband filters.

Task T110 may also include calculating (e.g., estimating) the phase of the microphone channel for each of the different frequency components (also called "bins"). For each frequency component to be examined, for example, task T110 may be configured to estimate the phase as the inverse tangent (also called the arctangent) of the ratio of the imaginary term of the corresponding FFT coefficient to the real term of the FFT coefficient.

Task T110 calculates a phase difference $\Delta\phi$ for each of the different frequency components, based on the estimated phases for each channel. Task T110 may be configured to calculate the phase difference by subtracting the estimated phase for that frequency component in one channel from the estimated phase for that frequency component in another channel. For example, task T110 may be configured to calculate the phase difference by subtracting the estimated phase for that frequency component in a primary channel from the estimated phase for that frequency component in another (e.g., secondary) channel. In such case, the primary channel may be the channel expected to have the highest signal-to-noise ratio, such as the channel corresponding to a microphone that is expected to receive the user's voice most directly during a typical use of the device.

It may be desirable to configure method M100 (or a system or apparatus configured to perform such a method) to determine directional coherence between channels of each pair over a wideband range of frequencies. Such a wideband range may extend, for example, from a low frequency bound of zero, fifty, one hundred, or two hundred Hz to a high frequency bound of three, 3.5, or four kHz (or even higher, such as up to seven or eight kHz or more). However, it may be unnecessary for task T110 to calculate phase differences across the entire bandwidth of the signal. For many bands in such a wideband range, for example, phase estimation may be impractical or unnecessary. The practical valuation of phase relationships of a received waveform at very low frequencies typically requires correspondingly large spacings between the transducers. Consequently, the maximum available spacing between microphones may establish a low frequency bound. On the other end, the distance between microphones should not exceed half of the minimum wavelength in order to avoid spatial aliasing. An eight-kilohertz sampling rate, for example, gives a bandwidth from zero to four kilohertz. The wavelength of a four-kHz signal is about 8.5 centimeters, so in this case, the spacing between adjacent microphones should not exceed about four centimeters. The microphone channels may be lowpass filtered in order to remove frequencies that might give rise to spatial aliasing.

It may be desirable to target specific frequency components, or a specific frequency range, across which a speech signal (or other desired signal) may be expected to be directionally coherent. It may be expected that background noise, such as directional noise (e.g., from sources such as automobiles) and/or diffuse noise, will not be directionally coherent over the same range. Speech tends to have low power in the range from four to eight kilohertz, so it may be desirable to forego phase estimation over at least this range. For example, it may be desirable to perform phase estimation and determine directional coherency over a range of from about seven hundred hertz to about two kilohertz.

Accordingly, it may be desirable to configure task T110 to calculate phase estimates for fewer than all of the frequency components (e.g., for fewer than all of the frequency samples of an FFT). In one example, task T110 calculates phase estimates for the frequency range of 700 Hz to 2000 Hz. For a 128-point FFT of a four-kilohertz-bandwidth signal, the range of 700 to 2000 Hz corresponds roughly to the twenty-three frequency samples from the tenth sample through the thirty-second sample.

Based on information from the phase differences calculated by task T110, task T120 evaluates a directional coherence of the channel pair in at least one spatial sector (where the spatial sector is relative to an axis of the microphone pair). The "directional coherence" of a multichannel signal is defined as the degree to which the various frequency components of the signal arrive from the same direction. For an ideally directionally coherent channel pair, the value of $$\frac{\Delta\varphi}{f}$$

is equal to a constant k for all frequencies, where the value of k is related to the direction of arrival $\theta$ and the time delay of arrival $\tau$. The directional coherence of a multichannel signal may be quantified, for example, by rating the estimated direction of arrival for each frequency component according to how well it agrees with a particular direction, and then combining the rating results for the various frequency components to obtain a coherency measure for the signal. Calculation and application of a measure of directional coherence is also described in, e.g., International Patent Publications WO2010/048620 A1 and WO2010/144577 A1 (Visser et al.).

For each of a plurality of the calculated phase differences, task T120 calculates a corresponding indication of the direction of arrival. Task T120 may be configured to calculate an indication of the direction of arrival $\theta_i$ of each frequency component as a ratio $r_i$ between estimated phase difference $\Delta\phi_i$ and frequency $f_i$ $$\left(\text{e.g., } r_i = \frac{\Delta\varphi_i}{f_i}\right).$$

Alternatively, task T120 may be configured to estimate the direction of arrival $\theta_i$ as the inverse cosine (also called the arccosine) of the quantity $$\frac{c\Delta\varphi_i}{d2\pi f_i},$$

where c denotes the speed of sound (approximately 340 m/sec), d denotes the distance between the microphones, $\Delta\phi_i$ denotes the difference in radians between the corresponding phase estimates for the two microphones, and $f_i$ is the frequency component to which the phase estimates correspond (e.g., the frequency of the corresponding FFT samples, or a center or edge frequency of the corresponding subbands). Alternatively, task T120 may be configured to estimate the direction of arrival $\theta_i$ as the inverse cosine of the quantity $$\frac{\lambda_i\Delta\varphi_i}{d2\pi},$$

where $\lambda_i$ denotes the wavelength of frequency component $f_i$.

Figure 24A:
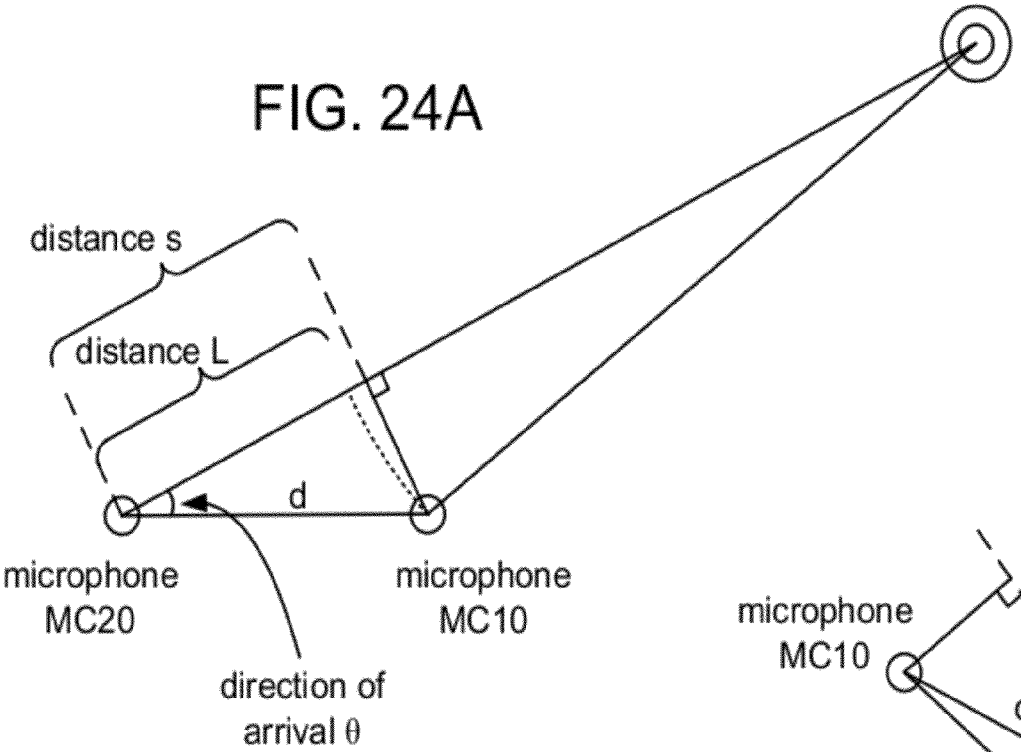
FIGS. 24A and 24B show examples of a geometric approximation that illustrates an approach to estimating direction of arrival.

FIG. 24A shows an example of a geometric approximation that illustrates this approach to estimating direction of arrival $\theta$ with respect to microphone MC20 of a microphone pair MC10, MC20. This approximation assumes that the distance s is equal to the distance L, where s is the distance between the position of microphone MC20 and the orthogonal projection of the position of microphone MC10 onto the line between the sound source and microphone MC20, and L is the actual difference between the distances of each microphone to the sound source. The error (s-L) becomes smaller as the direction of arrival $\theta$ with respect to microphone MC20 approaches zero. This error also becomes smaller as the relative distance between the sound source and the microphone array increases.

Figure 24B:
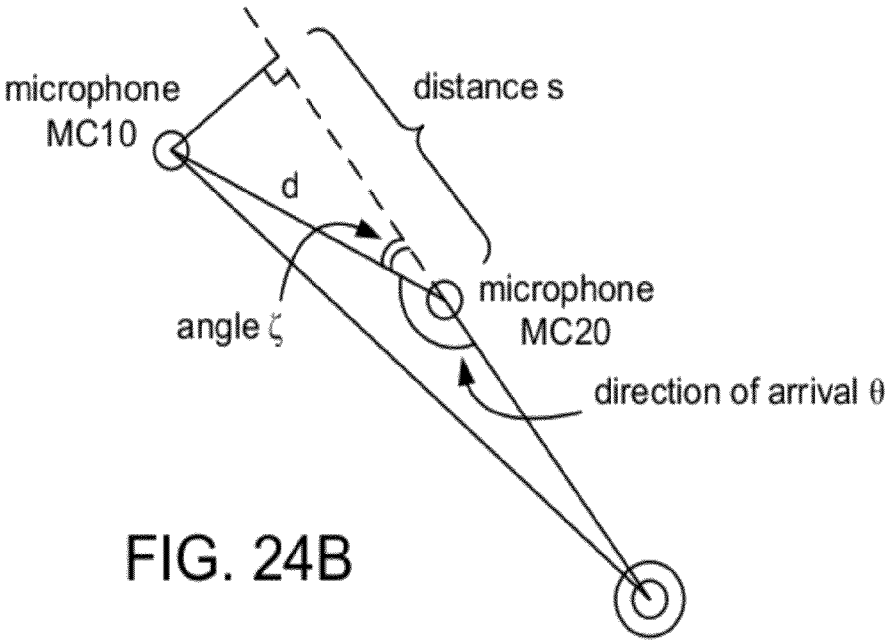

The scheme illustrated in FIG. 24A may be used for first- and fourth-quadrant values of $\Delta\phi_i$ (i.e., from zero to $+\pi/2$ and zero to $-\pi/2$). FIG. 24B shows an example of using the same approximation for second- and third-quadrant values of $\Delta\phi_i$ (i.e., from $+\pi/2$ to $-\pi/2$). In this case, an inverse cosine may be calculated as described above to evaluate the angle $\xi$, which is then subtracted from $\pi$ radians to yield direction of arrival $\theta_i$. The practicing engineer will also understand that direction of arrival $\theta_i$ may be expressed in degrees or any other units appropriate for the particular application instead of radians.

In the example of FIG. 24A, a value of $\theta_i=0$ indicates a signal arriving at microphone MC20 from a reference endfire direction (i.e., the direction of microphone MC10), a value of $\theta_i=\pi$ indicates a signal arriving from the other endfire direction, and a value of $\theta_i=\pi/2$ indicates a signal arriving from a broadside direction. In another example, task T120 may be configured to evaluate $\theta_i$ with respect to a different reference position (e.g., microphone MC10 or some other point, such as a point midway between the microphones) and/or a different reference direction (e.g., the other endfire direction, a broadside direction, etc.).

In another example, task T120 is configured to calculate an indication of the direction of arrival as the time delay of arrival $\tau_i$ (e.g., in seconds) of the corresponding frequency component $f_i$ of the multichannel signal. For example, task T120 may be configured to estimate the time delay of arrival $\tau_i$ at a secondary microphone MC20 with reference to primary microphone MC10, using an expression such as $$\tau_i = \frac{\lambda_i\Delta\varphi_i}{c2\pi} \text{ or } \tau_i = \frac{\Delta\varphi_i}{2\pi f_i}.$$

In these examples, a value of $\tau_i=0$ indicates a signal arriving from a broadside direction, a large positive value of $\tau_i$ indicates a signal arriving from the reference endfire direction, and a large negative value of $\tau_i$ indicates a signal arriving from the other endfire direction. In calculating the values $\tau_i$, it may be desirable to use a unit of time that is deemed appropriate for the particular application, such as sampling periods (e.g., units of 125 microseconds for a sampling rate of 8 kHz) or fractions of a second (e.g., $10^{-3}$, $10^{-4}$, $10^{-5}$, or $10^{-6}$ sec). It is noted that task T100 may also be configured to calculate time delay of arrival $\tau_i$ by cross-correlating the frequency components $f_i$ of each channel in the time domain.

Figure 25:
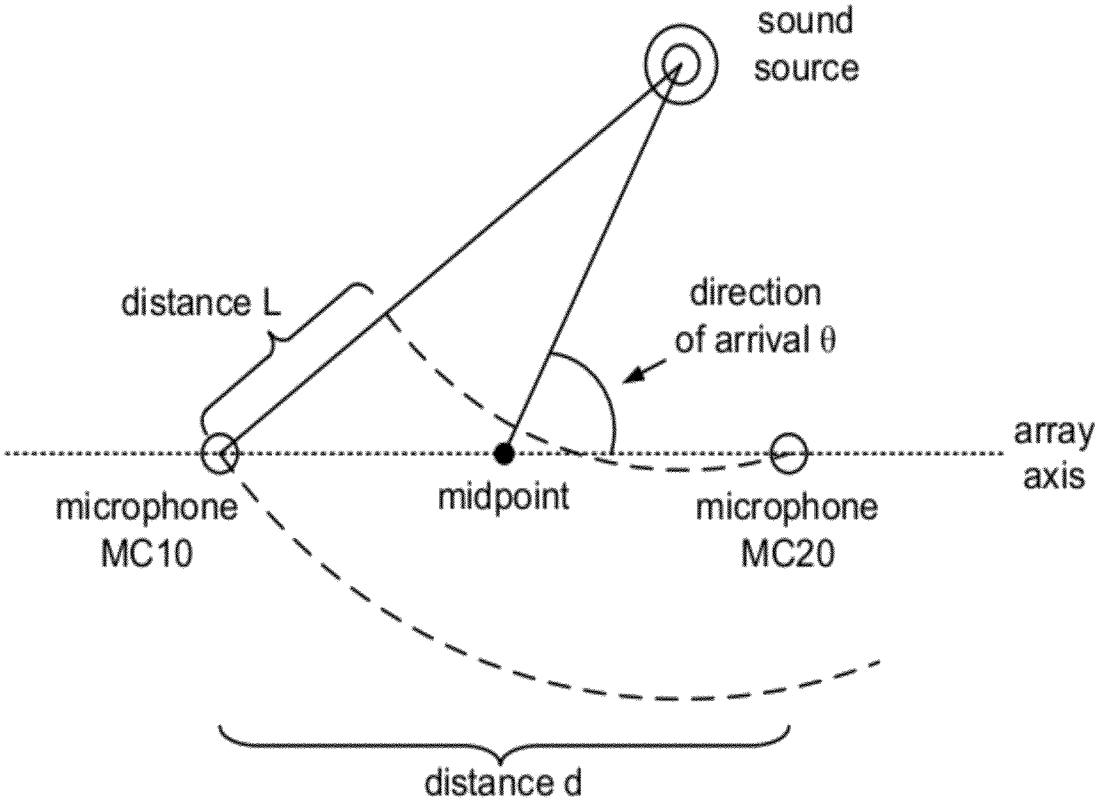
FIG. 25 shows an example of a different model.

It is noted that while the expression $$\theta_i = \cos^{-1}\left(\frac{c\Delta\varphi_i}{d2\pi f_i}\right) \text{ or } \theta_i = \cos^{-1}\left(\frac{\lambda_i\Delta\varphi_i}{d2\pi}\right)$$

calculates the direction indicator $\theta_i$ according to a far-field model (i.e., a model that assumes a planar wavefront), the expressions $$\tau_i = \frac{\lambda_i\Delta\varphi_i}{c2\pi},\ \tau_i = \frac{\Delta\varphi_i}{2\pi f_i},\ r_i = \frac{\Delta\varphi_i}{f_i}, \text{ and } r_i = \frac{f_i}{\Delta\varphi_i}$$

calculate the direction indicators $\tau_i$ and $r_i$ according to a near-field model (i.e., a model that assumes a spherical wavefront, as illustrated in FIG. 25). While a direction indicator that is based on a near-field model may provide a result that is more accurate and/or easier to compute, a direction indicator that is based on a far-field model provides a nonlinear mapping between phase difference and direction indicator value that may be desirable for some applications of method M100.

It may be desirable to configure method M100 according to one or more characteristics of a speech signal. In one such example, task T110 is configured to calculate phase differences for the frequency range of 700 Hz to 2000 Hz, which may be expected to include most of the energy of the user's voice. For a 128-point FFT of a four-kilohertz-bandwidth signal, the range of 700 to 2000 Hz corresponds roughly to the twenty-three frequency samples from the tenth sample through the thirty-second sample. In further examples, task T110 is configured to calculate phase differences over a frequency range that extends from a lower bound of about fifty, 100, 200, 300, or 500 Hz to an upper bound of about 700, 1000, 1200, 1500, or 2000 Hz (each of the twenty-five combinations of these lower and upper bounds is expressly contemplated and disclosed).

Figure 26:
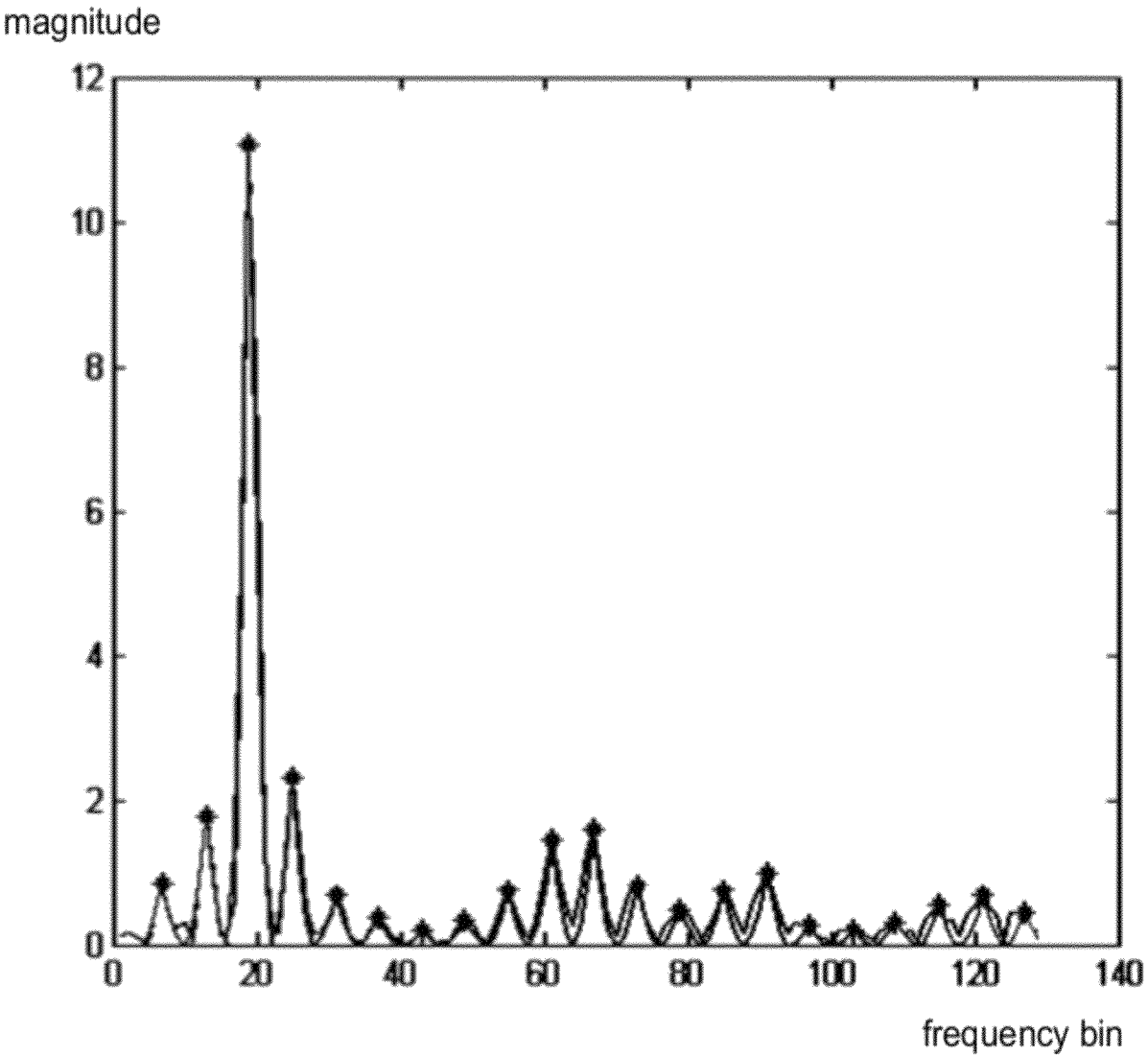
FIG. 26 shows a plot of magnitude vs. frequency bin for an FFT of a signal.

The energy spectrum of voiced speech (e.g., vowel sounds) tends to have local peaks at harmonics of the pitch frequency. FIG. 26 shows the magnitudes of the first 128 bins of a 256-point FFT of such a signal, with asterisks indicating the peaks. The energy spectrum of background noise, on the other hand, tends to be relatively unstructured. Consequently, components of the input channels at harmonics of the pitch frequency may be expected to have a higher signal-to-noise ratio (SNR) than other components. It may be desirable to configure method M110 (for example, to configure task T120) to consider only phase differences which correspond to multiples of an estimated pitch frequency.

Typical pitch frequencies range from about 70 to 100 Hz for a male speaker to about 150 to 200 Hz for a female speaker. The current pitch frequency may be estimated by calculating the pitch period as the distance between adjacent pitch peaks (e.g., in a primary microphone channel). A sample of an input channel may be identified as a pitch peak based on a measure of its energy (e.g., based on a ratio between sample energy and frame average energy) and/or a measure of how well a neighborhood of the sample is correlated with a similar neighborhood of a known pitch peak. A pitch estimation procedure is described, for example, in section 4.6.3 (pp. 4-44 to 4-49) of EVRC (Enhanced Variable Rate Codec) document C.S0014-C, available online at www-dot-3gpp-dot-org. A current estimate of the pitch frequency (e.g., in the form of an estimate of the pitch period or "pitch lag") will typically already be available in applications that include speech encoding and/or decoding (e.g., voice communications using codecs that include pitch estimation, such as code-excited linear prediction (CELP) and prototype waveform interpolation (PWI)).

Figure 27:
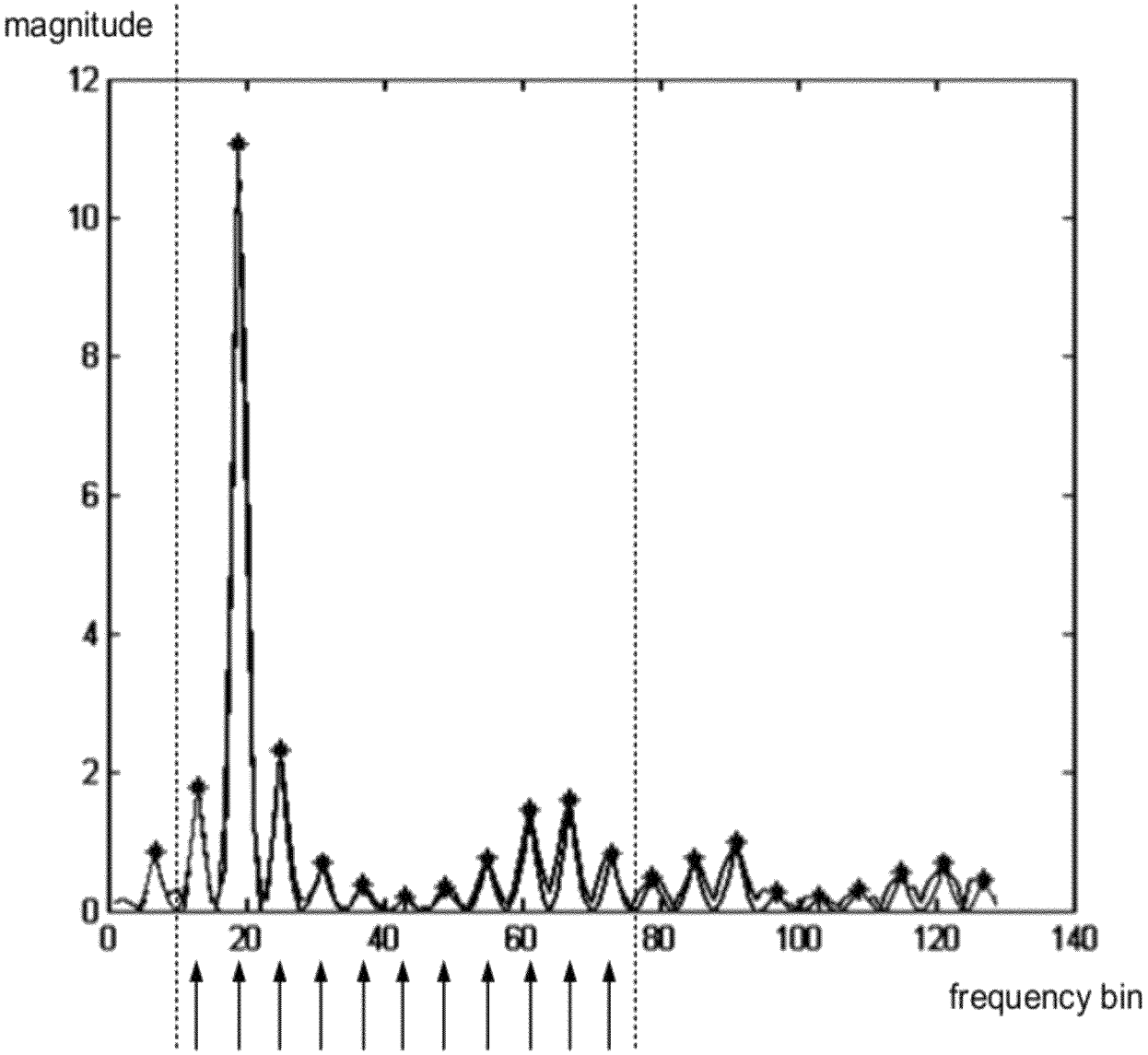
FIG. 27 shows a result of a pitch selection operation on the spectrum of FIG. 26.

FIG. 27 shows an example of applying such an implementation of method M110 (e.g., of task T120) to the signal whose spectrum is shown in FIG. 26. The dotted lines indicate the frequency range to be considered. In this example, the range extends from the tenth frequency bin to the seventy-sixth frequency bin (approximately 300 to 2500 Hz). By considering only those phase differences that correspond to multiples of the pitch frequency (approximately 190 Hz in this example), the number of phase differences to be considered is reduced from sixty-seven to only eleven. Moreover, it may be expected that the frequency coefficients from which these eleven phase differences are calculated will have high SNRs relative to other frequency coefficients within the frequency range being considered. In a more general case, other signal characteristics may also be considered. For example, it may be desirable to configure task T110 such that at least twenty-five, fifty, or seventy-five percent of the calculated phase differences correspond to multiples of an estimated pitch frequency. The same principle may be applied to other desired harmonic signals as well. In a related implementation of method M110, task T110 is configured to calculate phase differences for each of the frequency components of at least a subband of the channel pair, and task T120 is configured to evaluate coherence based on only those phase differences which correspond to multiples of an estimated pitch frequency.

Formant tracking is another speech-characteristic-related procedure that may be included in an implementation of method M100 for a speech processing application (e.g., a voice activity detection application). Formant tracking may be performed using linear predictive coding, hidden Markov models (HMMs), Kalman filters, and/or me1-frequency cepstral coefficients (MFCCs). Formant information is typically already available in applications that include speech encoding and/or decoding (e.g., voice communications using linear predictive coding, speech recognition applications using MFCCs and/or HMMs).

Task T120 may be configured to rate the direction indicators by converting or mapping the value of the direction indicator, for each frequency component to be examined, to a corresponding value on an amplitude, magnitude, or pass/fail scale. For example, for each sector in which coherence is to be evaluated, task T120 may be configured to use a directional masking function to map the value of each direction indicator to a mask score that indicates whether (and/or how well) the indicated direction falls within the masking function's passband. (In this context, the term "passband" refers to the range of directions of arrival that are passed by the masking function.) The passband of the masking function is selected to reflect the spatial sector in which directional coherence is to be evaluated. The set of mask scores for the various frequency components may be considered as a vector.

The width of the passband may be determined by factors such as the number of sectors in which coherence is to be evaluated, a desired degree of overlap between sectors, and/or the total angular range to be covered by the sectors (which may be less than 360 degrees). It may be desirable to design an overlap among adjacent sectors (e.g., to ensure continuity for desired speaker movements, to support smoother transitions, and/or to reduce jitter). The sectors may have the same angular width (e.g., in degrees or radians) as one another, or two or more (possibly all) of the sectors may have different widths from one another.

The width of the passband may also be used to control the spatial selectivity of the masking function, which may be selected according to a desired tradeoff between admittance range (i.e., the range of directions of arrival or time delays that are passed by the function) and noise rejection. While a wide passband may allow for greater user mobility and flexibility of use, it would also be expected to allow more of the environmental noise in the channel pair to pass through to the output.

The directional masking function may be implemented such that the sharpness of the transition or transitions between stopband and passband are selectable and/or variable during operation according to the values of one or more factors such as signal-to-noise ratio (SNR), noise floor, etc. For example, it may be desirable to use a more narrow passband when the SNR is low.

Figure 28A:
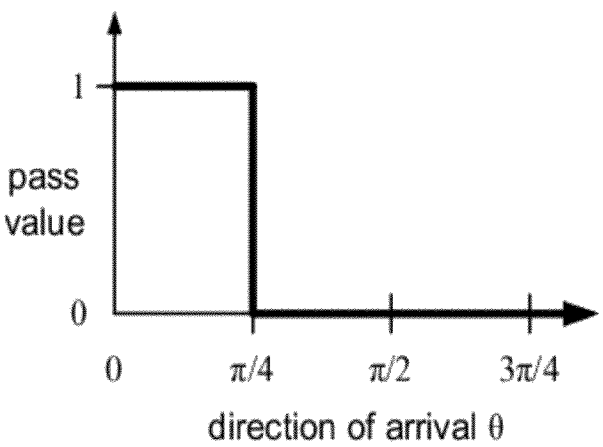
FIGS. 28A-D show examples of masking functions.
Figure 28B:
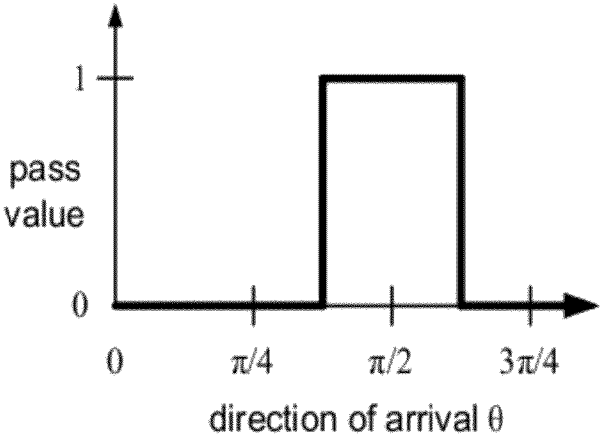

FIG. 28A shows an example of a masking function having relatively sudden transitions between passband and stopband (also called a "brickwall" profile) and a passband centered at direction of arrival $\theta=0$ (i.e., an endfire sector). In one such case, task T120 is configured to assign a binary-valued mask score having a first value (e.g., one) when the direction indicator indicates a direction within the function's passband, and a mask score having a second value (e.g., zero) when the direction indicator indicates a direction outside the function's passband. Task T120 may be configured to apply such a masking function by comparing the direction indicator to a threshold value. FIG. 28B shows an example of a masking function having a "brickwall" profile and a passband centered at direction of arrival $\theta=\pi/2$ (i.e., a broadside sector). Task T120 may be configured to apply such a masking function by comparing the direction indicator to upper and lower threshold values. It may be desirable to vary the location of a transition between stopband and passband depending on one or more factors such as signal-to-noise ratio (SNR), noise floor, etc. (e.g., to use a more narrow passband when the SNR is high, indicating the presence of a desired directional signal that may adversely affect calibration accuracy).

Figure 28C:
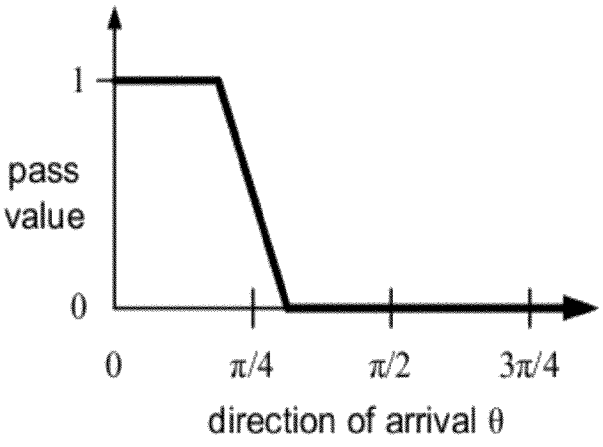
Figure 28D:
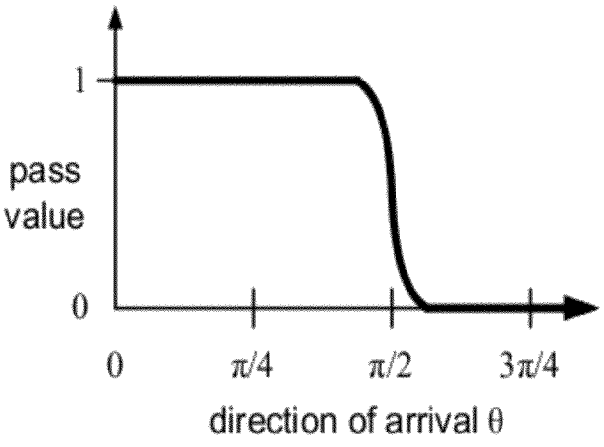
Figure 29A:
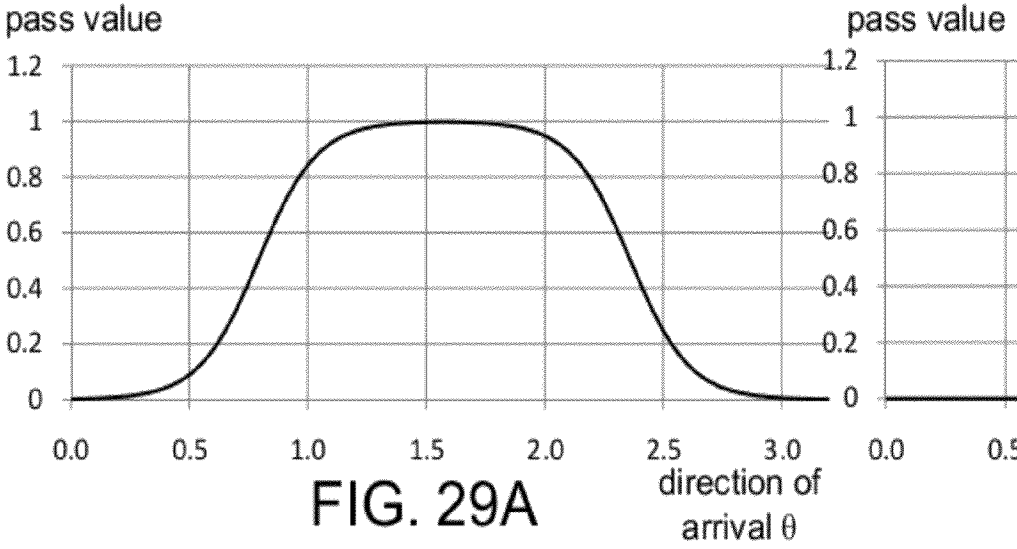
FIGS. 29A-D show examples of nonlinear masking functions.
Figure 29B:
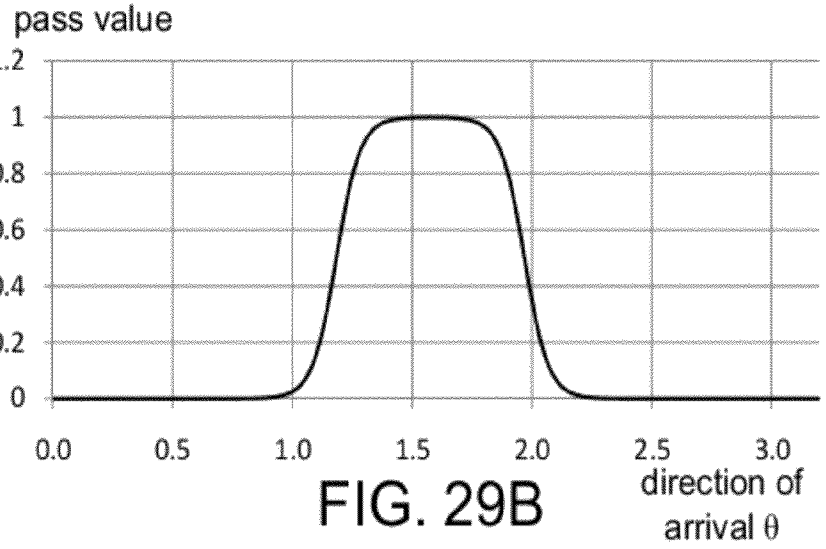
Figure 29C:
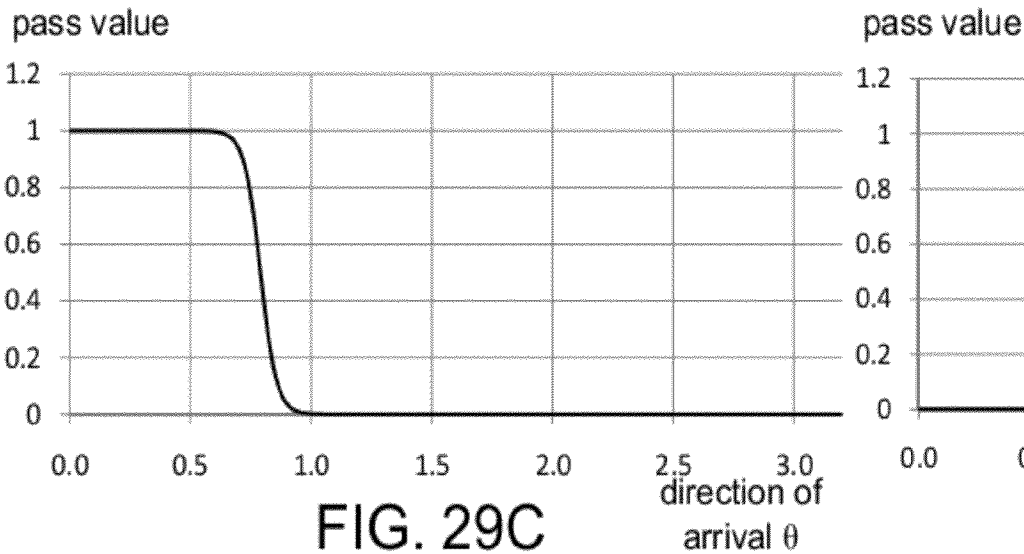
Figure 29D:
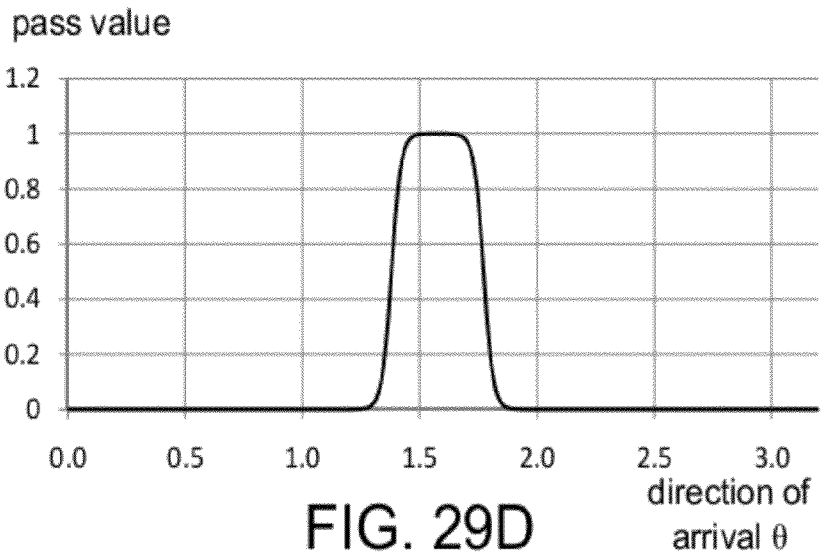

Alternatively, it may be desirable to configure task T120 to use a masking function having less abrupt transitions between passband and stopband (e.g., a more gradual rolloff, yielding a non-binary-valued mask score). FIG. 28C shows an example of a linear rolloff for a masking function having a passband centered at direction of arrival $\theta=0$, and FIG. 28D shows an example of a nonlinear rolloff for a masking function having a passband centered at direction of arrival $\theta=0$. It may be desirable to vary the location and/or the sharpness of the transition between stopband and passband depending on one or more factors such as SNR, noise floor, etc. (e.g., to use a more abrupt rolloff when the SNR is high, indicating the presence of a desired directional signal that may adversely affect calibration accuracy). Of course, a masking function (e.g., as shown in FIGS. 28A-D) may also be expressed in terms of time delay $\tau$ or ratio r rather than direction $\theta$. For example, a direction of arrival $\theta=\pi/2$ corresponds to a time delay $\tau$ or ratio $$r = \frac{\Delta\varphi}{f}$$

of zero.

One example of a nonlinear masking function may be expressed as $$m = \frac{1}{1 + \exp\left(\gamma\left[|\theta - \theta_T| - \left(\frac{w}{2}\right)\right]\right)},$$

where $\theta_T$ denotes a target direction of arrival, w denotes a desired width of the mask in radians, and $\gamma$ denotes a sharpness parameter. FIGS. 29A-D show examples of such a function for ($\gamma$, w, $\theta_T$) equal to $$\left(8, \frac{\pi}{2}, \frac{\pi}{2}\right), \left(20, \frac{\pi}{4}, \frac{\pi}{2}\right), \left(30, \frac{\pi}{2}, 0\right), \text{ and } \left(50, \frac{\pi}{8}, \frac{\pi}{2}\right),$$

respectively. Of course, such a function may also be expressed in terms of time delay $\tau$ or ratio r rather than direction $\theta$. It may be desirable to vary the width and/or sharpness of the mask depending on one or more factors such as SNR, noise floor, etc. (e.g., to use a more narrow mask and/or a more abrupt rolloff when the SNR is high).

It is noted that for small intermicrophone distances (e.g., 10 cm or less) and low frequencies (e.g., less than 1 kHz), the observable value of $\Delta\phi$ may be limited. For a frequency component of 200 Hz, for example, the corresponding wavelength is about 170 cm. An array having an intermicrophone distance of one centimeter can observe a maximum phase difference (e.g., at endfire) of only about two degrees for this component. In such case, an observed phase difference greater than two degrees indicates signals from more than one source (e.g., a signal and its reverberation). Consequently, it may be desirable to configure method M110 to detect when a reported phase difference exceeds a maximum value (e.g., the maximum observable phase difference, given the particular intermicrophone distance and frequency). Such a condition may be interpreted as inconsistent with a single source. In one such example, task T120 assigns the lowest rating value (e.g., zero) to the corresponding frequency component when such a condition is detected.

Task T120 calculates a coherency measure for the signal based on the rating results. For example, task T120 may be configured to combine the various mask scores that correspond to the frequencies of interest (e.g., components in the range of from 700 to 2000 Hz, and/or components at multiples of the pitch frequency) to obtain a coherency measure. For example, task T120 may be configured to calculate the coherency measure by averaging the mask scores (e.g., by summing the mask scores, or by normalizing the sum to obtain a mean of the mask scores). In such case, task T120 may be configured to weight each of the mask scores equally (e.g., to weight each mask score by one) or to weight one or more mask scores differently from one another (e.g., to weight a mask score that corresponds to a low- or high-frequency component less heavily than a mask score that corresponds to a mid-range frequency component). Alternatively, task T120 may be configured to calculate the coherency measure by calculating a sum of weighted values (e.g., magnitudes) of the frequency components of interest (e.g., components in the range of from 700 to 2000 Hz, and/or components at multiples of the pitch frequency), where each value is weighted by the corresponding mask score. In such case, the value of each frequency component may be taken from one channel of the multichannel signal (e.g., a primary channel) or from both channels (e.g., as an average of the corresponding value from each channel).

Instead of rating each of a plurality of direction indicators, an alternative implementation of task T120 is configured to rate each phase difference $\Delta\phi_i$ using a corresponding directional masking function $m_i$. For a case in which it is desired to select coherent signals arriving from directions in the range of from $\theta_L$ to $\theta_H$, for example, each masking function $m_i$ may be configured to have a passband that ranges from $\Delta\phi_{Li}$ to $\Delta\phi_{Hi}$, where $$\Delta\varphi_{Li} = \frac{d2\pi f_i}{c}\cos\theta_H \left(\text{equivalently, } \Delta\varphi_{Li} = \frac{d2\pi}{\lambda_i}\cos\theta_H\right)$$

and $$\Delta\varphi_{Hi} = \frac{d2\pi f_i}{c}\cos\theta_L \left(\text{equivalently, } \Delta\varphi_{Hi} = \frac{d2\pi}{\lambda_i}\cos\theta_L\right).$$

For a case in which it is desired to select coherent signals arriving from directions corresponding to the range of time delay of arrival from $\tau_L$ to $\tau_{Hi}$, each masking function $m_i$ may be configured to have a passband that ranges from $\Delta\phi_{Li}$ to $\Delta\phi_{Hi}$, where $$\Delta\varphi_{Li} = 2\pi f_i \tau_L \left(\text{equivalently, } \Delta\varphi_{Li} = \frac{c2\pi\tau_L}{\lambda_i}\right)$$

and $$\Delta\varphi_{Hi} = 2\pi f_i \tau_H \left(\text{equivalently, } \Delta\varphi_{Hi} = \frac{c2\pi\tau_H}{\lambda_i}\right).$$

For a case in which it is desired to select coherent signals arriving from directions corresponding to the range of the ratio of phase difference to frequency from $r_L$ to $r_H$, each masking function $m_i$ may be configured to have a passband that ranges from $\Delta\phi_{Li}$ to $\Delta\phi_{Hi}$, where $\Delta\phi_{Li}=f_i r_L$ and $\Delta\phi_{Hi}=f_i r_H$. The profile of each masking function is selected according to the sector to be evaluated and possibly according to additional factors as discussed above.

It may be desirable to configure task T120 to produce the coherency measure as a temporally smoothed value. For example, task T120 may be configured to calculate the coherency measure using a temporal smoothing function, such as a finite- or infinite-impulse-response filter. In one such example, the task is configured to produce the coherency measure as a mean value over the most recent m frames, where possible values of m include four, five, eight, ten, sixteen, and twenty. In another such example, the task is configured to calculate a smoothed coherency measure z(n) for frame n according to an expression such as $z(n)=\beta z(n-1)+(1-\beta)c(n)$ (also known as a first-order IIR or recursive filter), where z(n−1) denotes the smoothed coherency measure for the previous frame, c(n) denotes the current unsmoothed value of the coherency measure, and β is a smoothing factor whose value may be selected from the range of from zero (no smoothing) to one (no updating). Typical values for smoothing factor β include 0.1, 0.2, 0.25, 0.3, 0.4, and 0.5. During an initial convergence period (e.g., immediately following a power-on or other activation of the audio sensing circuitry), it may be desirable for the task to smooth the coherency measure over a shorter interval, or to use a smaller value of smoothing factor α, than during subsequent steady-state operation. It is typical, but not necessary, to use the same value of β to smooth coherency measures that correspond to different sectors.

The contrast of a coherency measure may be expressed as the value of a relation (e.g., the difference or the ratio) between the current value of the coherency measure and an average value of the coherency measure over time (e.g., the mean, mode, or median over the most recent ten, twenty, fifty, or one hundred frames). Task T200 may be configured to calculate the average value of a coherency measure using a temporal smoothing function, such as a leaky integrator or according to an expression such as $v(n)=\alpha v(n-1)+(1-\alpha)c(n)$, where v(n) denotes the average value for the current frame, v(n−1) denotes the average value for the previous frame, c(n) denotes the current value of the coherency measure, and α is a smoothing factor whose value may be selected from the range of from zero (no smoothing) to one (no updating). Typical values for smoothing factor α include 0.01, 0.02, 0.05, and 0.1.

It may be desirable to implement task T200 to include logic to support a smooth transition from one selected subset to another. For example, it may be desirable to configure task T200 to include an inertial mechanism, such as hangover logic, which may help to reduce jitter. Such hangover logic may be configured to inhibit task T200 from switching to a different subset of channels unless the conditions that indicate switching to that subset (e.g., as described above) continue over a period of several consecutive frames (e.g., two, three, four, five, ten, or twenty frames).

Figure 23B:
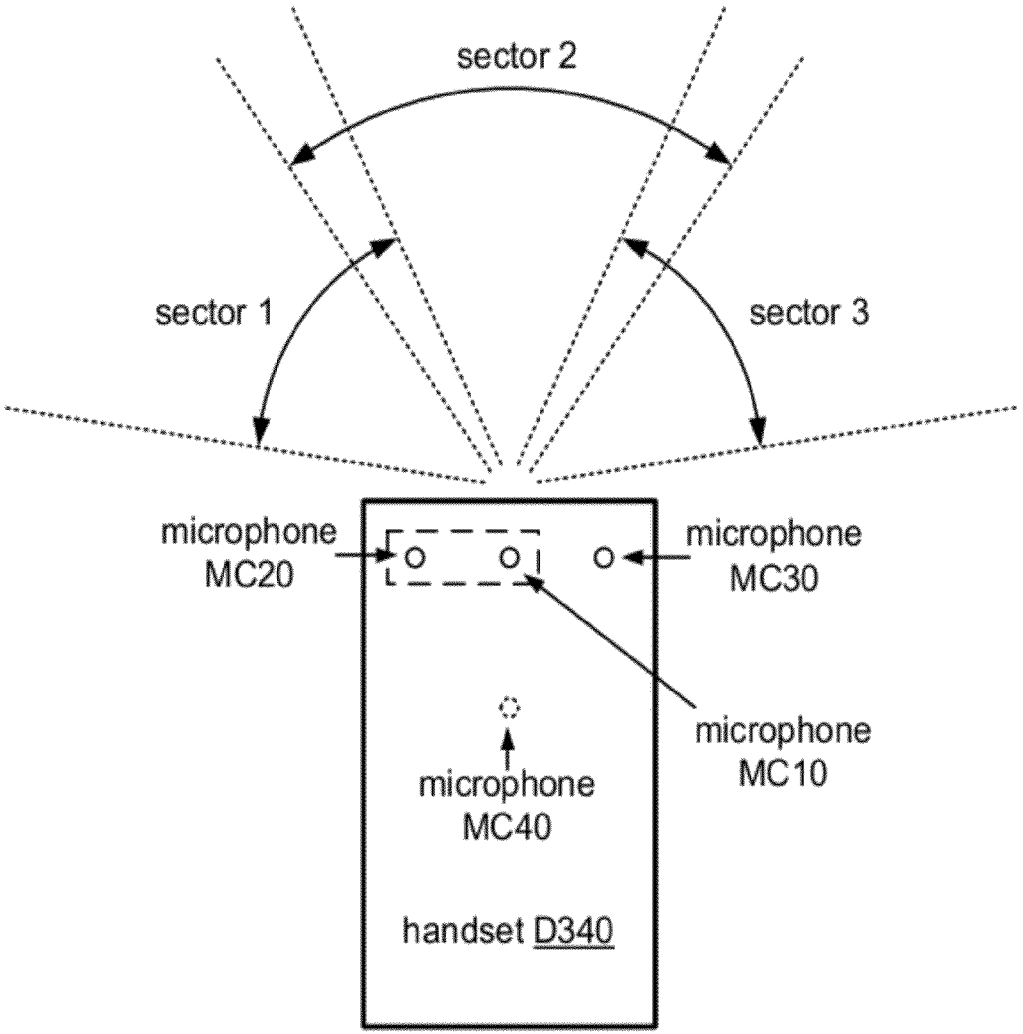
FIG. 23B shows an example of spatial sectors relative to a microphone pair MC10-MC20.
Figure 23A:
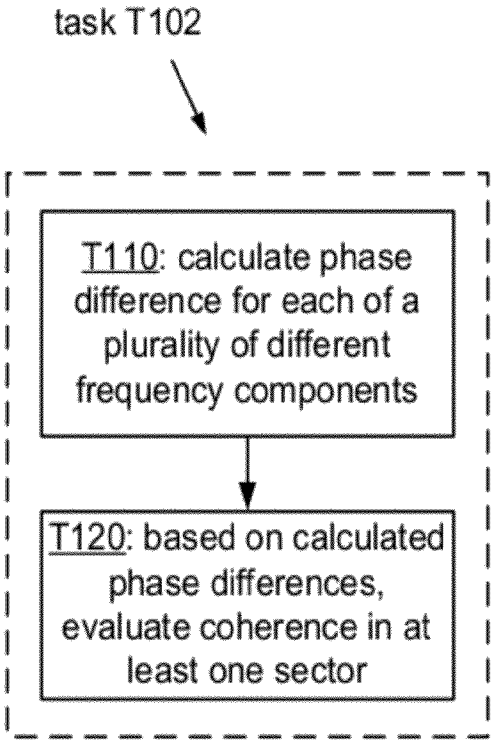
FIG. 23A shows a flowchart of an implementation T102 of task T100.

FIG. 23B shows an example in which task T102 is configured to evaluate a degree of directional coherence of a stereo signal received via the subarray of microphones MC10 and MC20 (alternatively, MC10 and MC30) in each of three overlapping sectors. In the example shown in FIG. 23B, task T200 selects the channels corresponding to microphone pair MC10 (as primary) and MC30 (as secondary) if the stereo signal is most coherent in sector 1; selects the channels corresponding to microphone pair MC10 (as primary) and MC40 (as secondary) if the stereo signal is most coherent in sector 2; and selects the channels corresponding to microphone pair MC10 (as primary) and MC20 (as secondary) if the stereo signal is most coherent in sector 3.

Task T200 may be configured to select the sector in which the signal is most coherent as the sector whose coherency measure is greatest. Alternatively, task T102 may be configured to select the sector in which the signal is most coherent as the sector whose coherency measure has the greatest contrast (e.g., has a current value that differs by the greatest relative magnitude from a long-term time average of the coherency measure for that sector).

Figure 30:
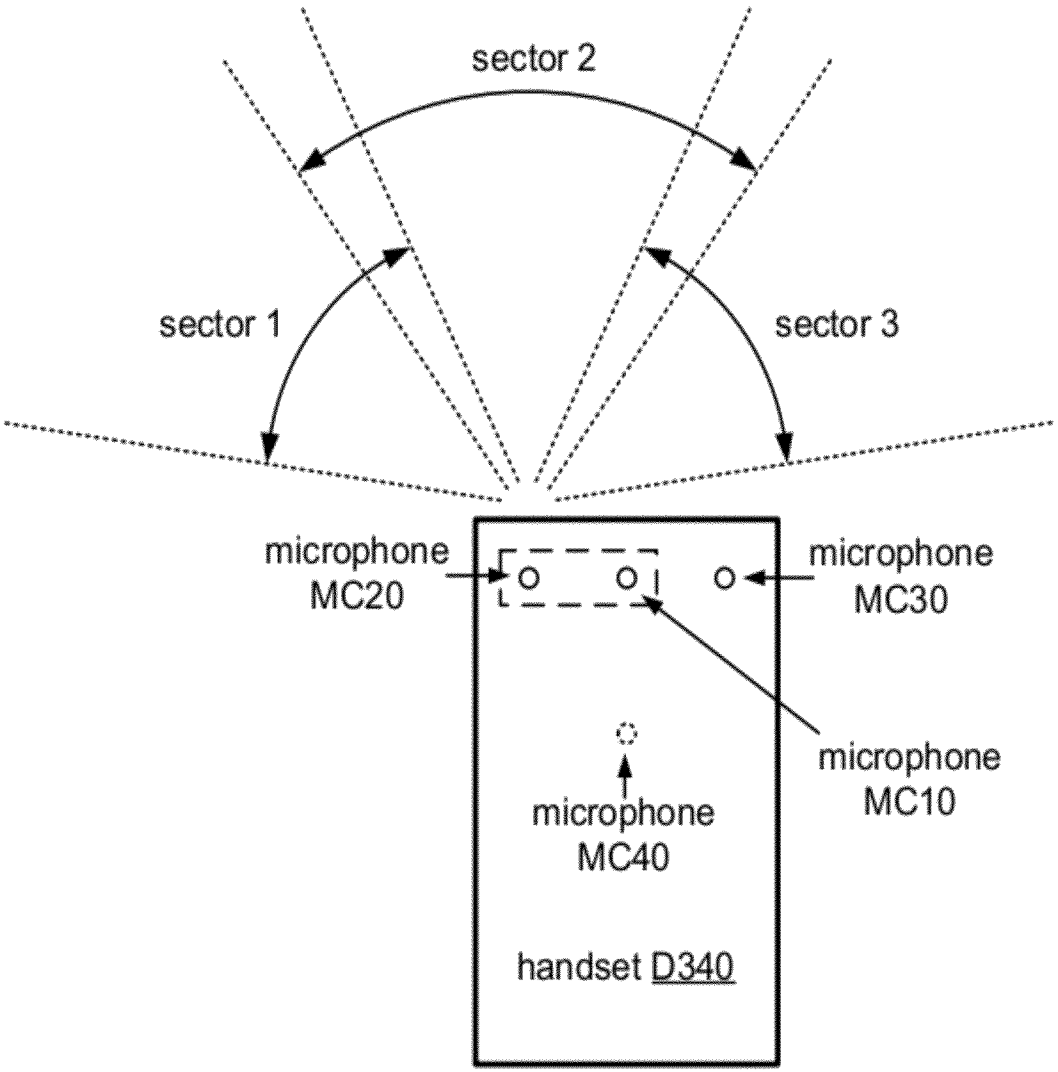
FIG. 30 shows an example of spatial sectors relative to a microphone pair MC20-MC10.

FIG. 30 shows another example in which task T102 is configured to evaluate a degree of directional coherence of a stereo signal received via the subarray of microphones MC20 and MC10 (alternatively, MC20 and MC30) in each of three overlapping sectors. In the example shown in FIG. 30, task T200 selects the channels corresponding to microphone pair MC20 (as primary) and MC10 (as secondary) if the stereo signal is most coherent in sector 1; selects the channels corresponding to microphone pair MC10 or MC20 (as primary) and MC40 (as secondary) if the stereo signal is most coherent in sector 2; and selects the channels corresponding to microphone pair MC10 or MC30 (as primary) and MC20 or MC10 (as secondary) if the stereo signal is most coherent in sector 3. (In the text that follows, the microphones of a microphone pair are listed with the primary microphone first and the secondary microphone last.) As noted above, task T200 may be configured to select the sector in which the signal is most coherent as the sector whose coherency measure is greatest, or to select the sector in which the signal is most coherent as the sector whose coherency measure has the greatest contrast.

Figure 31:
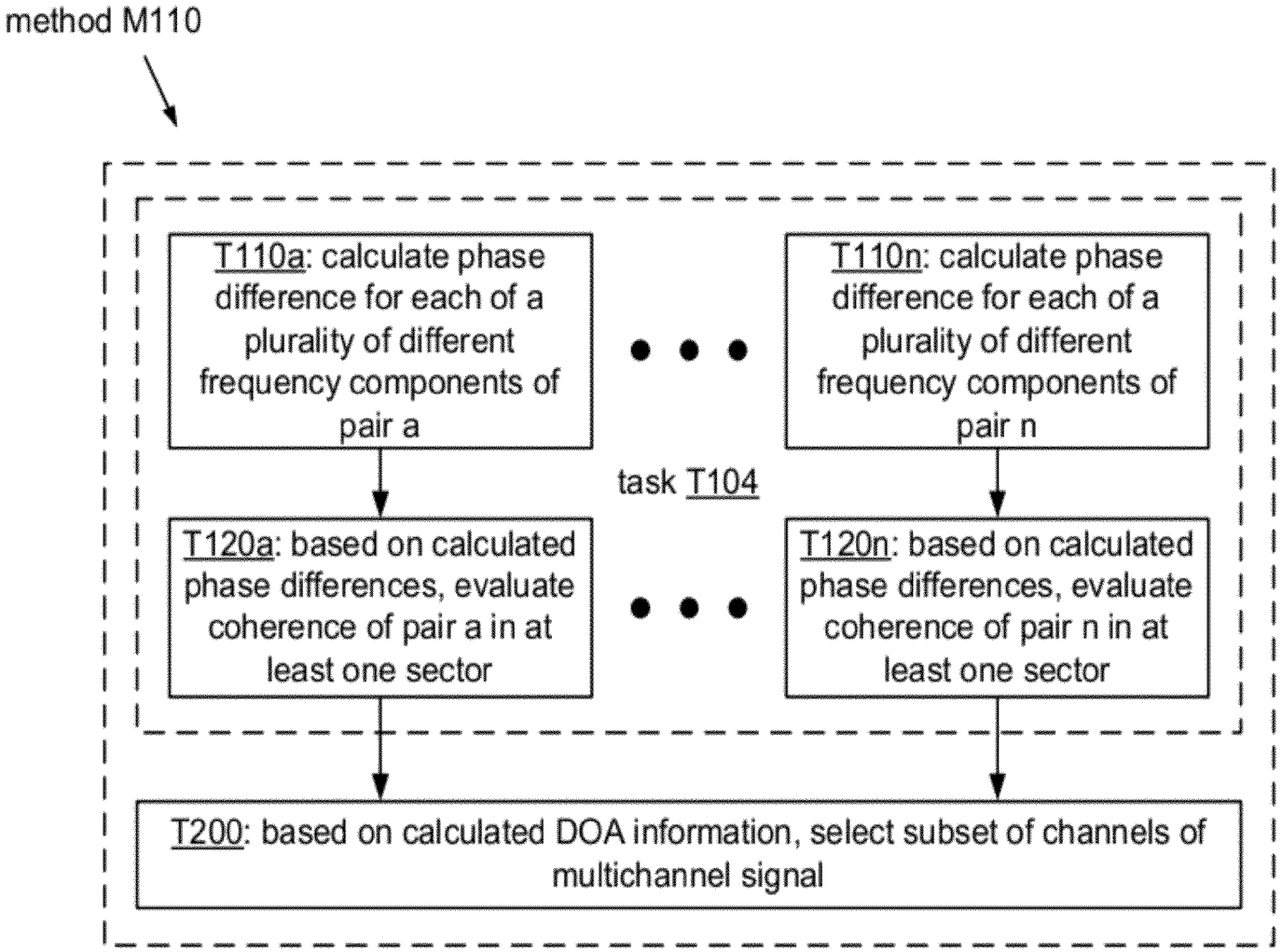
FIG. 31 shows a flowchart of an implementation M110 of method M100.

Alternatively, task T100 may be configured to indicate the DOA of a near-field source based on directional coherence in certain sectors using multichannel recordings from a set of three or more (e.g., four) microphones. FIG. 31 shows a flowchart of such an implementation M110 of method M100. Method M110 includes task T200 as described above and an implementation T104 of task T100. Task T104 includes n instances (where the value of n is an integer of two or more) of tasks T110 and T120. In task T104, each instance of task T110 calculates phase differences for frequency components of a corresponding different pair of channels of the multichannel signal, and each instance of task T120 evaluates a degree of directional coherence of the corresponding pair in each of at least one spatial sector. Based on the evaluated degrees of coherence, task T200 selects a proper subset of the channels of the multichannel signal (e.g., selects the pair of channels corresponding to the sector in which the signal is most coherent).

Figure 32:
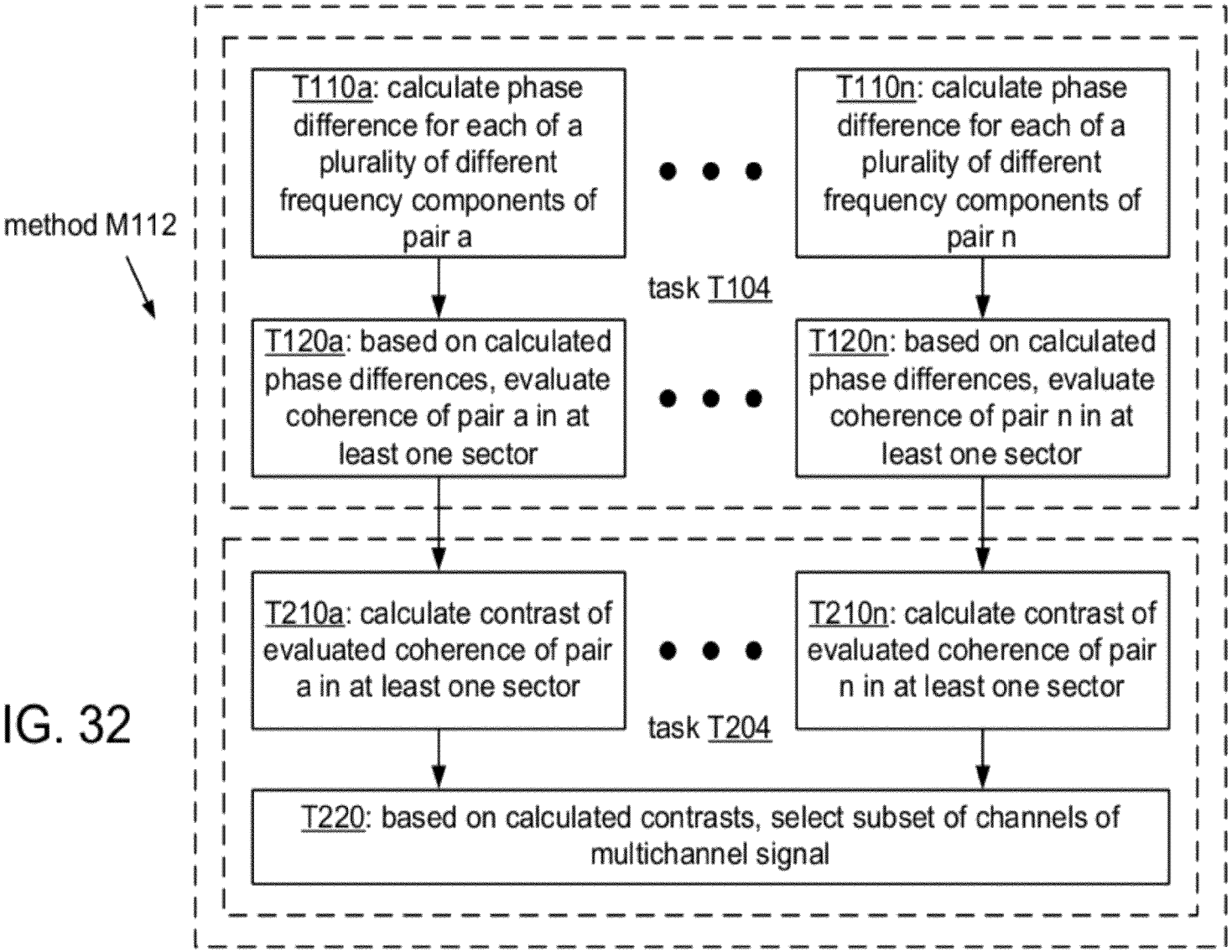
FIG. 32 shows a flowchart of an implementation M112 of method M110.

As noted above, task T200 may be configured to select the sector in which the signal is most coherent as the sector whose coherency measure is greatest, or to select the sector in which the signal is most coherent as the sector whose coherency measure has the greatest contrast. FIG. 32 shows a flowchart of an implementation M112 of method M100 that includes such an implementation T204 of task T200. Task T204 includes n instances of task T210, each of which calculates a contrast of each coherency measure for the corresponding pair of channels. Task T204 also includes a task T220 that selects a proper subset of the channels of the multichannel signal based on the calculated contrasts.

Figure 33:
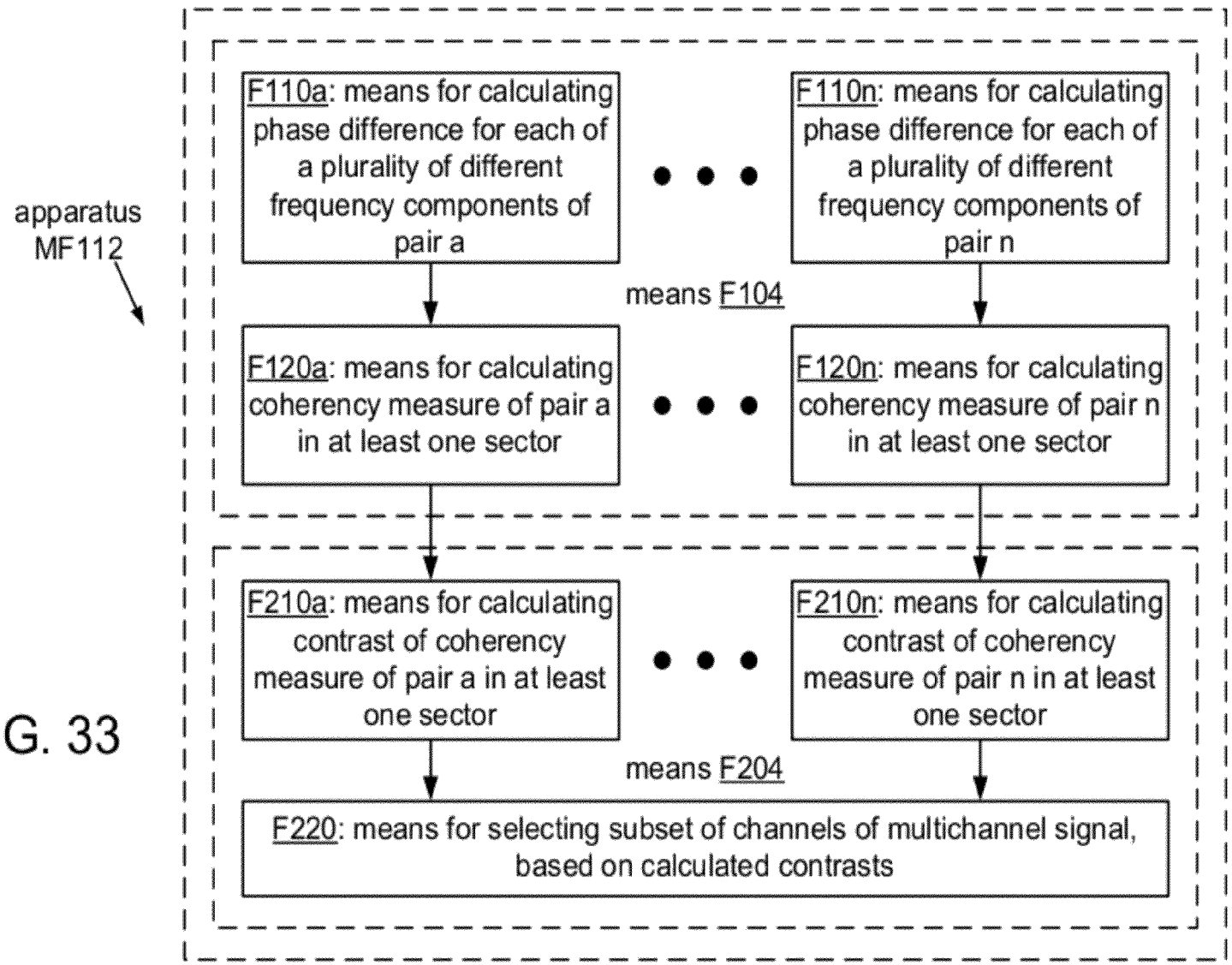
FIG. 33 shows a block diagram of an implementation MF112 of apparatus MF100.

FIG. 33 shows a block diagram of an implementation MF112 of apparatus MF100. Apparatus MF112 includes an implementation F104 of means F100 that includes n instances of means F110 for calculating phase differences for frequency components of a corresponding different pair of channels of the multichannel signal (e.g., by performing an implementation of task T110 as described herein). Means F104 also includes n instances of means F120 for calculating a coherency measure of the corresponding pair in each of at least one spatial sector, based on the corresponding calculated phase differences (e.g., by performing an implementation of task T120 as described herein). Apparatus MF112 also includes an implementation F204 of means F200 that includes n instances of means F210 for calculating a contrast of each coherency measure for the corresponding pair of channels (e.g., by performing an implementation of task T210 as described herein). Means F204 also includes means F220 for selecting a proper subset of the channels of the multichannel signal based on the calculated contrasts (e.g., by performing an implementation of task T220 as described herein).

Figure 34B:
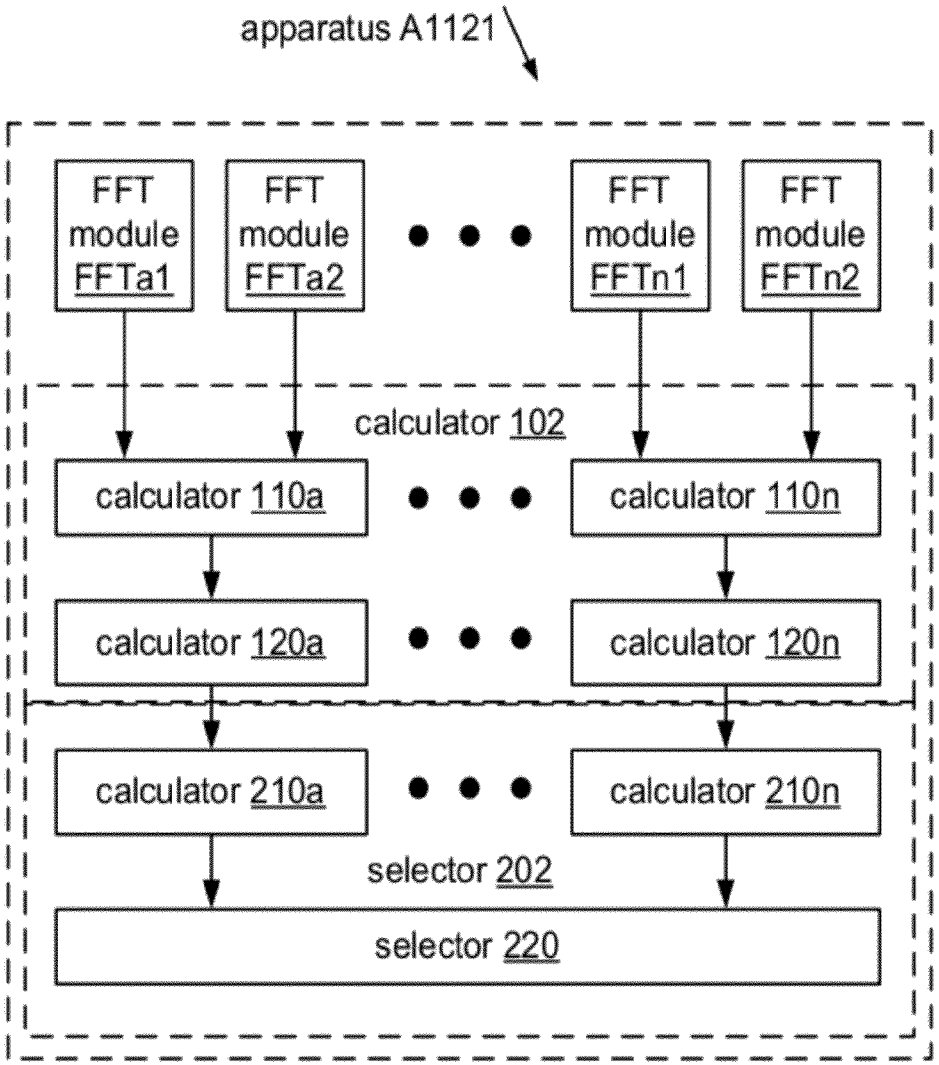
FIG. 34B shows a block diagram of an implementation A1121 of apparatus A112.
Figure 34A:
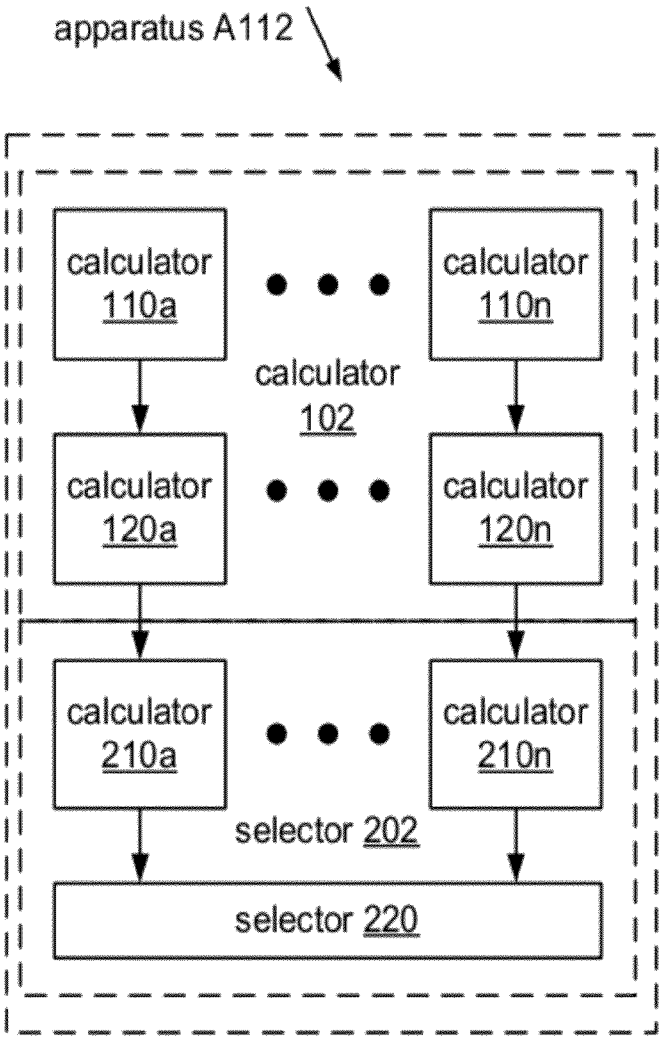
FIG. 34A shows a block diagram of an implementation A112 of apparatus A100.

FIG. 34A shows a block diagram of an implementation A112 of apparatus A100. Apparatus A112 includes an implementation 102 of direction information calculator 100 that has n instances of a calculator 110, each configured to calculate phase differences for frequency components of a corresponding different pair of channels of the multichannel signal (e.g., by performing an implementation of task T110 as described herein). Calculator 102 also includes n instances of a calculator 120, each configured to calculate a coherency measure of the corresponding pair in each of at least one spatial sector, based on the corresponding calculated phase differences (e.g., by performing an implementation of task T120 as described herein). Apparatus A112 also includes an implementation 202 of subset selector 200 that has n instances of a calculator 210, each configured to calculate a contrast of each coherency measure for the corresponding pair of channels (e.g., by performing an implementation of task T210 as described herein). Selector 202 also includes a selector 220 configured to select a proper subset of the channels of the multichannel signal based on the calculated contrasts (e.g., by performing an implementation of task T220 as described herein). FIG. 34B shows a block diagram of an implementation A1121 of apparatus A112 that includes n instances of pairs of FFT modules FFTa1, FFTa2 to FFTn1, FFTn2 that are each configured to perform an FFT operation on a corresponding time-domain microphone channel.

Figure 35:
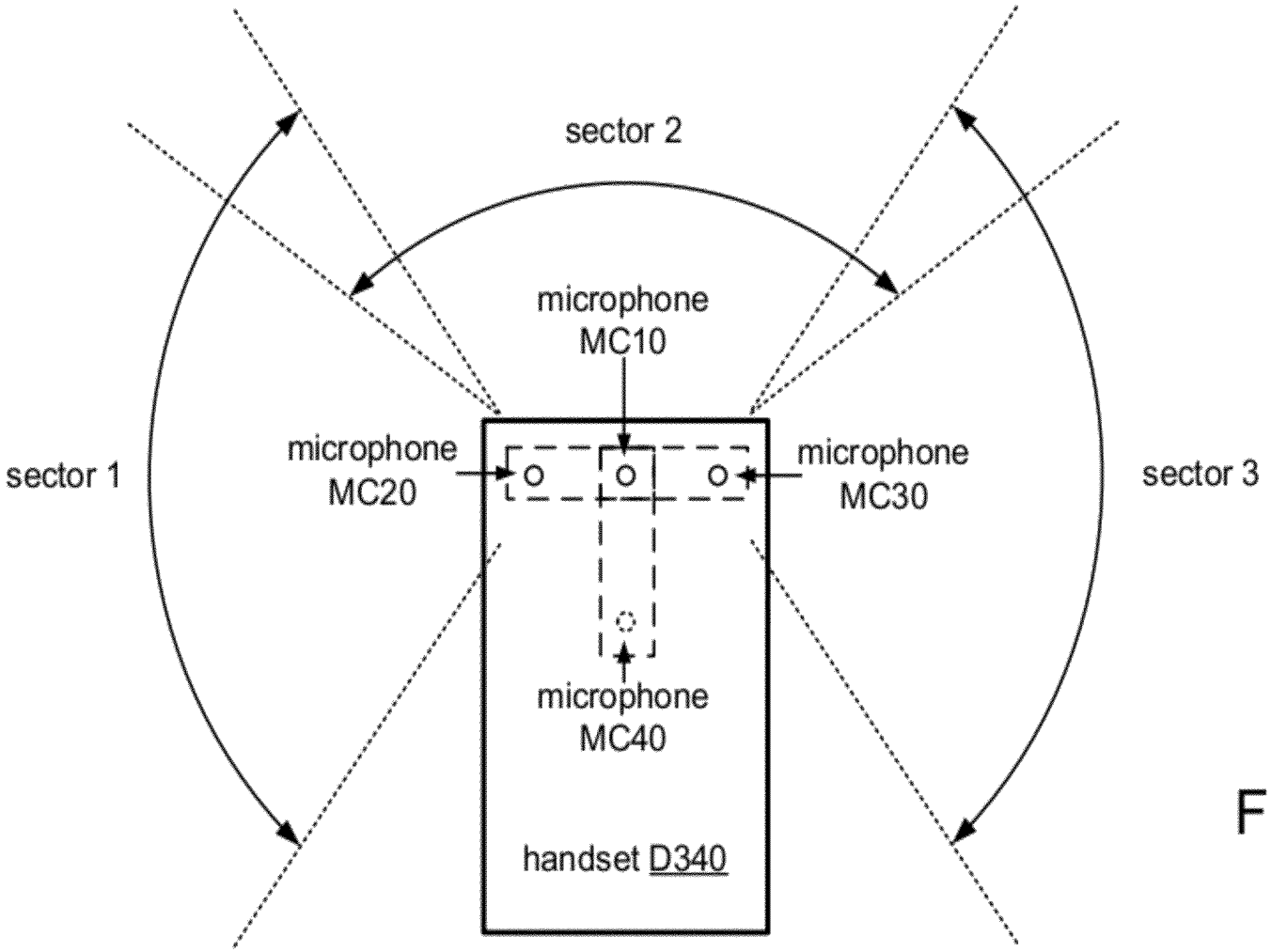
FIG. 35 shows an example of spatial sectors relative to various microphone pairs of handset D340.

FIG. 35 shows an example of an application of task T104 to indicate whether a multichannel signal received via the microphone set MC10, MC20, MC30, MC40 of handset D340 is coherent in any of three overlapping sectors. For sector 1, a first instance of task T120 calculates a first coherency measure based on a plurality of phase differences calculated by a first instance of task T110 from the channels corresponding to microphone pair MC20 and MC10 (alternatively, MC30). For sector 2, a second instance of task T120 calculates a second coherency measure based on a plurality of phase differences calculated by a second instance of task T110 from the channels corresponding to microphone pair MC10 and MC40. For sector 3, a third instance of task T120 calculates a third coherency measure based on a plurality of phase differences calculated by a third instance of task T110 from the channels corresponding to microphone pair MC30 and MC10 (alternatively, MC20). Based on the values of the coherency measures, task T200 selects a pair of channels of the multichannel signal (e.g., selects the pair corresponding to the sector in which the signal is most coherent). As noted above, task T200 may be configured to select the sector in which the signal is most coherent as the sector whose coherency measure is greatest, or to select the sector in which the signal is most coherent as the sector whose coherency measure has the greatest contrast.

Figure 36:
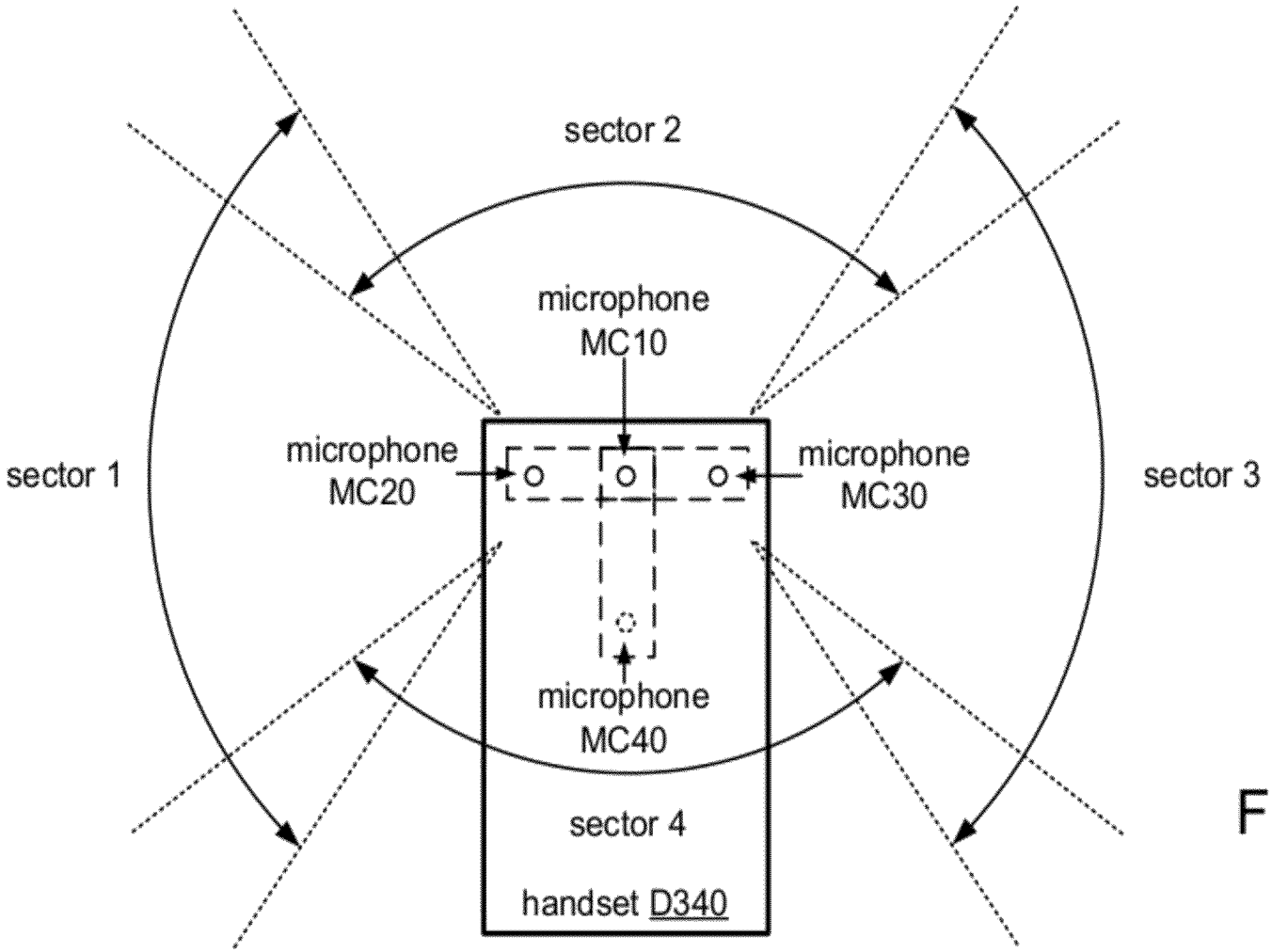
FIG. 36 shows an example of spatial sectors relative to various microphone pairs of handset D340.

FIG. 36 shows a similar example of an application of task T104 to indicate whether a multichannel signal received via the microphone set MC10, MC20, MC30, MC40 of handset D340 is coherent in any of four overlapping sectors and to select a pair of channels accordingly. Such an application may be useful, for example, during operation of the handset in a speakerphone mode.

Figure 37:
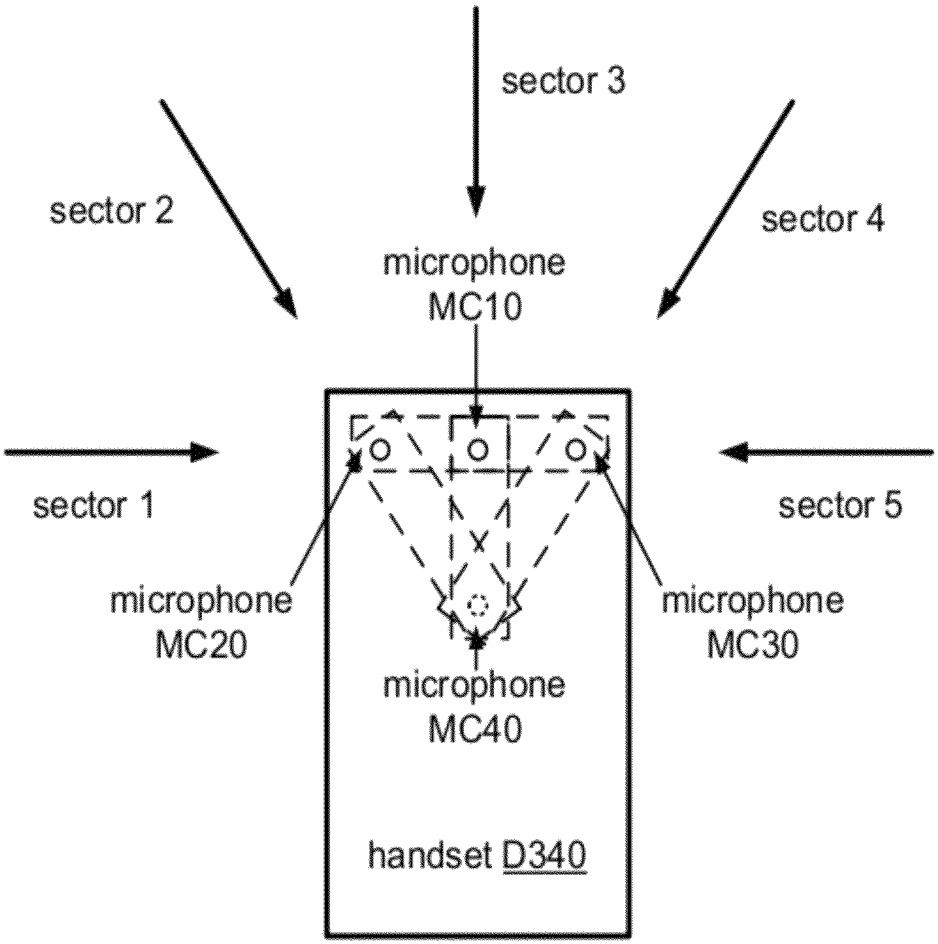
FIG. 37 shows an example of spatial sectors relative to various microphone pairs of handset D340.

FIG. 37 shows an example of a similar application of task T104 to indicate whether a multichannel signal received via the microphone set MC10, MC20, MC30, MC40 of handset D340 is coherent in any of five sectors (which may also be overlapping) in which the middle DOA of each sector is indicated by a corresponding arrow. For sector 1, a first instance of task T120 calculates a first coherency measure based on a plurality of phase differences calculated by a first instance of task T110 from the channels corresponding to microphone pair MC20 and MC10 (alternatively, MC30). For sector 2, a second instance of task T120 calculates a second coherency measure based on a plurality of phase differences calculated by a second instance of task T110 from the channels corresponding to microphone pair MC20 and MC40. For sector 3, a third instance of task T120 calculates a third coherency measure based on a plurality of phase differences calculated by a third instance of task T110 from the channels corresponding to microphone pair MC10 and MC40. For sector 4, a fourth instance of task T120 calculates a fourth coherency measure based on a plurality of phase differences calculated by a fourth instance of task T110 from the channels corresponding to microphone pair MC30 and MC40. For sector 5, a fifth instance of task T120 calculates a fifth coherency measure based on a plurality of phase differences calculated by a fifth instance of task T110 from the channels corresponding to microphone pair MC30 and MC10 (alternatively, MC20). Based on the values of the coherency measures, task T200 selects a pair of channels of the multichannel signal (e.g., selects the pair corresponding to the sector in which the signal is most coherent). As noted above, task T200 may be configured to select the sector in which the signal is most coherent as the sector whose coherency measure is greatest, or to select the sector in which the signal is most coherent as the sector whose coherency measure has the greatest contrast.

Figure 38:
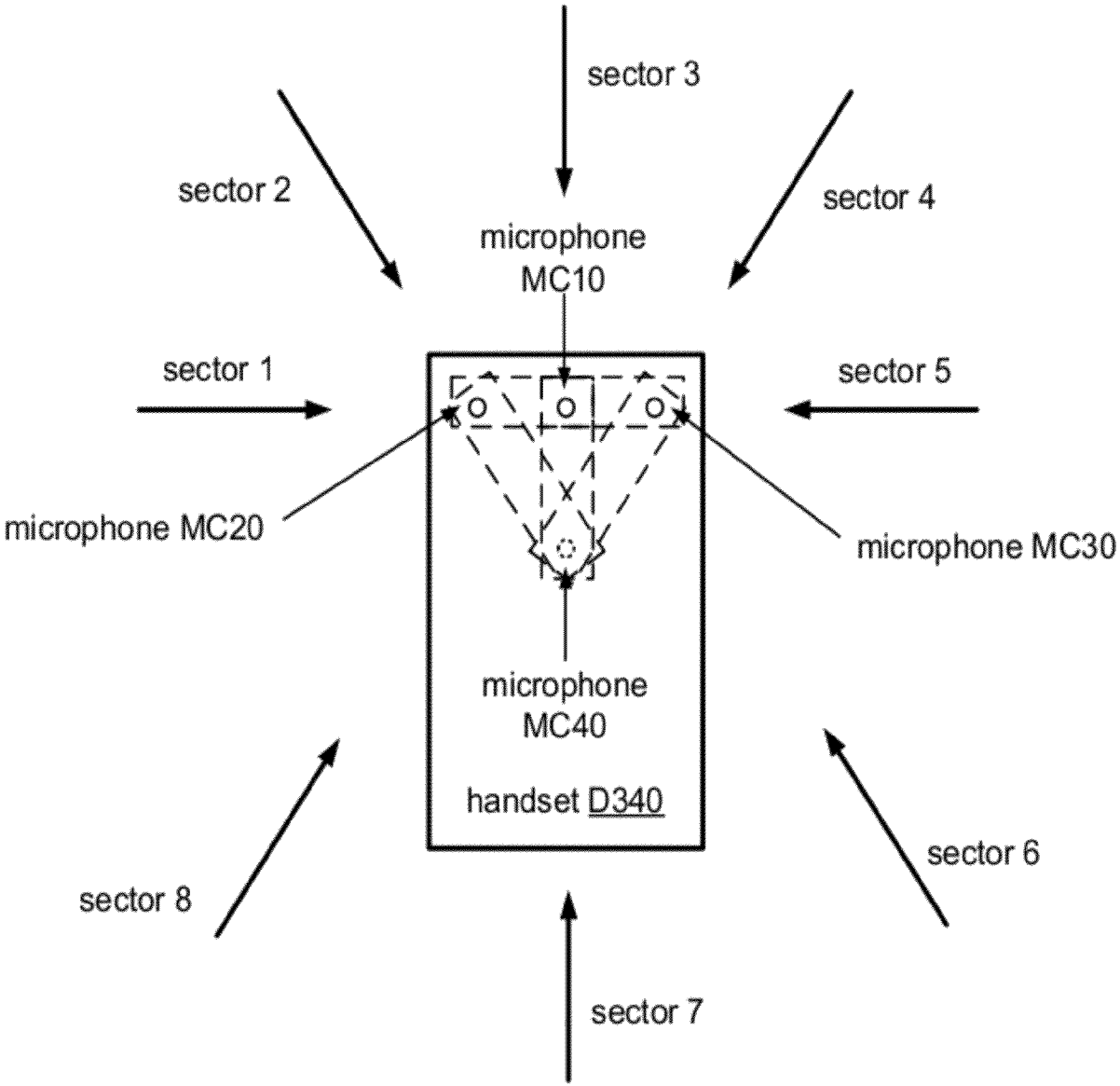
FIG. 38 shows an example of spatial sectors relative to various microphone pairs of handset D340.

FIG. 38 shows a similar example of an application of task T104 to indicate whether a multichannel signal received via the microphone set MC10, MC20, MC30, MC40 of handset D340 is coherent in any of eight sectors (which may also be overlapping) in which the middle DOA of each sector is indicated by a corresponding arrow and to select a pair of channels accordingly. For sector 6, a sixth instance of task T120 calculates a sixth coherency measure based on a plurality of phase differences calculated by a sixth instance of task T110 from the channels corresponding to microphone pair MC40 and MC20. For sector 7, a seventh instance of task T120 calculates a seventh coherency measure based on a plurality of phase differences calculated by a seventh instance of task T110 from the channels corresponding to microphone pair MC40 and MC10. For sector 8, an eighth instance of task T120 calculates an eighth coherency measure based on a plurality of phase differences calculated by an eighth instance of task T110 from the channels corresponding to microphone pair MC40 and MC30. Such an application may be useful, for example, during operation of the handset in a speakerphone mode.

Figure 39:
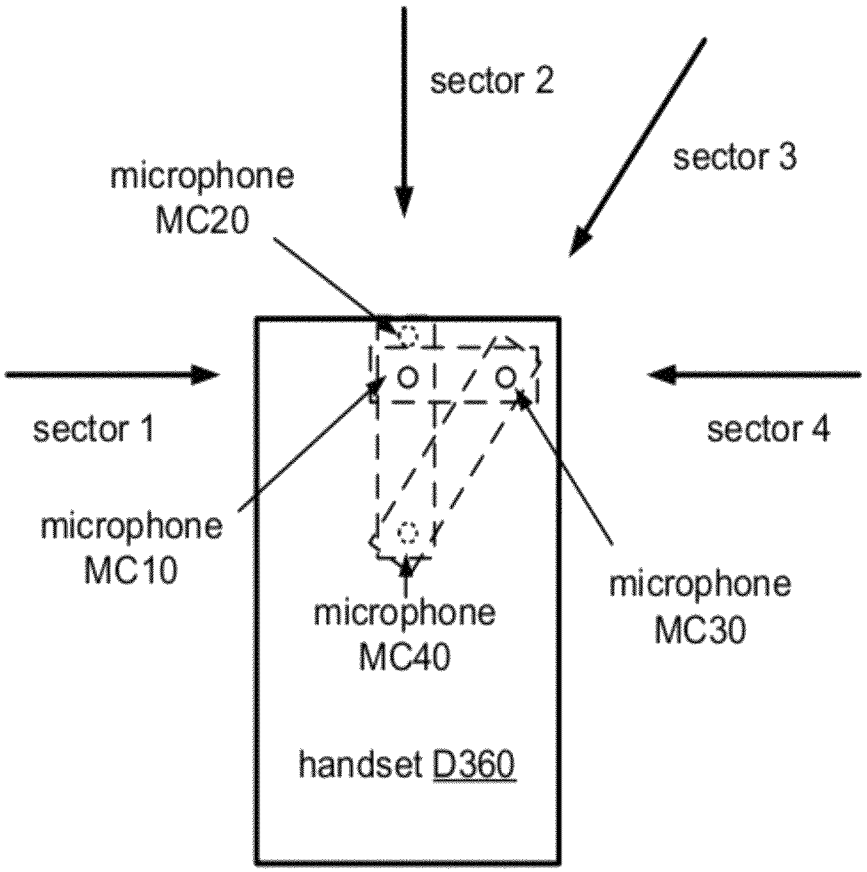
FIG. 39 shows an example of spatial sectors relative to various microphone pairs of handset D360.

FIG. 39 shows an example of a similar application of task T104 to indicate whether a multichannel signal received via the microphone set MC10, MC20, MC30, MC40 of handset D360 is coherent in any of four sectors (which may also be overlapping) in which the middle DOA of each sector is indicated by a corresponding arrow. For sector 1, a first instance of task T120 calculates a first coherency measure based on a plurality of phase differences calculated by a first instance of task T110 from the channels corresponding to microphone pair MC10 and MC30. For sector 2, a second instance of task T120 calculates a second coherency measure based on a plurality of phase differences calculated by a second instance of task T110 from the channels corresponding to microphone pair MC10 and MC40 (alternatively, MC20 and MC40, or MC10 and MC20). For sector 3, a third instance of task T120 calculates a third coherency measure based on a plurality of phase differences calculated by a third instance of task T110 from the channels corresponding to microphone pair MC30 and MC40. For sector 4, a fourth instance of task T120 calculates a fourth coherency measure based on a plurality of phase differences calculated by a fourth instance of task T110 from the channels corresponding to microphone pair MC30 and MC10. Based on the values of the coherency measures, task T200 selects a pair of channels of the multichannel signal (e.g., selects the pair corresponding to the sector in which the signal is most coherent). As noted above, task T200 may be configured to select the sector in which the signal is most coherent as the sector whose coherency measure is greatest, or to select the sector in which the signal is most coherent as the sector whose coherency measure has the greatest contrast.

Figure 40:
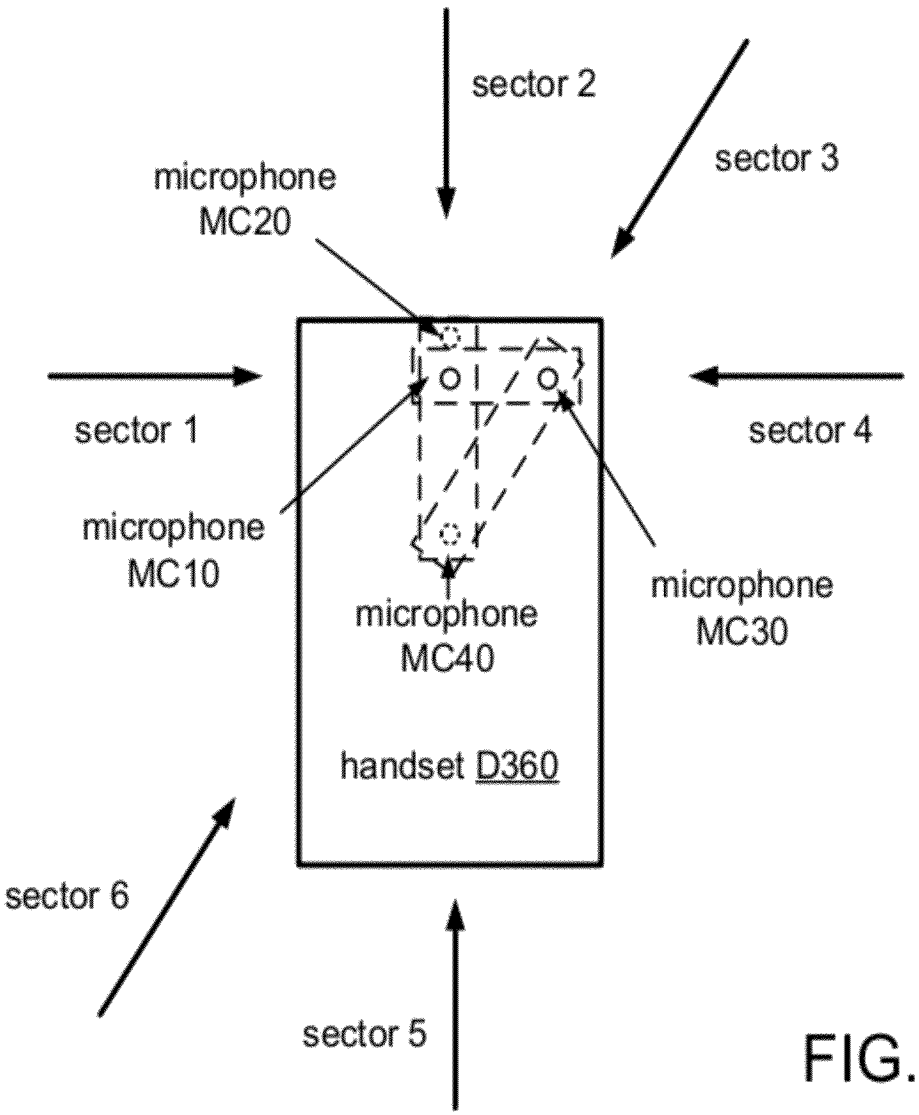
FIG. 40 shows an example of spatial sectors relative to various microphone pairs of handset D360.

FIG. 40 shows a similar example of an application of task T104 to indicate whether a multichannel signal received via the microphone set MC10, MC20, MC30, MC40 of handset D360 is coherent in any of six sectors (which may also be overlapping) in which the middle DOA of each sector is indicated by a corresponding arrow and to select a pair of channels accordingly. For sector 5, a fifth instance of task T120 calculates a fifth coherency measure based on a plurality of phase differences calculated by a fifth instance of task T110 from the channels corresponding to microphone pair MC40 and MC10 (alternatively, MC20). For sector 6, a sixth instance of task T120 calculates a sixth coherency measure based on a plurality of phase differences calculated by a sixth instance of task T110 from the channels corresponding to microphone pair MC40 and MC30. Such an application may be useful, for example, during operation of the handset in a speakerphone mode.

Figure 41:
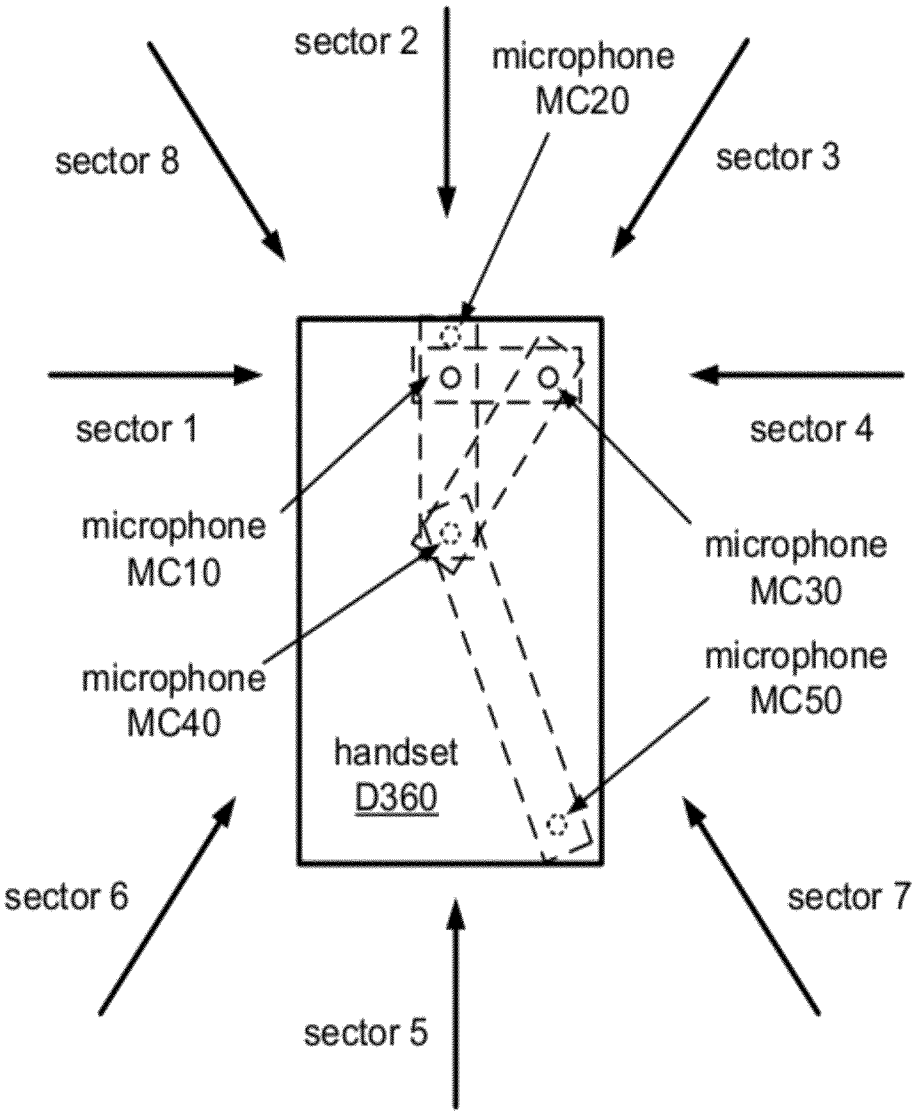
FIG. 41 shows an example of spatial sectors relative to various microphone pairs of handset D360.

FIG. 41 shows a similar example of an application of task T104 that also makes use of microphone MC50 of handset D360 to indicate whether a received multichannel signal is coherent in any of eight sectors (which may also be overlapping) in which the middle DOA of each sector is indicated by a corresponding arrow and to select a pair of channels accordingly. For sector 7, a seventh instance of task T120 calculates a seventh coherency measure based on a plurality of phase differences calculated by a seventh instance of task T110 from the channels corresponding to microphone pair MC50 and MC40 (alternatively, MC10 or MC20). For sector 8, an eighth instance of task T120 calculates an eighth coherency measure based on a plurality of phase differences calculated by an eighth instance of task T110 from the channels corresponding to microphone pair MC40 (alternatively, MC10 or MC20) and MC50. In this case, the coherency measure for sector 2 may be calculated from the channels corresponding to microphone pair MC30 and MC50 instead, and the coherency measure for sector 2 may be calculated instead from the channels corresponding to microphone pair MC50 and MC30 instead. Such an application may be useful, for example, during operation of the handset in a speakerphone mode.

As noted above, different pairs of channels of the multichannel signal may be based on signals produced by microphone pairs on different devices. In this case, the various pairs of microphones may be movable relative to one another over time. Communication of the channel pair from one such device to the other (e.g., to the device that performs the switching strategy) may occur over a wired and/or wireless transmission channel. Examples of wireless methods that may be used to support such a communications link include low-power radio specifications for short-range communications (e.g., from a few inches to a few feet) such as Bluetooth (e.g., a Headset or other Profile as described in the Bluetooth Core Specification version 4.0 [which includes Classic Bluetooth, Bluetooth high speed, and Bluetooth low energy protocols], Bluetooth SIG, Inc., Kirkland, Wash.), Peanut (QUALCOMM Incorporated, San Diego, Calif.), and ZigBee (e.g., as described in the ZigBee 2007 Specification and/or the ZigBee RF4CE Specification, ZigBee Alliance, San Ramon, Calif.). Other wireless transmission channels that may be used include non-radio channels such as infrared and ultrasonic.

It is also possible for the two channels of a pair to be based on signals produced by microphone pairs on different devices (e.g., such that the microphones of a pair are movable relative to one another over time). Communication of a channel from one such device to the other (e.g., to the device that performs the switching strategy) may occur over a wired and/or wireless transmission channel as described above. In such case, it may be desirable to process the remote channel (or channels, for a case in which both channels are received wirelessly by the device that performs the switching strategy) to compensate for transmission delay and/or sampling clock mismatch.

A transmission delay may occur as a consequence of a wireless communication protocol (e.g., Bluetooth™). The delay value required for delay compensation typically known for a given headset. If the delay value is unknown, a nominal value may be used for delay compensation, and inaccuracy may be taken care of in a further processing stage.

It may also be desirable to compensate for data rate differences between the two microphone signals (e.g., via sampling rate compensation). In general, the devices may be controlled by two independent clock sources, and the clock rates can slightly drift with respect to each other over time. If the clock rates are different, the number of samples delivered per frame for the two microphone signals can be different. This is typically known as a sample slipping problem and a variety of approaches that are known to those skilled in the art can be used for handling this problem. In the event of sample slipping, method M100 may include a task that compensates for the data rate difference between the two microphone signals, and an apparatus configured to perform method M100 may include means for such compensating (e.g., a sampling rate compensation module).

In such case, it may be desirable to match the sampling rates of the pair of channels before task T100 is performed. For example, one way is to add/remove samples from one stream to match the samples/frame in the other stream. Another way is to do fine sampling rate adjustment of one stream to match the other. In one example, both channels have a nominal sampling rate of 8 kHz, but the actual sampling rate of one channel is 7985 Hz. In this case, it may be desirable to up-sample audio samples from this channel to 8000 Hz. In another example, one channel has a sampling rate of 8023 Hz, and it may be desirable to down-sample its audio samples to 8 kHz.

As described above, method M100 may be configured to select the channels corresponding to a particular endfire microphone pair according to DOA information that is based on phase differences between channels at different frequencies. Alternatively or additionally, method M100 may be configured to select the channels corresponding to a particular endfire microphone pair according to DOA information that is based on gain differences between channels. Examples of gain-difference-based techniques for directional processing of a multichannel signal include (without limitation) beamforming, blind source separation (BSS), and steered response power-phase transform (SRP-PHAT). Examples of beamforming approaches include generalized sidelobe cancellation (GSC), minimum variance distortionless response (MVDR), and linearly constrained minimum variance (LCMV) beamformers. Examples of BSS approaches include independent component analysis (ICA) and independent vector analysis (IVA).

Phase-difference-based directional processing techniques typically produce good results when the sound source or sources are close to the microphones (e.g., within one meter), but their performance may fall off at greater source-microphone distances. Method M110 may be implemented to select a subset using phase-difference-based processing as described above at some times, and using gain-difference-based processing at other times, depending on an estimated range of the source (i.e., an estimated distance between source and microphone). In such case, a relation between the levels of the channels of a pair (e.g., a log-domain difference or linear-domain ratio between the energies of the channels) may be used as an indicator of source range. It may also be desirable to tune directional-coherence and/or gain-difference thresholds (e.g., based on factors such as far-field directional- and/or distributed-noise suppression needs).

Such an implementation of method M110 may be configured to select a subset of channels by combining directional indications from phase-difference-based and gain-difference-based processing techniques. For example, such an implementation may be configured to weight the directional indication of a phase-difference-based technique more heavily when the estimated range is small and to weight the directional indication of a gain-difference-based technique more heavily when the estimated range is large. Alternatively, such an implementation may be configured to select the subset of channels based on the directional indication of a phase-difference-based technique when the estimated range is small and to select the subset of channels based on the directional indication of a gain-difference-based technique instead when the estimated range is large.

Some portable audio sensing devices (e.g., wireless headsets) are capable of offering range information (e.g., through a communication protocol, such as Bluetooth™). Such range information may indicate how far a headset is located from a device (e.g., a phone) it is currently communicating with, for example. Such information regarding inter-microphone distance may be used in method M100 for phase-difference calculation and/or for deciding what type of direction estimate technique to use. For example, beamforming methods typically work well when the primary and secondary microphones are located closer to each other (distance<8 cm), BSS algorithms typically work well in the mid-range (6 cm<distance<15 cm), and the spatial diversity approaches typically work well when the microphones are spaced far apart (distance>15 cm).

Figure 42:
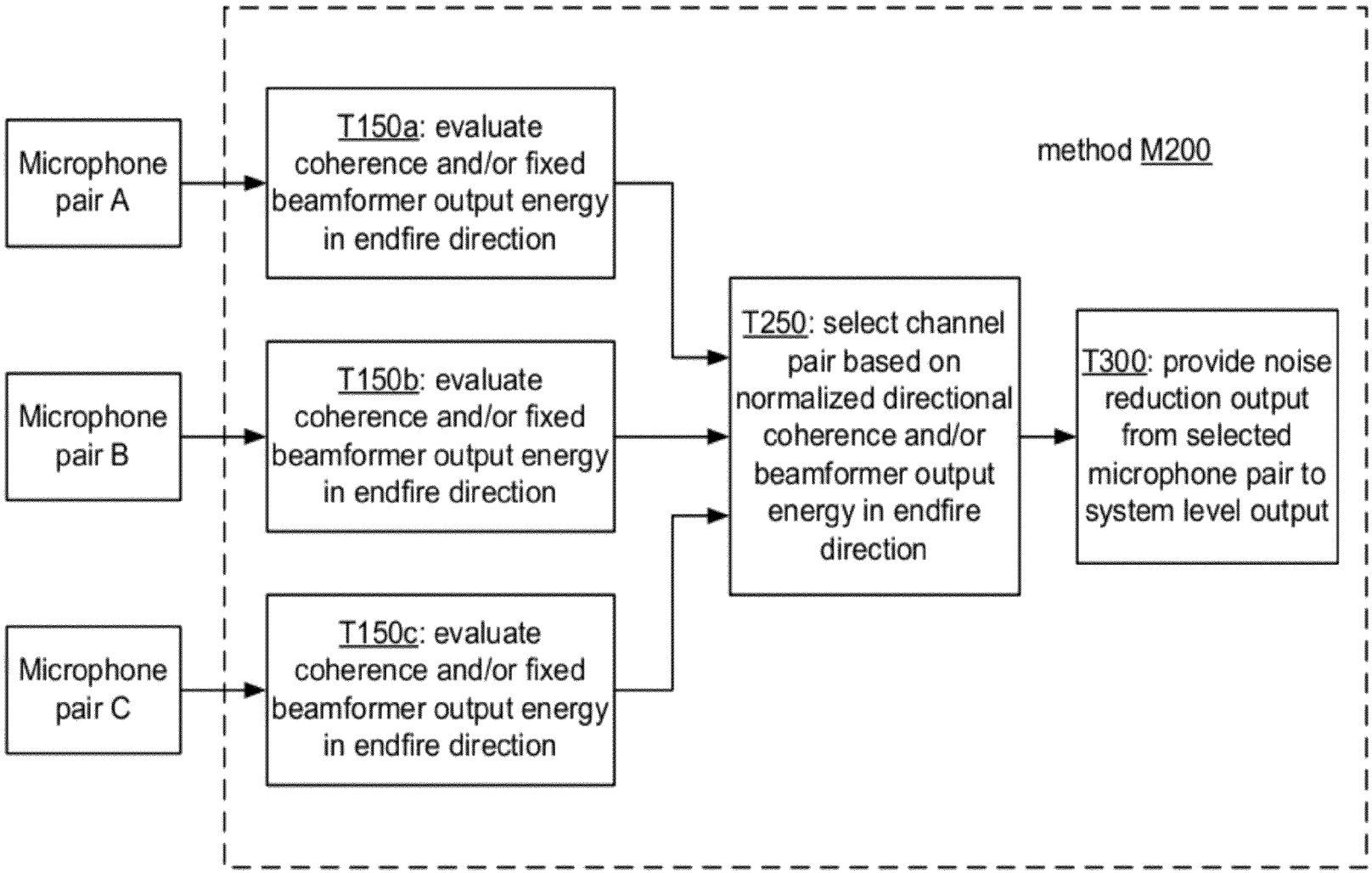
FIG. 42 shows a flowchart of an implementation M200 of method M100.

FIG. 42 shows a flowchart of an implementation M200 of method M100. Method M200 includes multiple instances T150A-T150C of an implementation of task T100, each of which evaluates a directional coherence or a fixed beamformer output energy of a stereo signal from a corresponding microphone pair in an endfire direction. For example, task T150 may be configured to perform directional-coherence-based processing at some times, and to use beamformer-based processing at other times, depending on an estimated distance from source to microphone. An implementation T250 of task T200 selects the signal from the microphone pair that has the largest normalized directional coherence (i.e., the coherency measure having the greatest contrast) or beamformer output energy, and task T300 provides a noise reduction output from the selected signal to a system-level output.

An implementation of method M100 (or an apparatus performing such a method) may also include performing one or more spatially selective processing operations on the selected subset of channels. For example, method M100 may be implemented to include producing a masked signal based on the selected subset by attenuating frequency components that arrive from directions different from the DOA of the directionally coherent portion of the selected subset (e.g., directions outside the corresponding sector). Alternatively, method M100 may be configured to calculate an estimate of a noise component of the selected subset that includes frequency components that arrive from directions different from the DOA of the directionally coherent portion of the selected subset. Alternatively or additionally, one or more nonselected sectors (possibly even one or more nonselected subsets) may be used to produce a noise estimate. For case in which a noise estimate is calculated, method M100 may also be configured to use the noise estimate to perform a noise reduction operation on one or more channels of the selected subset (e.g., Wiener filtering or spectral subtraction of the noise estimate from one or more channels of the selected subset).

Task T200 may also be configured to select a corresponding threshold for the coherency measure in the selected sector. The coherency measure (and possibly such a threshold) may be used to support a voice activity detection (VAD) operation, for example. A gain difference between channels may be used for proximity detection, which may also be used to support a VAD operation. A VAD operation may be used for training adaptive filters and/or for classifying segments in time (e.g., frames) of the signal as (far-field) noise or (near-field) voice to support a noise reduction operation. For example, a noise estimate as described above (e.g., a single-channel noise estimate, based on frames of the primary channel, or a dual-channel noise estimate) may be updated using frames that are classified as noise based on the corresponding coherency measure value. Such a scheme may be implemented to support consistent noise reduction without attenuation of desired speech across a wide range of possible source-to-microphone-pair orientations.

It may be desirable to use such a method or apparatus with a timing mechanism such that the method or apparatus is configured to switch to a single-channel noise estimate (e.g., a time-averaged single-channel noise estimate) if, for example, the greatest coherency measure among the sectors (alternatively, the greatest contrast among the coherency measures) has been too low for some time.

Figure 43A:
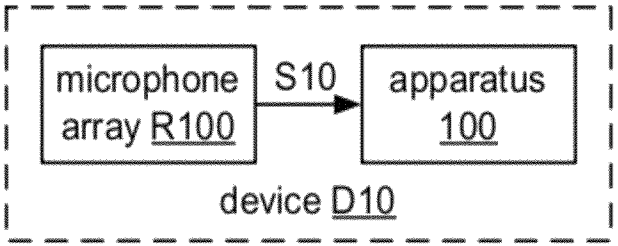
FIG. 43A shows a block diagram of a device D10 according to a general configuration.

FIG. 43A shows a block diagram of a device D10 according to a general configuration. Device D10 includes an instance of any of the implementations of microphone array R100 disclosed herein, and any of the audio sensing devices disclosed herein may be implemented as an instance of device D10. Device D10 also includes an instance of an implementation of apparatus 100 that is configured to process a multichannel signal, as produced by array R100, to select a proper subset of channels of the multichannel signal (e.g., according to an instance of any of the implementations of method M100 disclosed herein). Apparatus 100 may be implemented in hardware and/or in a combination of hardware with software and/or firmware. For example, apparatus 100 may be implemented on a processor of device D10 that is also configured to perform a spatial processing operation as described above on the selected subset (e.g., one or more operations that determine the distance between the audio sensing device and a particular sound source, reduce noise, enhance signal components that arrive from a particular direction, and/or separate one or more sound components from other environmental sounds).

Figure 43B:
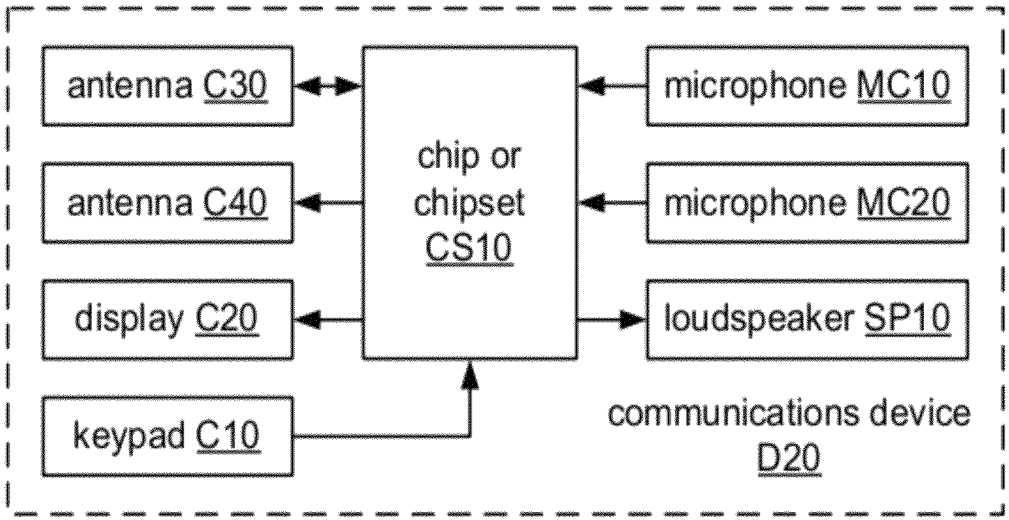
FIG. 43B shows a block diagram of a communications device D20.

FIG. 43B shows a block diagram of a communications device D20 that is an implementation of device D10. Any of the portable audio sensing devices described herein may be implemented as an instance of device D20, which includes a chip or chipset CS10 (e.g., a mobile station modem (MSM) chipset) that includes apparatus 100. Chip/chipset CS10 may include one or more processors, which may be configured to execute a software and/or firmware part of apparatus 100 (e.g., as instructions). Chip/chipset CS10 may also include processing elements of array R100 (e.g., elements of audio preprocessing stage AP10). Chip/chipset CS10 includes a receiver, which is configured to receive a radio-frequency (RF) communications signal and to decode and reproduce an audio signal encoded within the RF signal, and a transmitter, which is configured to encode an audio signal that is based on a processed signal produced by apparatus A10 and to transmit an RF communications signal that describes the encoded audio signal. For example, one or more processors of chip/chipset CS10 may be configured to perform a noise reduction operation as described above on one or more channels of the multichannel signal such that the encoded audio signal is based on the noise-reduced signal.

Device D20 is configured to receive and transmit the RF communications signals via an antenna C30. Device D20 may also include a diplexer and one or more power amplifiers in the path to antenna C30. Chip/chipset CS10 is also configured to receive user input via keypad C10 and to display information via display C20. In this example, device D20 also includes one or more antennas C40 to support Global Positioning System (GPS) location services and/or short-range communications with an external device such as a wireless (e.g., Bluetooth™) headset. In another example, such a communications device is itself a Bluetooth headset and lacks keypad C10, display C20, and antenna C30.

The methods and apparatus disclosed herein may be applied generally in any transceiving and/or audio sensing application, especially mobile or otherwise portable instances of such applications. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as applications for voice communications at sampling rates higher than eight kilohertz (e.g., 12, 16, or 44 kHz).

Goals of a multi-microphone processing system as described herein may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing (e.g., masking and/or noise reduction) for more aggressive noise reduction.

The various elements of an implementation of an apparatus as disclosed herein (e.g., apparatus A100, A112, A1121, MF100, and MF112) may be embodied in any hardware structure, or any combination of hardware with software and/or firmware, that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

One or more elements of the various implementations of the apparatus disclosed herein (e.g., apparatus A100, A112, A1121, MF100, and MF112) may also be implemented in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of selecting a subset of channels of a multichannel signal, such as a task relating to another operation of a device or system in which the processor is embedded (e.g., an audio sensing device). It is also possible for part of a method as disclosed herein to be performed by a processor of the audio sensing device (e.g., task T100) and for another part of the method to be performed under the control of one or more other processors (e.g., task T200).

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., methods M100, M110, M112, and M200) may be performed by an array of logic elements such as a processor, and that the various elements of an apparatus as described herein may be implemented in part as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in tangible, computer-readable features of one or more computer-readable storage media as listed herein) as one or more sets of instructions executable by a machine including an array of logic elements (e.g., a processor, microprocessor, microcontroller, or other finite state machine). The term "computer-readable medium" may include any medium that can store or transfer information, including volatile, nonvolatile, removable, and non-removable storage media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media, such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device (e.g., a handset, headset, or portable digital assistant (PDA)), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times). For example, one or more (possibly all) of calculators 110*a*-110*n* may be implemented to use the same structure (e.g., the same set of instructions defining a phase difference calculation operation) at different times.

What is claimed is:

1. A method of processing a multichannel signal, the method being implemented by an audio sensing device, said method comprising:

for each of a plurality of different frequency components of the multichannel signal, calculating a difference between a phase of the frequency component at a first time in each of a first pair of channels of the multichannel signal, to obtain a first plurality of phase differences;

based on information from the first plurality of phase differences, calculating a value of a first coherency measure that indicates a degree to which directions of arrival of at least the plurality of different frequency components of the first pair of channels of the multichannel signal at the first time are coherent in a first spatial sector;

for each of the plurality of different frequency components of the multichannel signal, calculating a difference between a phase of the frequency component at a second time in each of a second pair of channels of the multichannel signal, said second pair of channels of the multichannel signal being different than said first pair of channels of the multichannel signal, to obtain a second plurality of phase differences;

based on information from the second plurality of phase differences, calculating a value of a second coherency measure that indicates a degree to which directions of arrival of at least the plurality of different frequency components of the second pair of channels of the multichannel signal at the second time are coherent in a second spatial sector;

calculating a contrast of the first coherency measure by evaluating a relation between the calculated value of the first coherency measure and an average value of the first coherency measure over time;

calculating a contrast of the second coherency measure by evaluating a relation between the calculated value of the second coherency measure and an average value of the second coherency measure over time; and based on which is greatest between the contrast of the first coherency measure and the contrast of the second coherency measure, selecting one between the first and second pairs of channels of the multichannel signal, wherein said multichannel signal is received via a microphone array.

2. The method according to claim 1, wherein said selecting one between the first and second pairs of channels is based on (A) a relation between an energy of each channel of the first pair of channels and on (B) a relation between an energy of each channel of the second pair of channels.

3. The method according to claim 1, wherein said method comprises, in response to said selecting one between the first and second pairs of channels, calculating an estimate of a noise component of the selected pair.

4. The method according to claim 1, wherein said method comprises, for at least one frequency component of at least one channel of the selected pair, attenuating the frequency component, based on the calculated phase difference of the frequency component.

5. The method according to claim 1, wherein said method comprises estimating a range of a signal source, and wherein said selecting one between the first and second pairs of channels is based on said estimated range.

6. The method according to claim 1, wherein each of said first pair of channels is based on a signal produced by a corresponding one of a first pair of microphones of said microphone array, and wherein each of said second pair of channels is based on a signal produced by a corresponding one of a second pair of microphones of said microphone array.

7. The method according to claim 6, wherein the first spatial sector includes an endfire direction of the first pair of microphones and the second spatial sector includes an endfire direction of the second pair of microphones.

8. The method according to claim 6, wherein the first spatial sector excludes a broadside direction of the first pair of microphones and the second spatial sector excludes a broadside direction of the second pair of microphones.

9. The method according to claim 6, wherein the first pair of microphones includes one microphone of the second pair of microphones.

10. The method according to claim 6, wherein a position of each microphone of the first pair of microphones is fixed relative to a position of the other microphone of the first pair of microphones, and wherein at least one microphone of the second pair of microphones is movable relative to the first pair of microphones.

11. The method according to claim 6, wherein said method comprises receiving at least one channel of the second pair of channels via a wireless transmission channel.

12. The method according to claim 6, wherein said selecting one between the first and second pairs of channels is based on (A) a relation between (A) an energy of the first pair of channels in a beam that includes one endfire direction of the first pair of microphones and excludes the other endfire direction of the first pair of microphones and (B) an energy of the second pair of channels in a beam that includes one endfire direction of the second pair of microphones and excludes the other endfire direction of the second pair of microphones.

13. The method according to claim 6, wherein said method comprises:

estimating a range of a signal source; and at a third time subsequent to the first and second times, and based on said estimated range, selecting another between the first and second pairs of channels based on (A) a relation between (A) an energy of the first pair of channels in a beam that includes one endfire direction of the first pair of microphones and excludes the other endfire direction of the first pair of microphones and (B) an energy of the second pair of channels in a beam that includes one endfire direction of the second pair of microphones and excludes the other endfire direction of the second pair of microphones.

14. The method according to claim 6, wherein, for each microphone of said first pair of microphones, said signal produced by the microphone is produced by the microphone in response to an acoustic environment of the microphone, and wherein, for each microphone of said second pair of microphones, said signal produced by the microphone is produced by the microphone in response to an acoustic environment of the microphone.

15. A non-transitory computer-readable storage medium having tangible features that cause a machine reading the features to perform a method according to claim 1.

16. An apparatus for processing a multichannel signal, said apparatus comprising:

means for calculating, for each of a plurality of different frequency components of the multichannel signal, a difference between a phase of the frequency component at a first time in each of a first pair of channels of the multichannel signal, to obtain a first plurality of phase differences;

means for calculating a value of a first coherency measure, based on information from the first plurality of phase differences, that indicates a degree to which directions of arrival of at least the plurality of different frequency components of the first pair of channels of the multichannel signal at the first time are coherent in a first spatial sector;

means for calculating, for each of the plurality of different frequency components of the multichannel signal, a difference between a phase of the frequency component at a second time in each of a second pair of channels of the multichannel signal, said second pair of channels of the multichannel signal being different than said first pair of channels of the multichannel signal, to obtain a second plurality of phase differences;

means for calculating a value of a second coherency measure, based on information from the second plurality of phase differences, that indicates a degree to which directions of arrival of at least the plurality of different frequency components of the second pair of channels of the multichannel signal at the second time are coherent in a second spatial sector;

means for calculating a contrast of the first coherency measure by evaluating a relation between the calculated value of the first coherency measure and an average value of the first coherency measure over time;

means for calculating a contrast of the second coherency measure by evaluating a relation between the calculated value of the second coherency measure and an average value of the second coherency measure over time; and means for selecting one between the first and second pairs of channels of the multichannel signal, based on which is greatest between the contrast of the first coherency measure and the contrast of the second coherency measure, wherein at least one among said means for calculating a difference at a first time, said means for calculating a value of a first coherency measure, said means for calculating a difference at a second time, said means for calculating a value of a second coherency measure, said means for calculating a contrast of the first coherency measure, said means for calculating a contrast of the second coherency measure, and said means for selecting is implemented by at least one processor, and wherein said multichannel signal is received via a microphone array.

17. The apparatus according to claim 16, wherein said means for selecting one between the first and second pairs of channels is configured to select said one between the first and second pairs of channels based on (A) a relation between an energy of each channel of the first pair of channels and on (B) a relation between an energy of each channel of the second pair of channels.

18. The apparatus according to claim 16, wherein said apparatus comprises means for calculating, in response to said selecting one between the first and second pairs of channels, an estimate of a noise component of the selected pair.

19. The apparatus according to claim 16, wherein each of said first pair of channels is based on a signal produced by a corresponding one of a first pair of microphones of said microphone array, and wherein each of said second pair of channels is based on a signal produced by a corresponding one of a second pair of microphones of said microphone array.

20. The apparatus according to claim 19, wherein the first spatial sector includes an endfire direction of the first pair of microphones and the second spatial sector includes an endfire direction of the second pair of microphones.

21. The apparatus according to claim 19, wherein the first spatial sector excludes a broadside direction of the first pair of microphones and the second spatial sector excludes a broadside direction of the second pair of microphones.

22. The apparatus according to claim 19, wherein the first pair of microphones includes one microphone of the second pair of microphones.

23. The apparatus according to claim 19, wherein a position of each microphone of the first pair of microphones is fixed relative to a position of the other microphone of the first pair of microphones, and wherein at least one microphone of the second pair of microphones is movable relative to the first pair of microphones.

24. The apparatus according to claim 19, wherein said apparatus comprises means for receiving at least one channel of the second pair of channels via a wireless transmission channel.

25. The apparatus according to claim 19, wherein said means for selecting one between the first and second pairs of channels is configured to select said one between the first and second pairs of channels based on (A) a relation between (A) an energy of the first pair of channels in a beam that includes one endfire direction of the first pair of microphones and excludes the other endfire direction of the first pair of microphones and (B) an energy of the second pair of channels in a beam that includes one endfire direction of the second pair of microphones and excludes the other endfire direction of the second pair of microphones.

26. An apparatus for processing a multichannel signal, said apparatus comprising:

a first calculator configured to calculate, for each of a plurality of different frequency components of the multichannel signal, a difference between a phase of the frequency component at a first time in each of a first pair of channels of the multichannel signal, to obtain a first plurality of phase differences;

a second calculator configured to calculate a value of a first coherency measure, based on information from the first plurality of phase differences, that indicates a degree to which directions of arrival of at least the plurality of different frequency components of the first pair of channels of the multichannel signal at the first time are coherent in a first spatial sector;

a third calculator configured to calculate, for each of the plurality of different frequency components of the multichannel signal, a difference between a phase of the frequency component at a second time in each of a second pair of channels of the multichannel signal, said second pair of channels of the multichannel signal being different than said first pair of channels of the multichannel signal, to obtain a second plurality of phase differences;

a fourth calculator configured to calculate a value of a second coherency measure, based on information from the second plurality of phase differences, that indicates a degree to which directions of arrival of at least the plurality of different frequency components of the second pair of channels of the multichannel signal at the second time are coherent in a second spatial sector;

a fifth calculator configured to calculate a contrast of the first coherency measure by evaluating a relation between the calculated value of the first coherency measure and an average value of the first coherency measure over time;

a sixth calculator configured to calculate a contrast of the second coherency measure by evaluating a relation between the calculated value of the second coherency measure and an average value of the second coherency measure over time; and a selector configured to select one between the first and second pairs of channels, based on which is greatest between the contrast of the first coherency measure and the contrast of the second coherency measure, wherein at least one among said first calculator, said second calculator, said third calculator, said fourth calculator, said fifth calculator, said sixth calculator, and said selector is implemented by at least one processor, and wherein said multichannel signal is received via a microphone array.

27. The apparatus according to claim 26, wherein said selector is configured to select said one between the first and second pairs of channels based on (A) a relation between an energy of each channel of the first pair of channels and on (B) a relation between an energy of each channel of the second pair of channels.

28. The apparatus according to claim 26, wherein said apparatus comprises a seventh calculator configured to calculate, in response to said selecting one between the first and second pairs of channels, an estimate of a noise component of the selected pair.

29. The apparatus according to claim 26, wherein each of said first pair of channels is based on a signal produced by a corresponding one of a first pair of microphones of said microphone array, and wherein each of said second pair of channels is based on a signal produced by a corresponding one of a second pair of microphones of said microphone array.

30. The apparatus according to claim 26, wherein the first spatial sector includes an endfire direction of the first pair of microphones and the second spatial sector includes an endfire direction of the second pair of microphones.

31. The apparatus according to claim 29, wherein the first spatial sector excludes a broadside direction of the first pair of microphones and the second spatial sector excludes a broadside direction of the second pair of microphones.

32. The apparatus according to claim 29, wherein the first pair of microphones includes one microphone of the second pair of microphones.

33. The apparatus according to claim 29, wherein a position of each microphone of the first pair of microphones is fixed relative to a position of the other microphone of the first pair of microphones, and wherein at least one microphone of the second pair of microphones is movable relative to the first pair of microphones.

34. The apparatus according to claim 29, wherein said apparatus comprises a receiver configured to receive at least one channel of the second pair of channels via a wireless transmission channel.

35. The apparatus according to claim 29, wherein said selector is configured to select said one between the first and second pairs of channels based on (A) a relation between (A) an energy of the first pair of channels in a beam that includes one endfire direction of the first pair of microphones and excludes the other endfire direction of the first pair of microphones and (B) an energy of the second pair of channels in a beam that includes one endfire direction of the second pair of microphones and excludes the other endfire direction of the second pair of microphones.

36. A method of processing a multichannel signal, the method being implemented by an audio sensing device, said method comprising:

for a first pair of channels of the multichannel signal, calculating a value of a first coherency measure that indicates a degree to which directions of arrival of different frequency components of the first pair of channels of the multichannel signal are coherent;

for a second pair of channels of the multichannel signal that is different than said first pair of channels of the multichannel signal, calculating a value of a second coherency measure that indicates a degree to which directions of arrival of different frequency components of the second pair of channels of the multichannel signal are coherent;

calculating a contrast of the first coherency measure by evaluating a relation between the calculated value of the first coherency measure and an average value of the first coherency measure over time;

calculating a contrast of the second coherency measure by evaluating a relation between the calculated value of the second coherency measure and an average value of the second coherency measure over time; and based on which is greatest between the contrast of the first coherency measure and the contrast of the second coherency measure, selecting one between the first and second pairs of channels of the multichannel signal, wherein said multichannel signal is received via a microphone array.

37. The method according to claim 36, wherein said value of the first coherency measure is based on, for each of said different frequency components of the first pair of channels of the multichannel signal, a difference between a phase of the frequency component in a first channel of the first pair of channels of the multichannel signal and a phase of the frequency component in a second channel of the first pair of channels of the multichannel signal, and wherein said value of the second coherency measure is based on, for each of said different frequency components of the second pair of channels of the multichannel signal, a difference between a phase of the frequency component in a first channel of the second pair of channels of the multichannel signal and a phase of the frequency component in a second channel of the second pair of channels of the multichannel signal.

38. The method according to claim 36, wherein said microphone array comprises a plurality of transducers sensitive to acoustic frequencies.

39. The method according to claim 36, wherein said different frequency components of the first pair of channels of the multichannel signal are components at acoustic frequencies, and wherein said different frequency components of the second pair of channels of the multichannel signal are components at acoustic frequencies.

40. The method according to claim 36, wherein said multichannel signal is a result of performing audio preprocessing on signals produced by microphones of said microphone array.

* * * * *